US007449283B2

(12) United States Patent
Nishi et al.

(10) Patent No.: US 7,449,283 B2
(45) Date of Patent: Nov. 11, 2008

(54) PRODUCING METHOD OF ELECTROSTATIC SUCKING TYPE LIQUID JETTING HEAD, PRODUCING METHOD OF NOZZLE PLATE, DRIVING METHOD OF ELECTROSTATIC SUCKING TYPE LIQUID JETTING HEAD, ELECTROSTATIC SUCKING TYPE LIQUID JETTING APPARATUS AND LIQUID JETTING APPARATUS

(75) Inventors: Yasuo Nishi, Hino (JP); Kaoru Higuchi, Tenri (JP); Kazuhiro Murata, Tsukuba (JP); Hiroshi Yokoyama, Tsukuba (JP)

(73) Assignee: Sharp Kabushiki Kaisha (JP)

( * ) Notice: Subject to any disclaimer, the term of this patent is extended or adjusted under 35 U.S.C. 154(b) by 223 days.

(21) Appl. No.: 10/529,332

(22) PCT Filed: Sep. 22, 2003

(86) PCT No.: PCT/JP03/12101

§ 371 (c)(1), (2), (4) Date: Mar. 24, 2005

(87) PCT Pub. No.: WO2004/028815

PCT Pub. Date: Apr. 8, 2004

(65) Prior Publication Data

US 2006/0017782 A1 Jan. 26, 2006

(30) Foreign Application Priority Data

| | | |
|---|---|---|
| Sep. 24, 2002 | (JP) | 2002-278230 |
| Sep. 24, 2002 | (JP) | 2002-278233 |
| Sep. 24, 2002 | (JP) | 2002-278235 |
| Sep. 24, 2002 | (JP) | 2002-278246 |
| Aug. 13, 2003 | (JP) | 2003-293068 |
| Aug. 13, 2003 | (JP) | 2003-293082 |
| Aug. 13, 2003 | (JP) | 2003-293088 |
| Aug. 14, 2003 | (JP) | 2003-293418 |

(51) Int. Cl.
*B41J 2/06* (2006.01)
*B41J 2/16* (2006.01)

(52) U.S. Cl. ..... 430/320; 347/47; 347/55

(58) Field of Classification Search ..... None
See application file for complete search history.

(56) References Cited

U.S. PATENT DOCUMENTS

| | | | | |
|---|---|---|---|---|
| 5,477,249 | A | 12/1995 | Hotomi | |
| 6,123,415 | A | 9/2000 | Nagato et al. | |
| 6,162,589 | A * | 12/2000 | Chen et al. | 430/320 |

FOREIGN PATENT DOCUMENTS

| | | |
|---|---|---|
| EP | 0 770 486 | 1/2002 |
| EP | 1 275 440 | 1/2003 |
| JP | 48-37030 | 5/1973 |
| JP | 55-140570 | 11/1980 |
| JP | 58-148775 | 9/1983 |
| JP | 62-199451 | 9/1987 |
| JP | 1-108054 | 4/1989 |
| JP | 1-206062 | 8/1989 |
| JP | 2-235764 | 9/1990 |
| JP | 2-292049 | 12/1990 |
| JP | 4-59255 | 2/1992 |
| JP | 4-241948 | 8/1992 |
| JP | 4-338548 | 11/1992 |
| JP | 5-278212 | 10/1993 |
| JP | 9-123459 | 5/1997 |
| JP | 9-174871 | 7/1997 |
| JP | 9-193392 | 7/1997 |
| JP | 11-10885 | 1/1999 |
| JP | 11-20169 | 1/1999 |
| JP | 11-34330 | 2/1999 |
| JP | 2000-6423 | 1/2000 |
| JP | 2000-15817 | 1/2000 |
| JP | 2002-113858 | 4/2002 |
| JP | 2002-154211 | 5/2002 |
| JP | 2002-172787 | 6/2002 |
| JP | 2003-24835 | 1/2003 |
| JP | 2003-225591 | 8/2003 |

OTHER PUBLICATIONS

Office Action of Corresponding Japanese Patent Application No. 2003-293418 dated Mar. 27, 2007.

Office Action for Japanese Patent Application No. 2003-293068 with English translation mailed Nov. 7, 2006.

Office Action for Japanese Patent Application No. 2003-293082 with English translation mailed Nov. 7, 2006.

Office Action for Japanese Patent Application No. 2003-293088 with English translation mailed Nov. 7, 2006.

Office Action for Japanese Patent Application No. 2003-293418 with English translation mailed Nov. 7, 2006.

Chinese Office Action for Application No. 03822767.3 mailed May 23, 2008 with English translation.

* cited by examiner

*Primary Examiner*—John A. McPherson
(74) *Attorney, Agent, or Firm*—Cantor Colburn LLP

(57) ABSTRACT

First, through a coating step, a photolithography step and an etching step, a plurality of electrodes 142, 142, . . . are formed on a base plate 141. Next, a resist layer 143*b* is formed on the base plate 141 so as to cover all of the electrodes 142, 142, . . . , and by exposing and developing the resist layer 143*b*, a nozzle 103 having a super minute diameter is formed to stand with respect to the base plate 141 so as to make the resist layer 143*b* correspond to each electrode 142, and an in-nozzle passage is formed in each nozzle 103.

6 Claims, 44 Drawing Sheets

*FIG.7*

| NOZZLE DIAMETER (μm) | MAXIMUM ELECTRIC FIELD INTENSITY (V/m) | | COEFFICIENT OF FLUCTUATION (%) |
|---|---|---|---|
| | GAP100 (μm) | GAP2000 (μm) | |
| 0.2 | $2.001 \times 10^9$ | $2.00005 \times 10^9$ | 0.05 |
| 0.4 | $1.001 \times 10^9$ | $1.00005 \times 10^9$ | 0.09 |
| 1 | $0.401002 \times 10^9$ | $0.40005 \times 10^9$ | 0.24 |
| 8 | $0.0510196 \times 10^9$ | $0.05005 \times 10^9$ | 1.94 |
| 20 | $0.0210476 \times 10^9$ | $0.0200501 \times 10^9$ | 4.98 |
| 50 | $0.00911111 \times 10^9$ | $0.00805 \times 10^9$ | 13.18 |

FIG.28

| No. | WATER REPELLENT COATING | VOLTAGE APPLYING PATTERN AT STANDBY FOR JETTING | RESPONSIVENESS | CLOGGING |
|---|---|---|---|---|
| 1 | UNAVAILABLE | UNAVAILABLE | – | NG |
| 2 | UNAVAILABLE | AVAILABLE | 3 | OK |
| 3 | AREA 1 AVAILABLE | UNAVAILABLE | 1 | OK |
| 4 | AREA 1 AVAILABLE | AVAILABLE | 4 | OK |
| 5 | AREA 2 AVAILABLE | UNAVAILABLE | 2 | OK |
| 6 | AREA 2 AVAILABLE | AVAILABLE | 5 | OK |

FIG.38

| | CONTACT ANGLE BETWEEN PERIPHERAL MATERIAL OF NOZZLE JET OPENING AND LIQUID SOLUTION $\theta$ (°) | WATER REPELLENT COATING POSITION | MINIMUM JETTING VOLTAGE (V) | RESPONSIVENESS |
|---|---|---|---|---|
| 1 | 0 | UNAVAILABLE | 300 | 1 |
| 2 | 30 | AREA 1 | 300 | 1 |
| 3 | 45 | AREA 1 | 280 | 2 |
| 4 | 90 | AREA 1 | 260 | 3 |
| 5 | 130 | AREA 1 | 250 | 4 |
| 6 | 30 | AREA 2 | 300 | 1 |
| 7 | 45 | AREA 2 | 270 | 2 |
| 8 | 90 | AREA 2 | 250 | 4 |
| 9 | 130 | AREA 2 | 240 | 4 |

PRODUCING METHOD OF ELECTROSTATIC SUCKING TYPE LIQUID JETTING HEAD, PRODUCING METHOD OF NOZZLE PLATE, DRIVING METHOD OF ELECTROSTATIC SUCKING TYPE LIQUID JETTING HEAD, ELECTROSTATIC SUCKING TYPE LIQUID JETTING APPARATUS AND LIQUID JETTING APPARATUS

CROSS REFERENCE TO RELATED APPLICATION

This is a U.S. national stage of application No. PCT/JP2003/012101, filed on 22 Sep. 2003. Priority under 35 U.S.C. §119(a) and 35 U.S.C. §365(b) is claimed from Japanese Application Nos. 2002-278230, 2002-278233, 2002-278235, and 2002-278246, all filed 24 Sep. 2002 and Japanese Application Nos. 2003-293068, 2003-293082, and 2003-293088 all filed 13 Aug. 2003, and Japanese Application No. 2003-293418 filed on 14 Aug. 2003, the disclosures of which are also incorporated herein by reference.

FIELD OF THE INVENTION

The present invention relates to a nozzle plate producing method for producing a nozzle plate for jetting a droplet to a base member, a producing method of an electrostatic sucking type liquid jetting head comprising the nozzle plate, an electrostatic sucking type liquid jetting head driving method for driving the electrostatic sucking type liquid jetting head, an electrostatic sucking type liquid jetting apparatus comprising the electrostatic sucking type liquid jetting head, and a liquid jetting apparatus for jetting liquid to a base member.

BACKGROUND ART

As a conventional inkjet recording method, a piezo method for jetting an ink droplet by changing a shape of an ink passage according to a vibration of a piezoelectric element, a thermal method for making a heat generator provided in an ink passage heat to generate air bubbles and jetting an ink droplet according to a pressure change by the air bubbles in the ink passage, and an electrostatic sucking method for charging ink in an ink passage to jet an ink droplet by an electrostatic sucking power of the ink are known (for example, see JP-Tokukaihei-8-238774A, JP-Tokukai-2000-127410 and JP-Tokukaihei-11-277747 (FIG. 2 and FIG. 3)).

Further, conventionally, for the purpose of preventing clogging, there is an inkjet recording apparatus for forming an image by supplying ink in which a color material is dispersed into a solvent, by liberating an electrostatic force to the color material component in the ink and by making an ink droplet fly to a recording medium, the inkjet recording apparatus comprising a voltage applying section for applying a voltage to a plurality of electrodes provided on a head base, the voltage stirring the color material component in the ink (for example, see JP-Tokukaihei-9-193392 (page 3 to 6, FIG. 2).

However, the above-mentioned inkjet recording method has the following problems.

(1) Limit and Stability of a Minute Liquid Droplet Formation

Since a nozzle diameter is large, a shape of a droplet jetted from a nozzle is not stabilized, and there is a limit of making a droplet minute.

(2) High Applying Voltage

For jetting a minute droplet, miniaturization of a jet opening of the nozzle is an important factor. In a principle of the conventional electrostatic sucking method, since the nozzle diameter is large, an electric field intensity of a nozzle edge portion is weak, and therefore, in order to obtain necessary electric field intensity for jetting a droplet, it is necessary to apply a high jetting voltage (for example, extremely high voltage near 2000[V]). Accordingly, in order to apply a high voltage, a driving control of a voltage becomes expensive, and further, there is a problem in the aspect of safety.

Further, a cleaning mechanism which is effective to an electrostatic sucking type inkjet array, represented by a slit jet, comprises at least one ink container volume change generating section for changing a meniscus position of ink of a common opening part (slit), and a section for wiping the common opening part with an elastic cleaning member in a slit direction on a regular or sequential basis, wherein, before the wiping by the wiping section, a volume of the ink container is increased, the meniscus position is drawn back more than a slit width length, preferably three times more than the slit width, from a slit position, and the section performs the wiping in the slit direction under the condition that ink liquid is not contacted with the cleaning member to eliminate stain and foreign material existing on a slit surface, for preventing clogging. In an electrostatic sucking type inkjet of a type comprising a minute nozzle or comprising a minute nozzle with an edge portion thereof protruding in the present invention, such a cleaning method generates unevenness of a cleaning property and therefore it is not preferable, and further, it is not possible to manage cleaning in the minute nozzle and cleaning a passage. Further, in regard to a nozzle hole type electrostatic sucking type inkjet array, there is a method for cleaning a nozzle outside surface. However, in regard to the type comprising a minute nozzle or comprising a minute nozzle with an edge portion thereof protruding, by only cleaning the outside surface, a cleaning unevenness is similarly generated and therefore it is not preferable, and it is not possible to deal with cleaning in the minute nozzle and cleaning the passage. Therefore, an object is to accurately clean the electrostatic sucking type inkjet comprising the minute nozzle or comprising the minute nozzle with the edge portion thereof protruding so as to make no influence on clogging and landing accuracy of droplet.

Further, if a liquid jetting apparatus is not used for a long time or a specific nozzle is not used for a long time due to an operational circumstance, there is the case that aggregates of fine particles are formed by aggregating fine particles contained in liquid solution in the nozzle or in a supplying passage for supplying the liquid solution to the nozzle. For example, when aggregates are formed in the nozzle, the aggregates are clogged at a liquid solution jet opening of the nozzle, and clogging of the nozzle occurs. Further, when aggregates are formed in the supplying passage, in conjunction with liquid solution supply to the nozzle at the time of image formation or the like, the aggregates are carried to a liquid solution jet opening of the nozzle, and the aggregates are clogged at the nozzle jet opening. Further, since aggregates easily adhere to an inside surface of the supplying passage, there is a possibility that supplying of liquid solution to the nozzle is not suitably performed due to a minified cross-sectional area of the supplying passage with the aggregates adhering to the inside surface of the supplying passage. Therefore, there was a problem that it was not possible to suitably perform a liquid solution jetting from a nozzle.

In particular, since super-miniaturization of a nozzle has been in progress in conjunction with formation of a high-resolution image these days, there is a state where clogging of the nozzle easily occurs due to aggregates of fine particles in the liquid solution.

Thereupon, to provide a liquid jetting apparatus capable of jetting a minute droplet is a first object. At the same time, to provide a liquid jetting apparatus capable of jetting a stable droplet is a second object. Further, to provide a liquid jetting apparatus capable of jetting a minute droplet and having good jetting accuracy is a third object. Further, to provide a liquid jetting apparatus in which it is possible to reduce an applying voltage, the liquid jetting apparatus being cheap and having high safety, is a fourth object. Further, since there is a concern that clogging of a nozzle occurs with high frequency in conjunction with a minute-diameter nozzle and with a large number of nozzles, to prevent clogging of a nozzle by suppressing liquid solution from adhering to a circumference of the nozzle to prevent the liquid solution from being fixed to the nozzle is a fifth object.

DISCLOSURE OF THE INVENTION

In accordance with a first aspect of the present invention, at producing an electrostatic sucking type liquid jetting head having a plurality of nozzles for jetting liquid solution as a droplet from a nozzle edge, a plurality of jetting electrodes on a base plate for applying a jetting voltage are formed; a photosensitive resin layer on the base plate so as to cover all of the plurality of jetting electrodes is formed; the photosensitive resin layer is arranged to stand with respect to the base plate so as to correspond to each jetting electrode and so as to form the photosensitive resin layer in a nozzle shape having a nozzle diameter of not more than 30 μm, by exposing and developing the photosensitive resin layer; an in-nozzle passage is formed so as to establish a communication from an edge portion of the nozzle to the jetting electrode in the nozzle; and the in-nozzle passage is connected to a liquid solution supplying channel corresponding to the plurality of nozzles.

As mentioned, the nozzle is formed only by exposing and developing the photosensitive resin layer, it is beneficial in view of flexibility to a nozzle shape, responsiveness to a line head having large number of nozzles and production cost.

Hereinafter, in a case of saying a nozzle diameter, it indicates an inside diameter at the edge portion from which the droplet is jetted (inside diameter of the edge portion of the nozzle). In addition, a cross-sectional shape of a liquid jetting hole in the nozzle is not limited to a circular shape. For example, when the cross-sectional shape of the liquid jetting hole is a polygon, a starburst shape or the like, the fact that a circumcircle of the cross-sectional shape is not more than 30[μm] is indicated. Hereinafter, in a case of saying a nozzle diameter or an inside diameter of the edge portion of the nozzle, a case of defining another value is the same. Further, in a case of saying a nozzle radius, a length as much as ½ of this nozzle diameter (inside diameter at the edge portion of the nozzle) is indicated.

Preferably, at least an inside surface of each liquid solution supplying channel is made insulating; and a control electrode for controlling a meniscus position of the liquid solution at the edge portion of the nozzle is provided with the liquid solution supplying channel.

The control electrode for controlling the meniscus position is provided in the liquid solution supplying channel, and a capacity of the liquid solution supplying channel is changed by applying a voltage to the control electrode to control the meniscus position at the nozzle edge portion.

Further, making the inside surface of the liquid solution supplying channel insulating is done for preventing a stroke via the liquid solution existing between the jetting electrode and the control electrode, and an insulating layer covers the control electrodes provided in the liquid solution supplying channel. In regard to a level of the insulating layer, it is necessary to determine a material and a coating thickness in consideration of conductivity of the liquid solution and the applying voltage. For example, evaporation of a parylene resin, CVD such as $SiO_2$, $Si_3N_4$ or the like is suitable.

Preferably, the liquid solution supplying channel is formed from a piezoelectric material.

Preferably, the nozzle diameter of the nozzle is less than 20 μm, more preferably not more than 10 μm, more preferably not more than 8 μm, and more preferably 4 μm.

As mentioned, by making the inside diameter of the nozzle less than 20[μm], electric field intensity distribution becomes narrower. Thereby, it is possible to concentrate the electric field. As a result, it is possible to make the formed droplet minute and have stabilized shape, and it is possible to reduce the total applying voltage. Further, the droplet is accelerated by an electrostatic force affecting between the electric field and the electric charge right after being jetted from the nozzle, and since the electric field is drastically decreases when the droplet takes off from the nozzle, thereafter, it is decelerated by air resistance. However, the droplet being a minute droplet and to which the electric field is concentrated is accelerated by an image force as becoming closer to the base member or the counter electrode. By balancing between the deceleration by the air resistance and the acceleration by the image force, it is possible to fly the minute droplet stably, and to improve landing accuracy.

As mentioned, by making the inside diameter of the nozzle not more than 10[μm], it is possible to concentrate the electric field even more, and it is further possible to make the droplet minute and to reduce influence of the change of a distance of the counter electrode at the time of flying to the electric field intensity distribution. Therefore, it is possible to reduce influence to positional accuracy of the counter electrode, characteristic of the base member and a droplet shape of thickness, and influence to landing accuracy.

As mentioned, by making the inside diameter of the nozzle not more than 8[μm], it is possible to concentrate the electric field even more, and it is further possible to make the droplet minute and to reduce influence of the change of a distance of the counter electrode at the time of flying to the electric field intensity distribution. Therefore, it is possible to reduce influence to positional accuracy of the counter electrode, characteristic of the base member and a droplet shape of thickness, and influence to landing accuracy.

As mentioned, by making the inside diameter of the nozzle not more than 4[μm], it is possible to remarkably concentrate the electric field, to enhance the maximum electric field, to make the droplet super minute having a stable shape, and to increase initial jetting speed of the droplet. Thereby, with the flying stability improved, it is possible to further improve the landing accuracy, and to improve jetting responsiveness.

Further, preferably, the inside diameter of the nozzle is more than 0.2[μm]. Since it is possible to improve charging efficiency of the droplet by making the inside diameter of the nozzle more than 0.2[μm], it is possible to improve the jetting stability of the droplet.

Preferably, the photosensitive resin layer is a fluorine-containing resin.

In accordance with a second aspect of the present invention, at driving the electrostatic sucking type liquid jetting head produced by the producing method of the first aspect of the present invention, the edge portion of each nozzle is arranged to face the base member; the chargeable liquid solution is supplied to each liquid solution supplying channel; and the jetting voltage is applied to each of the plurality of jetting electrodes.

In addition, "base member" is an object that receives the landing of the droplet of the jetted liquid solution, and is not in particular limited in view of material. Therefore, for example, when the above-mentioned structure is applied to an inkjet printer, a recording medium such as paper, sheet or the like is equivalent to the base member, and when a circuit is formed by using conductive paste, a base on which the circuit is to be formed is equivalent to the base member.

Preferably, the liquid solution in each in-nozzle passage forms a state of rising from the edge portion of the nozzle in a convex shape.

By doing as above, since the liquid solution of the in-nozzle passage rises in a convex shape from the edge portion at the edge portion of each nozzle, an electric field is concentrated to the convex portion of the liquid solution, and electric field intensity is remarkably enhanced. Therefore, even when a voltage applied to the electrode is low, a droplet is jetted from the edge portion against a surface tension of the liquid solution for performing the flying of the droplet.

Preferably, the jetting voltage is applied to the jetting electrode when the liquid solution in each of the in-nozzle passage forms the state of rising from the edge portion in the convex shape.

In accordance with a third aspect of the present invention, an electrostatic sucking type liquid jetting apparatus comprises: the electrostatic sucking type liquid jetting head produced by the producing method of the first aspect of the present invention, so as to be capable of placing the edge portion of each nozzle to face the base member; a liquid solution supplying section for supplying the chargeable liquid solution to each in-nozzle passage; and a jetting voltage applying section for individually applying the jetting voltage to the plurality of jetting electrodes.

Preferably, the above-mentioned electrostatic sucking type liquid jetting apparatus further comprises a convex meniscus forming section for forming a state where the liquid solution of each in-nozzle passage rises in a convex shape from the edge portion of the nozzle.

By doing as above, since the liquid solution of the in-nozzle passage rises in a convex shape from the edge portion at the edge portion of each nozzle, an electric field is concentrated to the convex portion of the liquid solution, and electric field intensity is remarkably enhanced. Therefore, even when a voltage applied to the electrode is low, a droplet is jetted from the edge portion against a surface tension of the liquid solution for performing the flying of the droplet.

Preferably, the jetting voltage applying section applies the jetting voltage to the jetting electrode when the convex meniscus forming section forms the state where the liquid solution of each in-nozzle passage rises in the convex shape from the edge portion of the nozzle.

Preferably, the convex meniscus forming section comprises a piezoelectric element being so placed as to correspond to each nozzle, and the piezoelectric element changes a shape thereof for changing a pressure of the liquid solution of the in-nozzle passage.

In accordance with a fourth aspect of the present invention, at producing a nozzle plate having a plurality of nozzles for jetting liquid solution as a droplet from a nozzle edge, a plurality of jetting electrodes for applying a jetting voltage are formed on a base plate; a photosensitive resin layer is formed on the base plate so as to cover all of the plurality of jetting electrodes; the photosensitive resin layer is arranged to stand with respect to the base plate so as to correspond to the plurality of jetting electrodes respectively and so as to form the photosensitive resin layer in a nozzle shape having a nozzle diameter of not more than 30 μm, by exposing and developing the photosensitive resin layer; and an in-nozzle passage is formed so as to establish a communication from an edge portion of the nozzle to the jetting electrode in the nozzle.

As mentioned above, a nozzle is formed by only exposing and developing a photosensitive resin layer, it is advantageous in view of flexibility to a nozzle shape, responsiveness to a line head having a large number of nozzles and production cost.

Preferably, the nozzle diameter of the nozzle is less than 20 μm, more preferably not more than 10 μm, more preferably not more than 8 μm, and more preferably 4 μm.

Preferably, the photosensitive resin layer is a fluorine-containing resin.

In accordance with a fifth aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a jetting voltage applying section for applying a jetting voltage to the liquid solution in the nozzle; and a liquid solution supplying section for controlling a supplying pressure of the liquid solution so as to locate a liquid level within the nozzle while the apparatus is on standby, by supplying the liquid solution in the nozzle.

The above-mentioned "a base plate having a receiving surface for receiving a jetting of a droplet of charged liquid solution" is an object that receives the landing of a droplet of the jetted liquid solution, and is not in particular limited in view of material. For example, when the above-mentioned structure is applied to an inkjet printer, it is a recording medium such as paper, sheet or the like, and when a circuit is formed by using conductive paste, it is a base on which the circuit is to be formed.

The above-mentioned "on standby" is at a time for preparing the next jetting while the liquid jetting apparatus is functioning. The time to prepare for the next jetting is, while the liquid jetting apparatus is temporarily stopped, a state of waiting until a jetting timing comes, a state of waiting for the jetting timing, and then, in a case of the liquid jetting apparatus having a large number of nuzzles, a state where a nozzle which does not have necessity to jet is waiting for the next jetting timing.

Further, this operation does not have to be carried out at all the periods that are defined as on standby, and it is possible to carry it out by suitably selecting it according to liquid solution properties. For example, in cases of a liquid solution property of easily getting dried or a liquid solution property of easily getting aggregated, preferably it is carried out on standby of each, and in cases of a liquid solution property of not easily getting dried or a stable liquid solution property, it may be carried out at a necessary timing.

According to the fifth aspect of the present invention, the nozzle or the base member is placed so as to make the receiving surface of the droplet face the edge portion of the nozzle. The placing operation for realizing the mutual positional relationship may be done by either moving the nozzle or moving the base member.

Then, the liquid solution supplying section supplies the liquid solution in the nozzle. In order to perform the jetting, the liquid solution in the nozzle is required to be in a state of being charged. In addition, a charging-dedicated electrode for applying a voltage necessary for charging the liquid solution may be provided.

According to the fifth aspect of the present invention, since a liquid level is in the nozzle, it is possible to prevent the liquid solution from adhering to the circumference of the nozzle jet opening. Further, it is possible to prevent the liquid solution from being dried, and to prevent the liquid solution from adhering to the nozzle. Therefore, it is possible to prevent clogging of the nozzle.

Preferably, the above-mentioned liquid jetting apparatus comprises a stirring voltage applying section for applying a voltage for stirring a charged component in the liquid solution, to the liquid solution while the apparatus is on standby.

By doing as above, since it is possible to maintain a state where charged components in the liquid solution is evenly dispersed, it is possible to prevent the charged components from being aggregated. Further, since it is possible to continuously move the liquid solution, it is possible to prevent the liquid solution from adhering in the nozzle, and to prevent the liquid solution from being fixed to the nozzle. Therefore, it is possible to prevent clogging of the nozzle.

Preferably, the stirring voltage applying section is structured by structuring a hardware in common with the jetting voltage applying section so as to be capable of carrying out an operation of applying a repeating voltage oscillating within a voltage range smaller than a jetting start voltage, to the liquid solution.

By doing as above, since the jetting voltage applying section applies a voltage, it is possible to apply a voltage to the liquid solution with a simple structure. Further, since a repeating voltage, which oscillates within a voltage range smaller than the jetting start voltage is applied, it is possible to stir the charged components in the liquid solution in a state of not letting a droplet jetted, and it is possible to prevent the charged components from being aggregated. Further, since it is possible to continuously move the liquid solution, it is possible to prevent the liquid solution from adhering in the nozzle, and to prevent the liquid solution from being fixed to the nozzle. Therefore, it is possible to prevent clogging of the nozzle.

Preferably, at least an inside surface of a passage of the nozzle is insulating, and a fluid supplying electrode is placed at a circumference of the liquid solution in the passage and outside of the insulating portion.

The above-mentioned "a fluid supplying electrode is placed outside of the insulating portion" means both of: placing the fluid supplying electrode inside of the nozzle through an insulating coating, and forming the whole nozzle from insulating material and placing the fluid supplying electrode outside of the nozzle.

In general, by having an electric potential difference between an electrode placed by insulating an inside surface of a tube passage and through the insulating portion, and an electrode for applying a voltage to the liquid solution inside of the tube passage, when the voltage is applied to each electrode, wettability of the liquid solution with respect to the insulating inside surface of the tube passage is improved, in other words, it is possible to obtain an effect of the so-called electrowetting phenomenon.

By doing as above, by providing an electric potential difference between an applying voltage by the fluid supplying electrode placed outside of the insulating portion of the inside surface of the nozzle and an applying voltage by the jetting voltage applying section, it is possible to improve wettability in the nozzle according to the electrowetting effect, and it is possible to achieve smoothing the liquid solution supply in the nozzle according to the electrowetting effect.

It is good when the inside diameter of the edge portion of the nozzle is less than 20 μm, more preferably not more than 10 μm, more preferably not more than 8 μm, and more preferably 4 μm.

Preferably, a coating having higher water repellency than the base member of the nozzle is formed at a circumferential portion of a jet opening of the nozzle.

By doing as above, since it is possible to suppress the liquid solution from adhering to the circumferential portion of the jet opening of the nozzle, it is possible to prevent the liquid solution from being fixed to the nozzle. Therefore, it is possible to prevent clogging of the nozzle.

Preferably, a coating having higher water repellency than the base member of the nozzle is formed at the inside surface of the nozzle.

By doing as above, since it is possible to suppress the liquid solution from adhering to the inside surface of the nozzle, it is possible to prevent the liquid solution from being fixed to the nozzle. Therefore, it is possible to prevent clogging of the nozzle.

Preferably, the nozzle is formed from a fluorine-containing photosensitive resin.

By doing as above, since it is possible to suppress the liquid solution from adhering to the nozzle, it is possible to prevent the liquid solution from being fixed to the nozzle. Therefore, it is possible to prevent clogging of the nozzle.

In accordance with a sixth aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a liquid solution supplying section for supplying the liquid solution in the nozzle; a jetting voltage applying section for applying a jetting voltage to the liquid solution in the nozzle; and a coating formed on an edge surface of the nozzle where a jet opening of the nozzle opens, in a circular shape surrounding the jet opening, having higher water repellency than a nozzle base member, wherein the apparatus jets the droplet when a liquid level of the liquid solution is in a state of being in a convex meniscus shape at outside of the nozzle so as to make a diameter the liquid level equal to an inside diameter of the coating.

By doing as above, when the jetting voltage applying section applies a voltage while a liquid level of the liquid solution has a diameter equal to the inside diameter of the coating and in a state of being a convex meniscus shape to outside of the nozzle, a droplet is jetted from the nozzle.

"Base plate having a receiving surface for receiving a jetting of a droplet of charged liquid solution" is an object for receiving the landing of a droplet of the jetted liquid solution, and is not in particular limited in view of material. For example, when the above-mentioned structure is applied to an inkjet printer, it is a recording medium such as paper, sheet or the like, and when a circuit is formed by using conductive paste, it is a base on which the circuit is to be formed.

According to the sixth aspect of the present invention, the nozzle or the base member is places so as to make the receiving surface of the droplet face the edge portion of the nozzle. A positioning operation to realize these mutual relations may be done by moving the nozzle or by moving the base member.

Then, the liquid solution supplying section supplies the liquid solution in the nozzle. The liquid solution in the nozzle is required to be in a state of being charged for performing the jetting. In addition, a charging-dedicated electrode for applying a voltage for charging the liquid solution may also be provided.

When the jetting voltage is applied to the liquid solution in the nozzle, the liquid solution is guided to the edge side of the nozzle according to an electrostatic force, and a convex meniscus denting to outside is formed. An electric field is concentrated to the top of this convex meniscus, and a droplet is jetted against a surface tension of the liquid solution.

When water repellency of the circumference of the jet opening of the nozzle is low, the liquid solution spreads over the edge surface of the nozzle while a curvature of the convex meniscus is small.

However, according to the sixth aspect of the present invention, since a coating having higher water repellency than the nozzle base member is formed on the nozzle edge surface where the jet opening of the nozzle opens in a ring shape surrounding the jet opening, the liquid solution does not easily spread from the inside diameter of the coating to outside. Therefore, at the nozzle edge portion, it is possible to make a curvature of the convex meniscus formed with its diameter equal to the inside diameter of the coating higher, and it is possible to concentrate the electric field to the top of the meniscus with higher concentration. As a result, it is possible to make the droplet minute. Further, since it is possible to form a meniscus having a minute diameter, the electric field is easily concentrated to the top of the meniscus, and it is possible to make the jetting voltage become a low voltage.

For making the jetted droplet minute, preferably the inside diameter of the coating in a ring shape surrounding the jet opening is set equal to the inside diameter of the nozzle.

Preferably, the inside diameter of the edge portion of the nozzle is less than 20 μm, more preferably not more than 10 μm, more preferably not more than 8 μm, and more preferably 4 μm.

In accordance with a seventh aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a liquid solution supplying section for supplying the liquid solution in the nozzle; a jetting voltage applying section for applying a jetting voltage to the liquid solution in the nozzle; and a coating formed on an edge surface of the nozzle where a jet opening of the nozzle opens, in a circular shape surrounding the jet opening, having higher water repellency than an inside surface of the nozzle, wherein the apparatus jets the droplet when a liquid level of the liquid solution is in a state of being in a convex meniscus shape at outside of the nozzle so as to make a diameter the liquid level equal to an inside diameter of the coating.

By doing as above, when the jetting voltage applying section applies a voltage while a liquid level of the liquid solution has a diameter equal to the inside diameter of the coating and in a state of being a convex meniscus-shape to outside of the nozzle, a droplet is jetted from the nozzle.

According to the seventh aspect of the present invention, since a coating having higher water repellency than the inside surface of the nozzle is formed on the nozzle edge surface where the jet opening of the nozzle opens, in a ring shape surrounding the jet opening, compared to the case that water repellency of the inside surface of the nozzle is equal to that of the edge surface of the nozzle, the liquid solution does not easily wet and spread to outside from the inside diameter of the coating. Therefore, at the nozzle edge portion, it is possible to make a curvature of the convex meniscus formed with its diameter equal to the inside diameter of the coating higher, and it is possible to concentrate the electric field to the top of the meniscus with higher concentration. As a result, it is possible to make the droplet minute. Further, since it is possible to form a meniscus having a minute diameter, the electric field is easily concentrated to the top of the meniscus, and it is possible to make the jetting voltage become a low voltage.

Preferably, the inside diameter of the edge portion of the nozzle is less than 20 μm, more preferably not more than 10 μm, more preferably not more than 8 μm, and more preferably 4 μm.

In accordance with an eighth aspect of the present invention, a liquid jetting apparatus comprises: a nozzle having an edge portion facing a base plate having a receiving surface for receiving a jetting of a droplet of charged liquid solution, the nozzle being formed from a fluorine-containing photosensitive resin, the nozzle having an inside diameter of not more than 30 μm, for jetting the droplet from the edge portion; a liquid solution supplying section for supplying the liquid solution in the nozzle; and a jetting voltage applying section for applying a jetting voltage to the liquid solution in the nozzle.

According to the eighth aspect of the present invention, since the nozzle is formed from fluorine-containing resin, the liquid solution does not easily wet and spread. Therefore, at the nozzle edge portion, it is possible to make a curvature of the convex meniscus formed with its diameter equal to the inside diameter of the coating higher, and it is possible to concentrate the electric field to the top of the meniscus with higher concentration. As a result, it is possible to make the droplet minute. Further, since it is possible to form a meniscus having a minute diameter, the electric field is easily concentrated to the top of the meniscus, and it is possible to make the jetting voltage become a low voltage. Further, since it is possible to suppress the liquid solution from adhering to the nozzle, it is possible to prevent the liquid solution from being fixed to the nozzle, and it is possible to suppress clogging of the nozzle.

Preferably, the inside diameter of the edge portion of the nozzle is less than 20 μm, more preferably not more than 10 μm, more preferably not more than 8 μm, and more preferably 4 μm.

In accordance with a ninth aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a liquid solution supplying section for supplying the liquid solution in the nozzle; and a jetting voltage applying section for applying a jetting voltage to the liquid solution in the nozzle, wherein the liquid solution forms a contact angle with respect to a circumferential material of the jet opening at not less than 45 degree.

According to the ninth aspect of the present invention, since a contact angle between the liquid solution and the circumferential material of the jet opening of the nozzle is not less than 45 degree, the liquid solution does not easily wet and spread to the circumference of the jet opening of the nozzle. Therefore, at the nozzle edge portion, it is possible to make a curvature of the convex meniscus formed with its diameter equal to the inside diameter of the coating higher, and it is possible to concentrate the electric field to the top of the meniscus with higher concentration. As a result, it is possible to make the droplet minute. Further, since it is possible to form a meniscus having a minute diameter, the electric field is easily concentrated to the top of the meniscus, and it is possible to make the jetting voltage become a low voltage.

In accordance with a tenth aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a liquid solution supplying section for supplying the liquid solution in the nozzle; and a jetting voltage applying section for applying a jetting voltage to the liquid solution in the nozzle, wherein the liquid solution forms a contact angle with respect to a circumferential material of the jet opening at not less than 90 degree.

According to the tenth aspect of the present invention, since a contact angle between the liquid solution and the circumferential material of the jet opening of the nozzle is not less than 90 degree, the liquid solution does not easily wet and spread to the circumference of the jet opening of the nozzle. Therefore, at the nozzle edge portion, it is possible to make a curvature of the convex meniscus even higher, and it is possible to concentrate the electric field to the top of the meniscus with even higher concentration. As a result, it is possible to make the droplet minute. Further, since it is possible to form a meniscus having a minute diameter, the electric field is easily concentrated to the top of the meniscus, and it is possible to make the jetting voltage become a low voltage. Further, when the contact angle becomes not less than 90 degree, formation of the meniscus shape becomes stable and stabilization of jetted droplet amount becomes easy. Thereby, responsiveness is improved.

In accordance with an eleventh aspect of the present invention, a liquid jetting apparatus comprises: a nozzle having an edge portion facing a base plate having a receiving surface for receiving a jetting of a droplet of charged liquid solution, the nozzle having an inside diameter of not more than 30 μm, for jetting the droplet from the edge portion; a liquid solution supplying section for supplying the liquid solution in the nozzle; and a jetting voltage applying section for applying a jetting voltage to the liquid solution in the nozzle, wherein the liquid solution forms a contact angle with respect to a circumferential material of the jet opening at not less than 130 degree.

According to the eleventh aspect of the present invention, since a contact angle between the liquid solution and the circumferential material of the jet opening of the nozzle is not less than 90 degree, the liquid solution does not easily wet and spread to the circumference of the jet opening of the nozzle. Therefore, at the nozzle edge portion, it is possible to make a curvature of the convex meniscus even higher, and it is possible to concentrate the electric field to the top of the meniscus with even higher concentration. As a result, it is possible to make the droplet minute. Further, since it is possible to form a meniscus having a minute diameter, the electric field is easily concentrated to the top of the meniscus, and it is possible to make the jetting voltage become a low voltage. Further, when the contact angle becomes not less than 130 degree, formation of the meniscus shape becomes remarkably stable and stabilization of jetted droplet amount becomes easier. Thereby, responsiveness is improved more.

Preferably, the inside diameter of the edge portion of the nozzle is less than 20 μm, more preferably not more than 10 μm, more preferably not more than 8 μm, and more preferably 4 μm.

In accordance with a twelfth aspect of the present invention, a liquid jetting apparatus comprises: a nozzle having a nozzle diameter of not more than 30[μm]; a supplying passage for guiding liquid solution to the nozzle; and a jetting voltage applying section for applying a jetting voltage to the liquid solution in the nozzle, wherein the apparatus jets the charged liquid solution as a droplet from an edge portion of the nozzle, to a base member being so placed as to face the edge portion based on the applying of the jetting voltage to the liquid solution in the nozzle by the jetting voltage applying section, and the apparatus further comprises a cleaning device for circulating cleaning solvent in the nozzle, or in the nozzle and in the supplying passage, for cleaning the nozzle, or the nozzle and the supplying passage with the cleaning solvent.

"Base member" is an object for receiving the landing of a droplet of the jetted liquid solution, and is not in particular limited in view of material. Therefore, for example, when the above-mentioned structure is applied to an inkjet printer, a recording medium such as paper, sheet or the like is equivalent to the base member, and when a circuit is formed by using conductive paste, a base on which the circuit is to be formed is equivalent to the base member.

The nozzle or the base member is placed so as to make the liquid solution receiving surface face the edge portion of the nozzle. A positioning operation for realizing these mutual relations may be done by moving the nozzle or by moving the base member.

Then, the liquid solution in the nozzle is required to be in a state of being charged for performing the jetting. Charging of the liquid solution may be done by applying a voltage by a charging-dedicated electrode within a range within which the jetting is not performed by the jetting voltage applying section, which applies the jetting voltage.

According to the twelfth aspect of the present invention, a cleaning device for cleaning the nozzle, or the nozzle and the supplying passage with cleaning solvent is provided. Then, by the cleaning device, the cleaning solvent is circuited in the nozzle, or in the nozzle and in the supplying passage. For example, when the liquid solution contains fine particles, there is a possibility of having clogging of the nozzle happen with aggregates of the fine particles aggregated in the nozzle or in the supplying passage clogging at an opening from which the liquid solution is jetted, the opening being at the edge portion of the nozzle (hereinafter, it is called "jet opening"). However, by circulating the cleaning solvent in the nozzle, or in the nozzle and in the supplying passage, the aggregates of fine particles existing in the nozzle and in the supplying passage are drained to outside, whereby it is possible to clean in the nozzle and in the supplying passage. Further, even when the aggregates of fine particles are fixed to the inside surface of the supplying passage or in the nozzle, by eliminating the aggregates from the inside surface of the supplying passage according to a cleaning effect of the circulated cleaning solvent, the inside surface and inside of the nozzle are cleaned. Further, for example, even in the case that impurities such as contaminant, solid contents generated by solidifying the liquid solution exist in the nozzle or in the supplying passage, the impurities are drained by the cleaning solvent.

In this way, since it is possible to clean in the nozzle and in the supplying passage, even with a nozzle having a nozzle diameter of not more than 30[μm], clogging of the nozzle does not easily occur at the time of jetting the liquid solution, whereby it is possible to prevent clogging of the nozzle.

Preferably, the cleaning device circulates the cleaning solvent along a supplying direction of the liquid solution to the nozzle.

By doing as above, the cleaning device circulates the cleaning solvent along the supplying direction of the liquid solution to the nozzle. In other words, the cleaning solvent is put in the supplying passage and flown to the nozzle side in this supplying passage, and drained to outside from the edge portion of the nozzle. Therefore, for example, when the liquid solution exists in the supplying passage, the circulated cleaning solvent pushes the liquid solution in the supplying passage to the nozzle side, for draining the liquid solution to outside from the edge portion of the nozzle.

Preferably, the cleaning device comprises: a cap member for covering an outside surface of the nozzle from a side of the edge portion; and a sucking pump for sucking inside of the nozzle via the cap member.

By doing as above, the cleaning device comprises a cap member for covering the outside surface of the nozzle from the edge portion side of the nozzle, and a sucking pump for sucking in the nozzle via the cap member. Thereby, the sucking pump sucks the liquid solution, cleaning solvent or the like existing in the nozzle via the cap member. In other words, in the case of circulating the cleaning solvent in the nozzle and in the supplying passage, when the liquid solution exists in the nozzle or in the supplying passage, the sucking pump sucks the liquid solution, and sucks the cleaning solvent so as to circulate the cleaning solvent in the nozzle, or in the nozzle and in the supplying passage.

Further, the sucking pump may be used for supplying the liquid solution in the nozzle, and in this case, for example, the sucking pump sucks the liquid solution so as to supply the liquid solution in the liquid solution containing unit, in which the liquid solution is contained, in the nozzle.

Here, circulating the cleaning solvent in the nozzle, or in the nozzle and in the supplying passage and supplying the liquid solution in the nozzle may be done by a single sucking pump. In other words, for example, by having a structure comprising a switching section capable of switching between circulating the cleaning solvent and supplying the liquid solution, it is possible to realize circulating the cleaning solvent and supplying the liquid solution by a single sucking pump.

Preferably, the cleaning device comprises a head portion having a jetting hole capable of jetting the cleaning solvent toward the outside surface of the nozzle.

Here, what is important is that the cleaning solvent jetted to the nozzle outside surface is approximately perpendicularly jetted at least to the nozzle edge surface in a case of a protruding type nozzle shape, or approximately perpendicularly jetted to the nozzle hole and the circumference of the nozzle hole in a case of a flat type nozzle shape, and preferably its speed is fast.

By doing as above, the cleaning device comprises a head portion having a jetting hole capable of jetting the cleaning solvent toward the outside surface of the nozzle. Thereby, since the cleaning solvent is jetted from the jetting hole of the head portion toward the outside surface of the nozzle, the outside surface is cleaned by the cleaning solvent. In other words, for example, by repeating the jetting of the liquid solution from the nozzle, at the outside surface of the nozzle, in particular the outside surface of the edge portion side of the nozzle, the liquid solution adheres and gets fixed for generating fixing material. Then, with the adhering and getting fixed of the liquid solution repeated, the fixing material gets fixed up to the liquid solution jet opening at the edge portion, and there is a possibility of clogging of the nozzle occurring. However, by jetting the cleaning solvent toward the edge portion of the nozzle, according to a cleaning effect of the cleaning solvent, it is possible to eliminate the fixing material of the liquid solution existing at the outside surface of the edge portion side of the nozzle, and the fixing material existing at the liquid solution jet opening. Thereby, it is possible to prevent clogging of the nozzle.

Preferably, a jet hole capable of jetting the cleaning solvent toward the outside surface of the nozzle is placed at the cap member, and the sucking pump sucks the cleaning solvent jetted to the outside surface from the jet hole.

By doing as above, it is possible to suck the cleaning solvent jetted to the outside surface of the nozzle from the jetting hole provided with the cap member. In other words, it is possible to do the jetting of the cleaning solvent to the outside surface of the nozzle, and do the sucking of the jetted cleaning solvent by the sucking pump, via a single cap member. That is, it is possible to clean and eliminate the fixing material at the nozzle edge portion where clogging easily occurs, by the cleaning solvent jetted from the cap member toward the nozzle hole, and continuously, to smoothly clean the inside of the nozzle and the supplying passage of the jetted liquid solution according to a sucking operation by the sucking pump.

Preferably, a vibration of high frequency is given to the cleaning solvent.

By doing as above, for example, since a vibration having high frequency of megahertz is given to the cleaning solvent, by accelerating water particles, it is possible to easily clean and eliminate fine particles of submicron, which is difficult to eliminate with normal fluid cleaning solvent.

Preferably, the liquid jetting apparatus comprises a liquid solution containing section for containing the liquid solution supplied to the nozzle via the supplying passage; and a vibration generating device for dispersing fine particles included in the liquid solution by giving the vibration to the liquid solution contained in the liquid solution containing section.

Here, the fine particles are various fine particles and included in components structuring a solute in the liquid solution, and when the liquid solution is an ink, the fine particles are equivalent to various particles structuring components such as coloring material, addition agent, dispersing agent or the like, and when the liquid solution is a conductive paste, the fine particles are equivalent to particles such as various metal, for example, Ag (Argentums), Au (Aurum) and the like.

By doing as above, the liquid solution containing unit for containing the liquid solution that is to be supplied to the nozzle via the supplying passage is provided. Further, a vibration generating device for dispersing the fine particles included in the liquid solution by giving a vibration to the liquid solution contained in the liquid solution containing unit is provided. Thereby, since the vibration generating device gives the vibration to the liquid solution contained in the liquid solution containing unit for stirring and dispersing the fine particles in the liquid solution, a density of the fine particles in the liquid solution becomes in a state without unevenness. In other words, the fine particles do not easily aggregate to form the aggregate. Therefore, for example, when the liquid solution is supplied from the liquid solution containing unit to the nozzle, it is possible to reduce a possibility of the aggregate clogging at the nozzle, and to reduce a possibility of the aggregate of the fine particles clogging at the nozzle or the supplying passage.

Further, since the vibration generating device gives the vibration to the liquid solution by irradiating supersonic wave, it is possible to give the fine vibration generated based on the irradiation of supersonic wave to the fine particles in the liquid solution via solvent, to stir and disperse the fine particles efficiently, and to provide a state of the density of the fine particles without unevenness.

Further, by irradiating supersonic wave from outside of the liquid solution containing unit, it is possible to give the vibration to the liquid solution without contacting the liquid solution, and it is possible to suitably disperse the fine particles in the liquid solution. Therefore, it is possible to enhance operation efficiency regarding the disperse of the fine particles in the liquid solution.

Preferably, the cleaning device is capable of stopping the circulating of the cleaning solvent in a state where the cleaning solvent fills the nozzle, or the nozzle and the supplying passage, when the jetting of the liquid solution from the nozzle is stopped.

By doing as above, since the cleaning device stops the circulation of the cleaning solvent when the nozzle does not jet the liquid solution, in a state where the cleaning solvent fills the nozzle, or the nozzle and the supplying passage, for example, even in the case that the aggregates of the fine particles, impurities or the like are fixed in the supplying passage or in the nozzle, it is possible to secure sufficient time for the cleaning solvent to affect the aggregates of the fine particles, the impurities or the like. Therefore, it is possible to effectively clean in the nozzle or in the supplying passage.

Preferably, the nozzle diameter is less than 20 μm, more preferably not more than 10 μm, more preferably not more than 8 μm, and more preferably 4 μm.

According to the present invention, it is characterized in providing a nozzle having a super-minute diameter, which is not found conventionally, for concentrating an electric field to the nozzle edge portion and enhancing electric field intensity. In regard to miniaturizing a diameter of the nozzle, description will be made in detail later. In such a case, it is possible to jet a droplet without a counter electrode facing the edge portion of the nozzle. For example, in a state where the counter electrode does not exist and a base member is so placed as to face the nozzle edge portion, when the base member is conductive material, an image charge having reversed polarity is induced to a position being plane symmetric to the nozzle edge portion with respect to the receiving surface of the base member, and when the base member is insulating material, image charge having opposite polarity is induced at a symmetrical position determined by conductivity of the base member with respect to the receiving surface of the base member. Then, flying of a droplet is performed according to an electrostatic force between the charge induced at the nozzle edge portion and the image charge.

However, although it is possible not to necessitate the counter electrode, the counter electrode may be used together. When the counter electrode is used together, it is desirous that the base member is placed in a state of being along the facing surface of the counter electrode and the facing surface of the counter electrode is placed perpendicularly to a droplet jetting direction from the nozzle. It is possible to use the electrostatic force by the electric field between the nozzle and the counter electrode together, for guiding a flying electrode, and by grounding the counter electrode, it is possible to let electric charge of a charged droplet out via the counter electrode, and it is possible to obtain an effect of reducing accumulation of electric charge. Therefore, using the counter electrode together is rather more desirous structure.

(1) Preferably, the nozzle is formed from electrically insulating material, and an electrode for applying the jetting voltage is inserted in the nozzle or a plating formation functioning as the electrode is performed.

(2) Preferably, the nozzle is formed from electrically insulating material, and the electrode is inserted into the nozzle, or plating as the electrode is formed and an electrode for jetting is also provided at outside of the nozzle.

The electrode for jetting at outside of the nozzle is, for example, provided at the end surface of the nozzle edge side, over the whole circumference of the side surface of the nozzle edge portion side or part thereof.

By doing as (1) and (2), in addition to the above-mentioned effects by the present invention, it is possible to improve a jetting force. Therefore, even when the nozzle diameter is further miniaturized, it is possible to jet a droplet at a low voltage.

(3) Preferably, the base member is formed from conductive material or insulating material.

(4) Preferably, a jetting voltage V applied to the jetting electrode satisfies a range of the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of the liquid solution [N/m], $\epsilon_0$: electric constant [F/m], d: nozzle diameter [m], h: distance between nozzle and base member [m], and k: proportionality constant depending on nozzle shape (1.5<k<8.5).

(5) Preferably, the applied jetting voltage is not more than 1000[V].

By setting the upper limit of the jetting voltage in this way, it is possible to make the jetting control easy and to easily improve reliability by improving durability of the apparatus and by performing safety measures.

(6) Preferably, the applied jetting voltage is not more than 500[V.

By setting the upper limit of the jetting voltage in this way, it is possible to make the jetting control easier and to easily improve reliability further by further improving durability of the apparatus and by performing safety measures.

(7) It is preferable to set a distance between the nozzle and the base member to not more than 500[μm], because it is possible to obtain high landing accuracy even when the nozzle diameter is made minute.

(8) Preferably, a pressure is applied to the liquid solution in the nozzle.

(9) When the jetting is performed at a single pulse, a pulse width Δt which is not less than a time constant τ determined by the following equation (2) may be applied.

$$\tau = \frac{\varepsilon}{\sigma} \tag{2}$$

where ε: dielectric constant of liquid solution [F/m], and σ: conductivity of liquid solution [S/m].

BRIEF DESCRIPTION OF DRAWINGS

FIG. 7 is a chart showing a maximum electric field intensity under each condition of FIG. 1 to FIG. 6, FIG. 28 is a diagram showing an experimental condition and an experimental result of an experiment example using the liquid jetting apparatus 1020 in the second embodiment, FIG. 38 is a diagram showing a condition and a result of an experiment for comparing an effect of a water repellent coating process at the nozzle.

BEST MODE FOR CARRYING OUT THE INVENTION

Figure 1A:
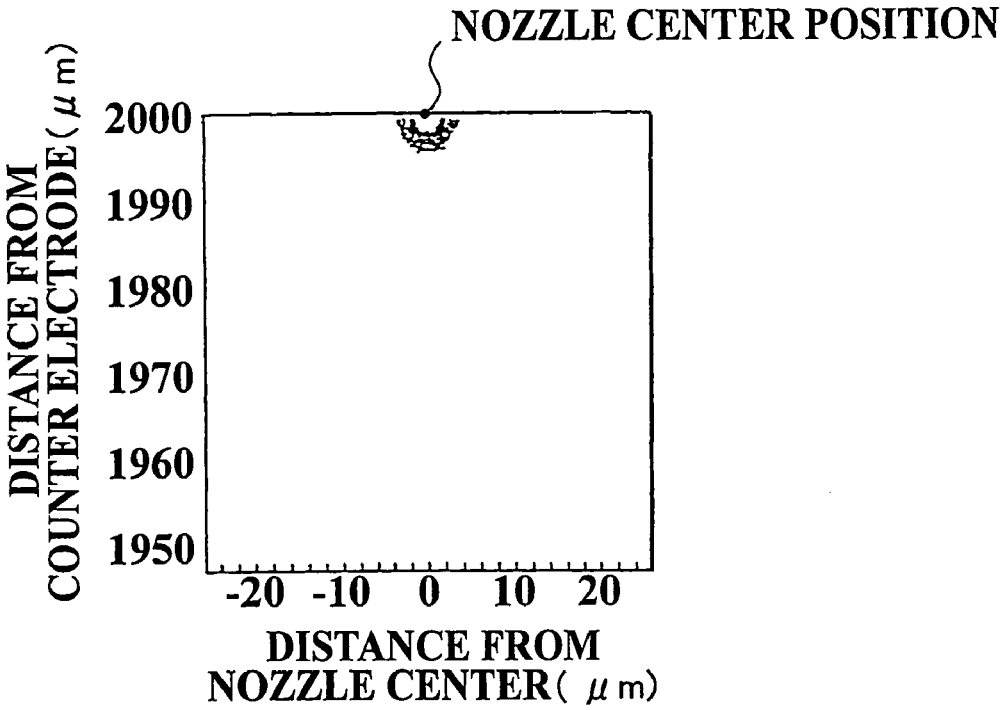
FIG. 1A is a view showing an electric field intensity distribution with a nozzle diameter as Φ0.2[μm] and with a distance from a nozzle to a counter electrode set to 2000[μm]
Figure 1B:
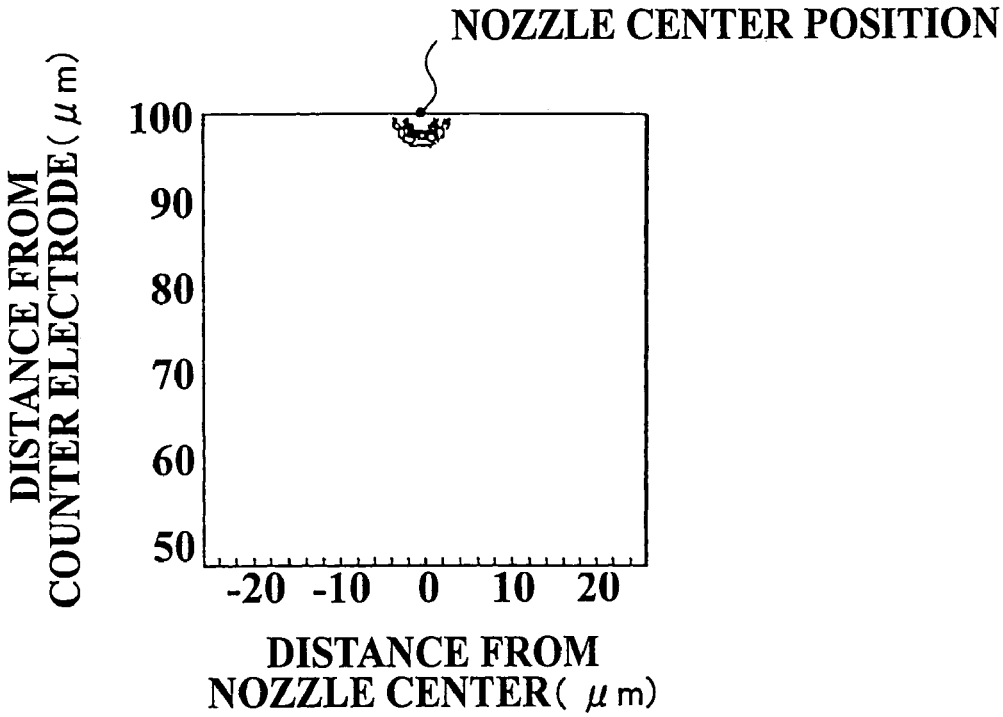
FIG. 1B is a view showing an electric field intensity distribution with the nozzle diameter as Φ0.2[μm] and with a distance from a nozzle to a counter electrode set to 100[μm]
Figure 2A:
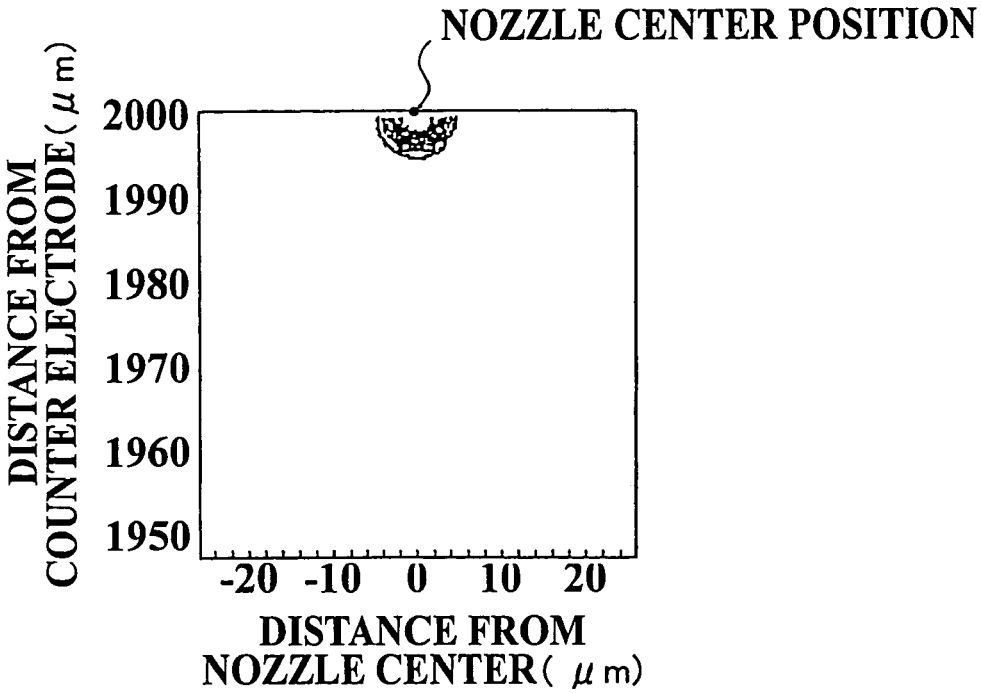
FIG. 2A is a view showing an electric field intensity distribution with the nozzle diameter as Φ0.4[μm] and with a distance from a nozzle to a counter electrode set to 2000[μm]
Figure 2B:
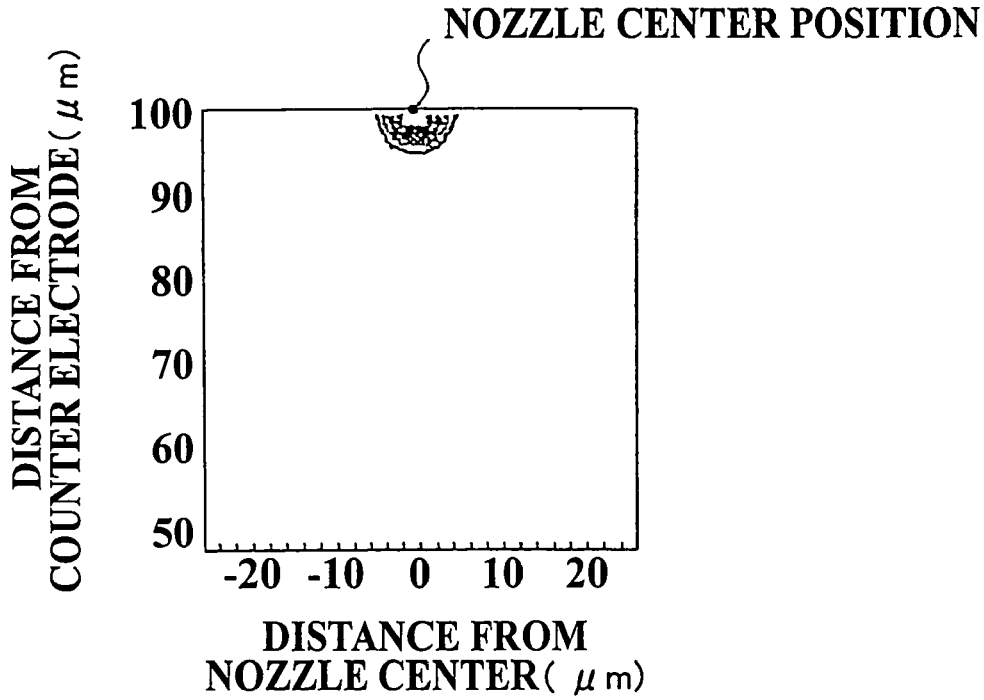
FIG. 2B is a view showing an electric field intensity distribution with the nozzle diameter as Φ0.4[μm] and with a distance from a nozzle to a counter electrode set to 100[μm]
Figure 3A:
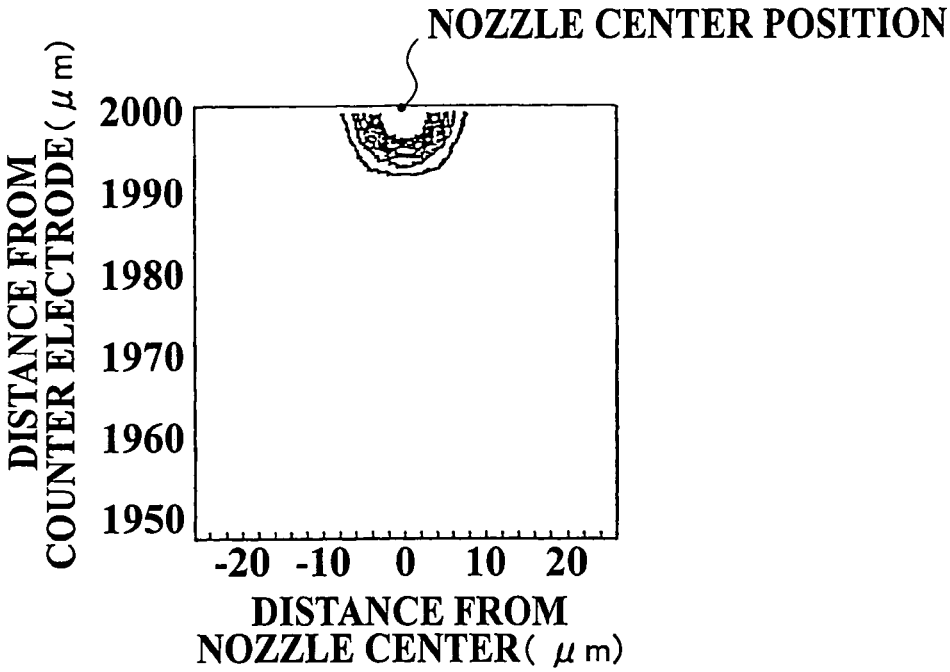
FIG. 3A is a view showing an electric field intensity distribution with the nozzle diameter as Φ1[μm] and with a distance from a nozzle to a counter electrode set to 2000[μm]
Figure 3B:
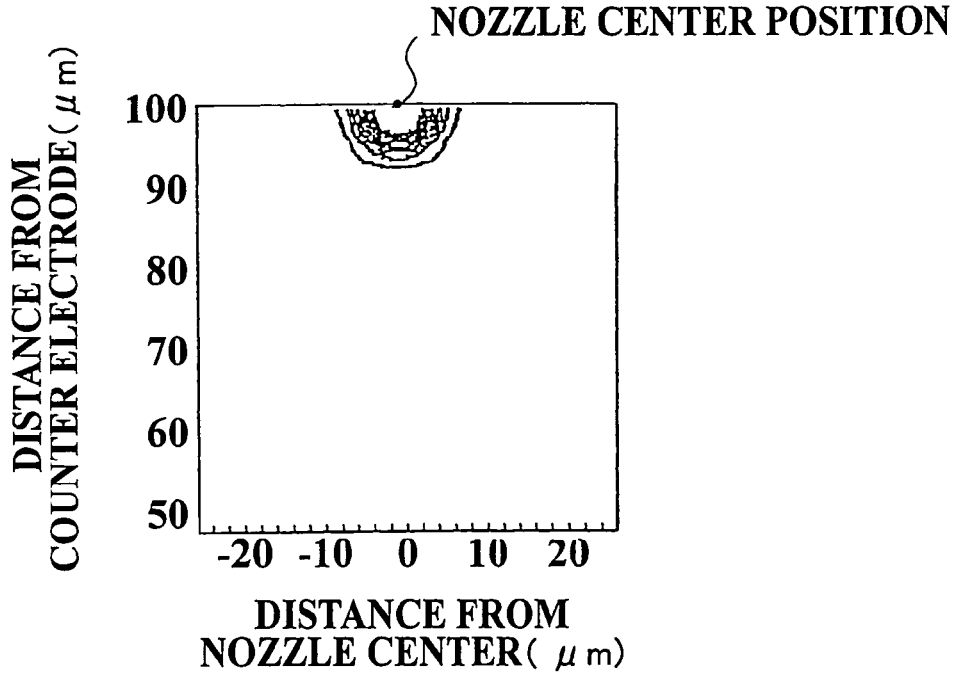
FIG. 3B is a view showing an electric field intensity distribution with the nozzle diameter as Φ1[μm] and with a distance from a nozzle to a counter electrode set to 100[μm]
Figure 4A:
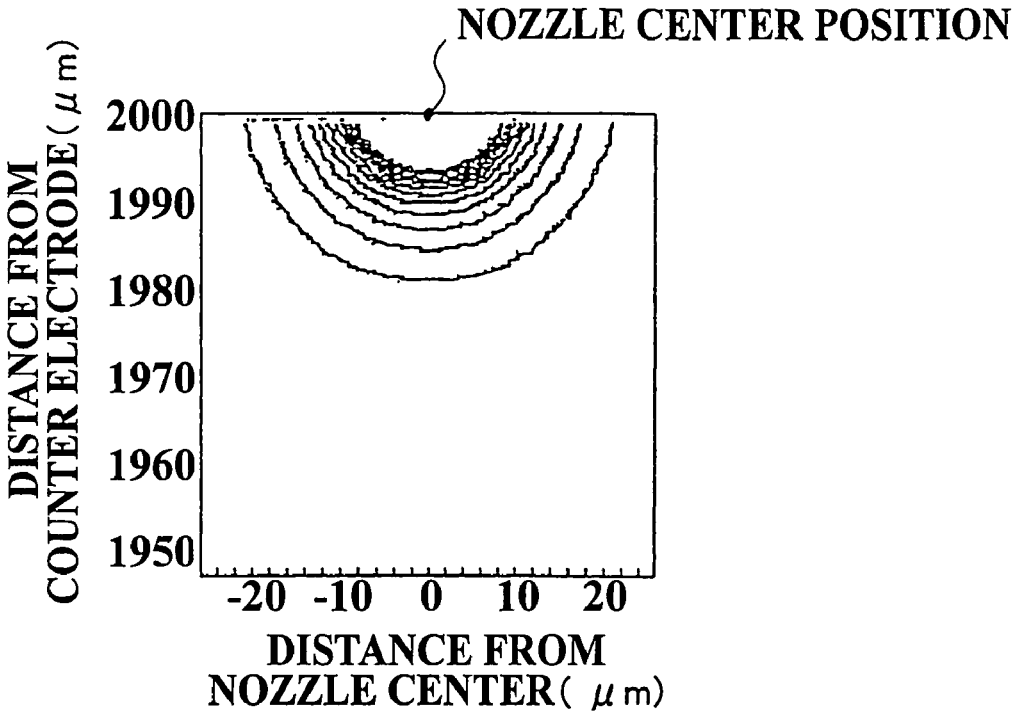
FIG. 4A is a view showing an electric field intensity distribution with the nozzle diameter as Φ8[μm] and with a distance from a nozzle to a counter electrode set to 2000[μm]
Figure 4B:
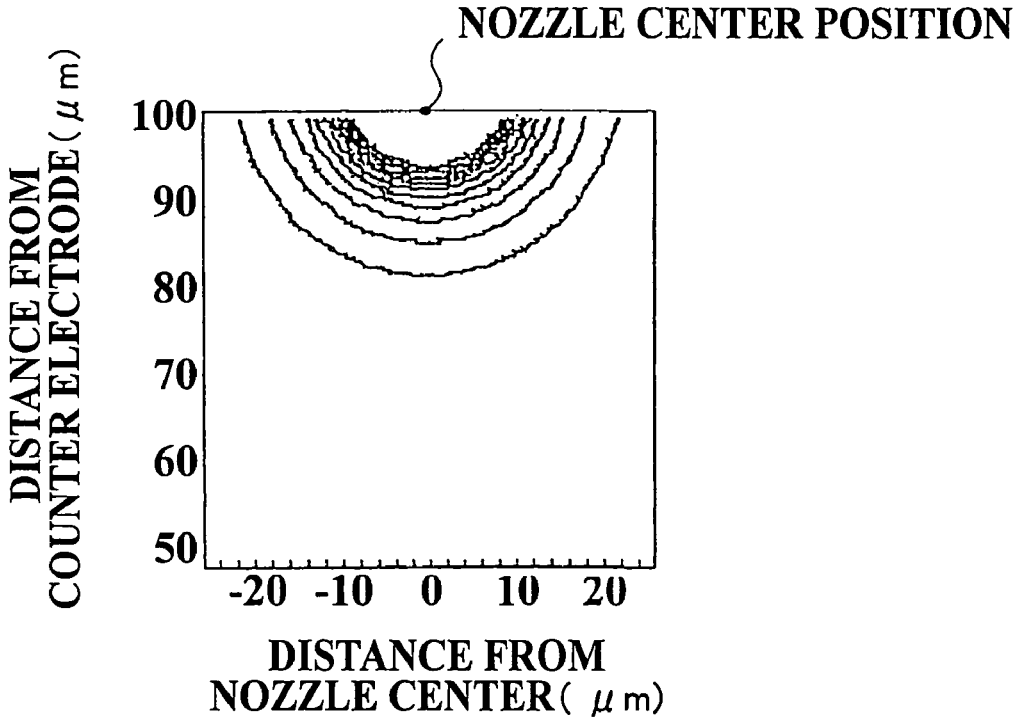
FIG. 4B is a view showing an electric field intensity distribution with the nozzle diameter as Φ8[μm] and with a distance from a nozzle to a counter electrode set to 100[μm]
Figure 5A:
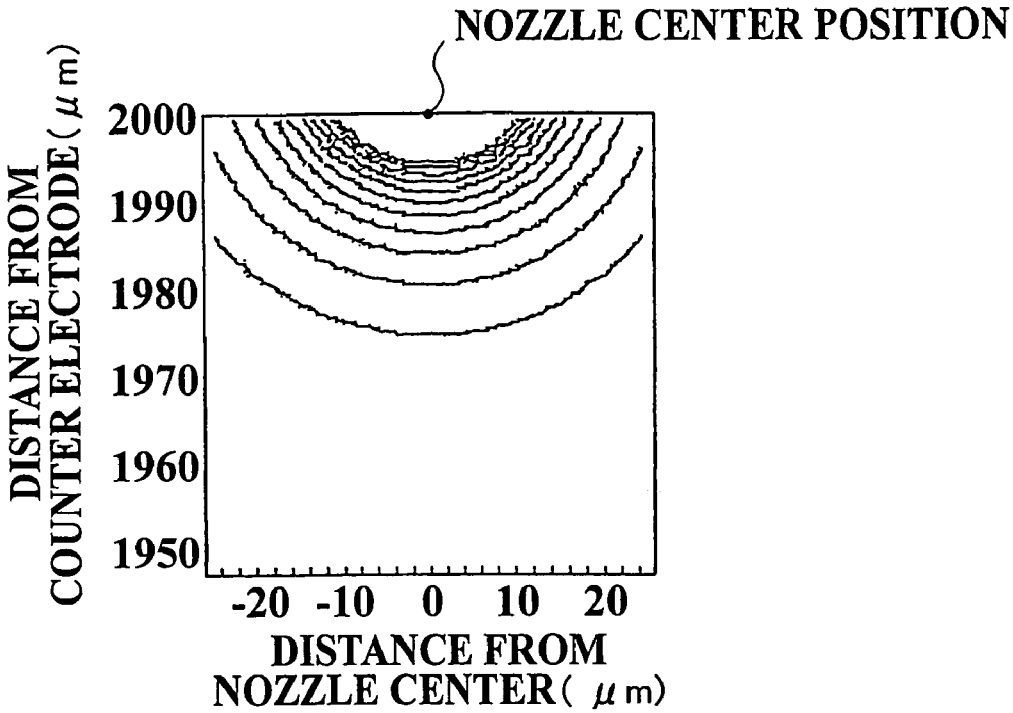
FIG. 5A is a view showing an electric field intensity distribution with the nozzle diameter as Φ20[μm] and with a distance from a nozzle to a counter electrode set to 2000[μm]
Figure 5B:
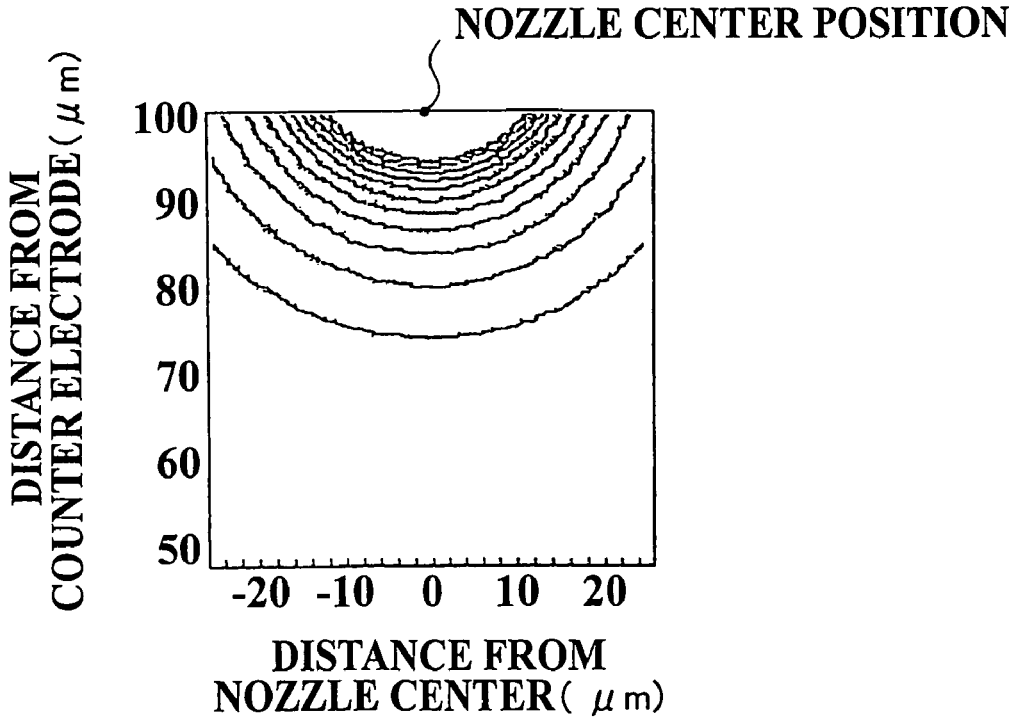
FIG. 5B is a view showing an electric field intensity distribution with the nozzle diameter as Φ20[μm] and with a distance from a nozzle to a counter electrode set to 100[μm]
Figure 6A:
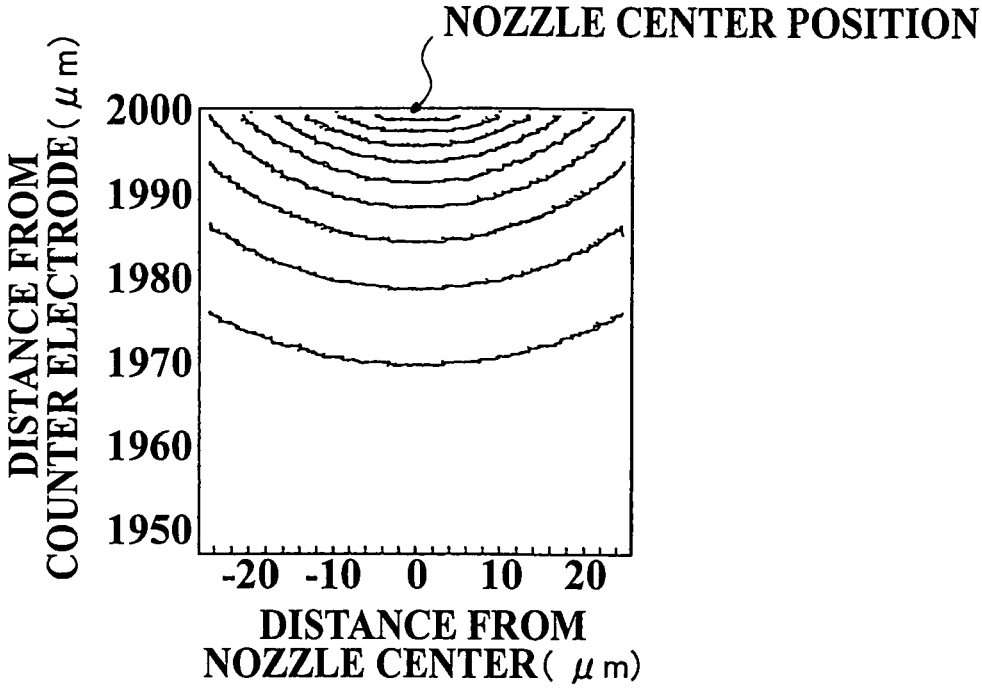
FIG. 6A is a view showing an electric field intensity distribution with the nozzle diameter as Φ50[μm] and with a distance from a nozzle to a counter electrode set to 2000[μm]
Figure 6B:
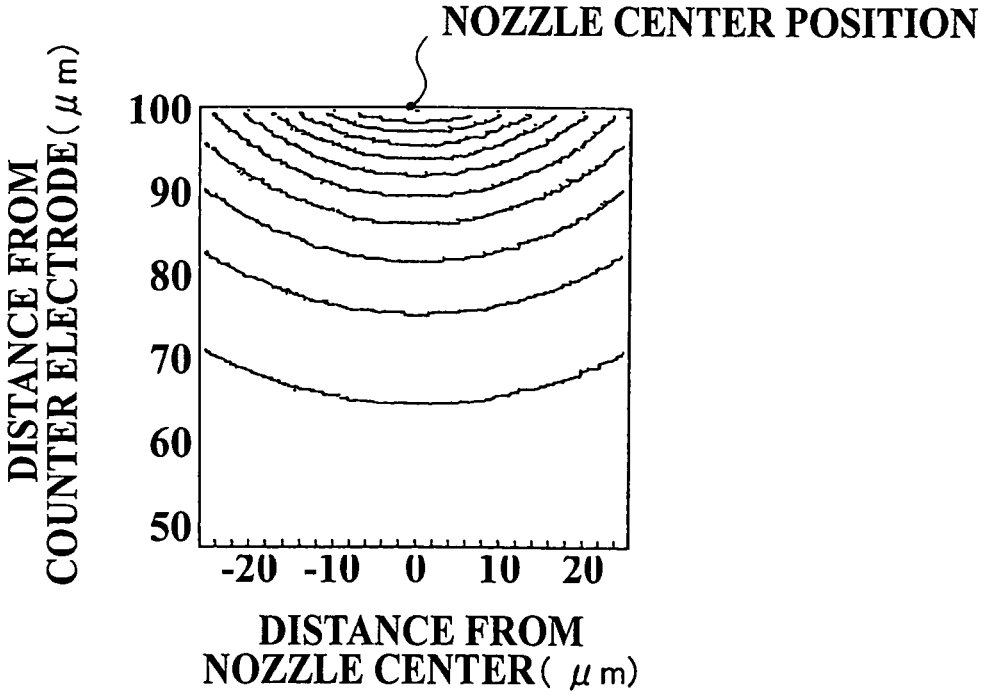
FIG. 6B is a view showing an electric field intensity distribution with the nozzle diameter as Φ50[μm] and with a distance from a nozzle to a counter electrode set to 100[μm]

Hereinafter, a best mode for implementing the present invention will be described by using drawings. However, in the following described embodiments, although various limitations that are technically suitable for implementing the present invention are provided, the limitations are not used for limiting a scope of the invention within the following embodiments and illustrated examples.

A nozzle diameter of each nozzle provided in an electrostatic sucking type liquid jetting apparatus and a liquid jetting apparatus described in the following embodiments is preferably not more than 30[μm], more preferably less than 20[μm], even more preferably not more than 10[μm], even more preferably not more than 8[μm], even more preferably not more than 4[μm]. Hereinafter, in regard to a relation between the nozzle diameter and an electric field intensity, descriptions will be hereafter made with reference to FIG. 1A to FIG. 6A and FIG. 1B to FIG. 6B. In correspondence with FIG. 1A to FIG. 6A, electric field intensity distributions in cases of nozzle diameters being Φ0.2, 0.4, 1, 8 and 20[μm], and a case of a conventionally-used nozzle diameter being Φ50[μm] as a reference are shown. In correspondence with FIG. 1B to FIG. 6B, electric field intensity distributions in cases of nozzle diameters being Φ0.2, 0.4, 1, 8 and 20[μm], and a case of a conventionally-used nozzle diameter being Φ50[μm] as a reference are shown.

Here, in each drawing, a nozzle center position indicates a center position of a liquid jetting surface of a liquid jetting hole at a nozzle edge. Further, FIG. 1A to FIG. 6A indicate electric field intensity distributions when a distance between a nozzle and a counter electrode is set to 2000[μm], and FIG. 1B to FIG. 6B indicate electric field intensity distributions when a distance between a nozzle and a counter electrode is set to 100[μm]. Here, an applying voltage is set constant to 200[V] in each condition. A distribution line in the drawings indicates a range of electric charge intensity from $1\times10^6$[V/m] to $1\times10^7$[V/m].

FIG. 7 shows a chart indicating a maximum electric field under each condition.

According to FIG. 1A to FIG. 6A and FIG. 1B to FIG. 6B, the fact that an electric field intensity distribution spreads to a large area if the nozzle diameter is not less than Φ20[μm] (see FIG. 5A and FIG. 5B), was comprehended. Further, according to the chart of FIG. 7, the fact that a distance between a nozzle and a counter electrode has an influence on an electric field intensity was comprehended.

From these things, when the nozzle diameter is not more than Φ8[μm] (see FIG. 4A and FIG. 4B), an electric field intensity is concentrated and change of a distance to the counter electrode scarcely has an influence on an electric field intensity distribution. Therefore, when the nozzle diameter is not more than Φ8[μm], it is possible to perform a stable jetting without suffering influence of position accuracy of the counter electrode, and unevenness of base member property and thickness.

Figure 8:
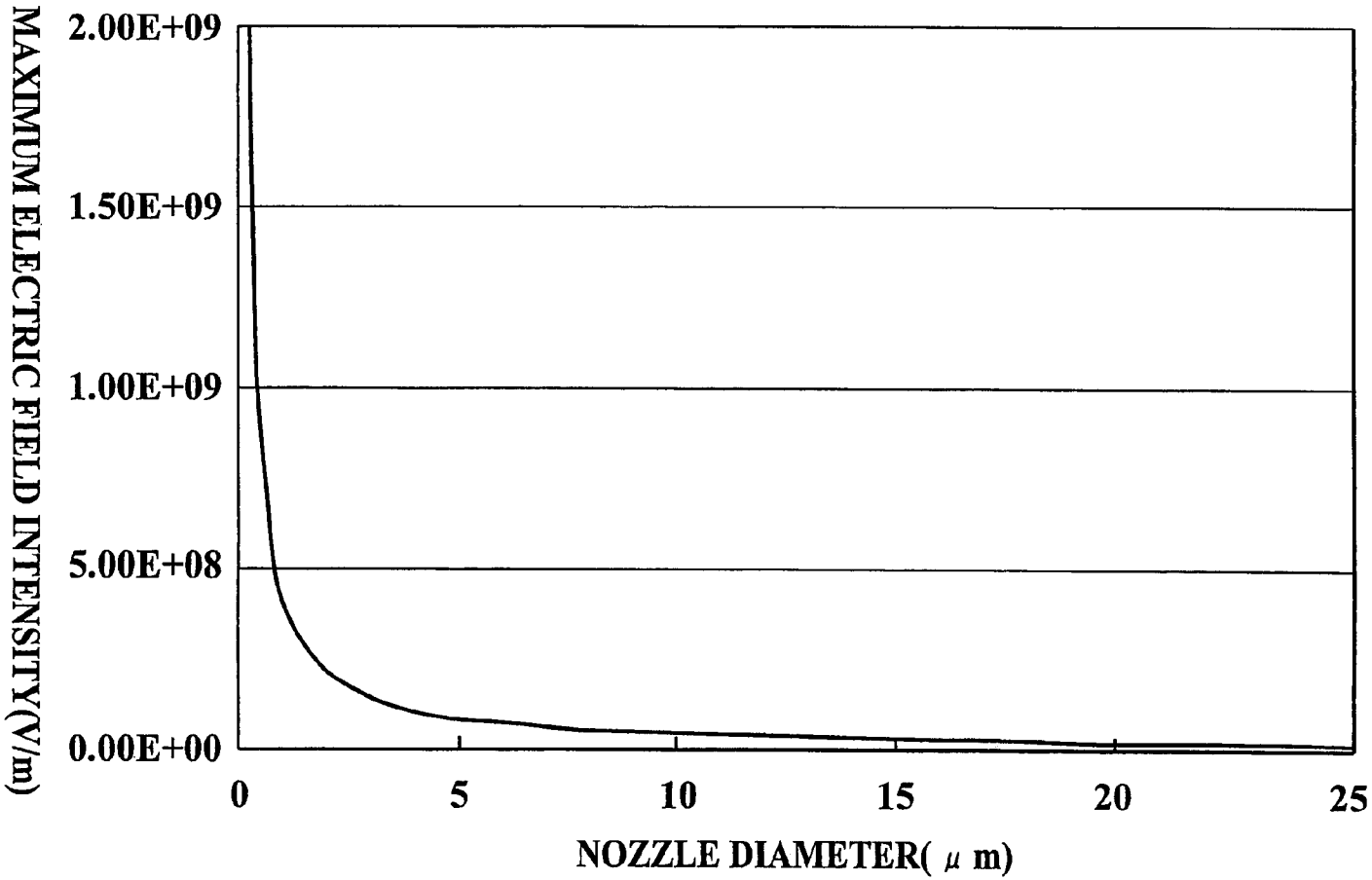
FIG. 8 is a diagram showing a relation between the nozzle diameter of a nozzle and a maximum electric field intensity at the time that there is a liquid level at an edge position of the nozzle.

Next, a relation between the nozzle diameter of a nozzle and a maximum electric field intensity when a liquid level is at an edge position of the nozzle is shown in FIG. 8.

According to a graph shown in FIG. 8, when the nozzle diameter is not more than Φ4[μm], the fact that electric field concentration grows extremely large and a maximum electric field intensity can be made high was comprehended. Thereby, since it is possible to make an initial jetting speed of the liquid solution large, flying stability of a droplet is increased and moving speed of electric charge at the nozzle edge portion is increased, whereby jetting responsiveness improves.

Continuously, in regard to maximum electric charge amount chargeable to a jetted droplet, descriptions will be made hereafter. Electric charge amount chargeable to a droplet is shown as the following equation (3), in consideration of Rayleigh fission (Rayleigh limit) of a droplet.

$$q = 8\times\pi\times\sqrt{\varepsilon_0\times\gamma\times\frac{d_0^3}{8}} \tag{3}$$

where q: electric charge amount [C] giving Rayleigh limit, $\epsilon_0$: electric constant [F/m], γ: surface tension of the liquid solution [N/m], and $d_0$: diameter [m] of the droplet.

The closer to a Rayleigh limit value the electric charge amount q calculated by the above-mentioned equation (3) is, an electrostatic force becomes stronger and jetting stability improves. However, when it is too close to the Rayleigh limit value, conversely a dispersion of the liquid solution occurs at a liquid jet opening of the nozzle, and there is lack of jetting stability.

Figure 9:
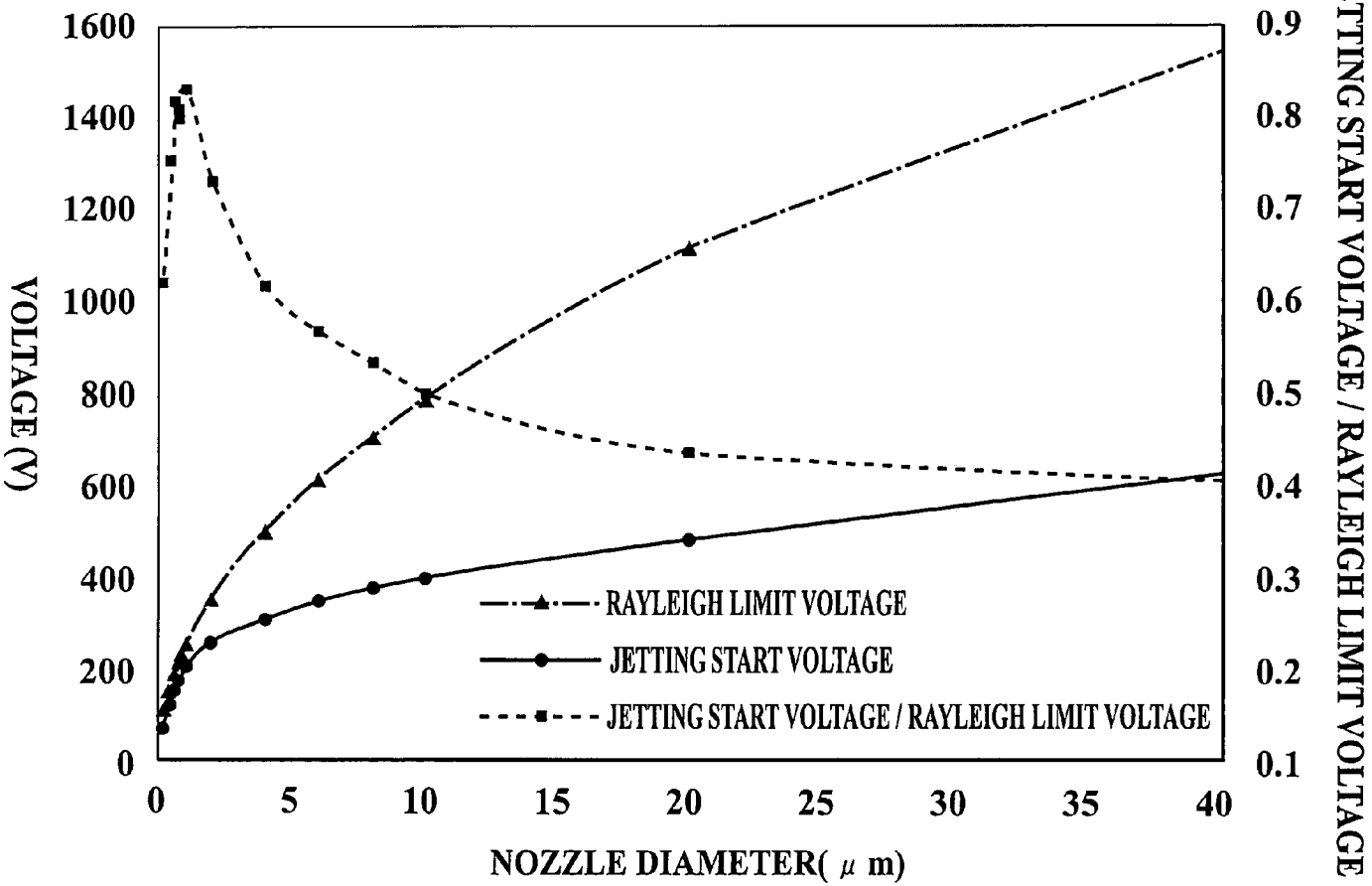
FIG. 9 is a diagram showing a relation among the nozzle diameter of the nozzle, a jetting start voltage at which a droplet jetted at a nozzle edge portion starts flying, a voltage value at Rayleigh limit of the initial jetted droplet, and a ratio of the jetting start voltage to the Rayleigh limit voltage.
Figure 10:
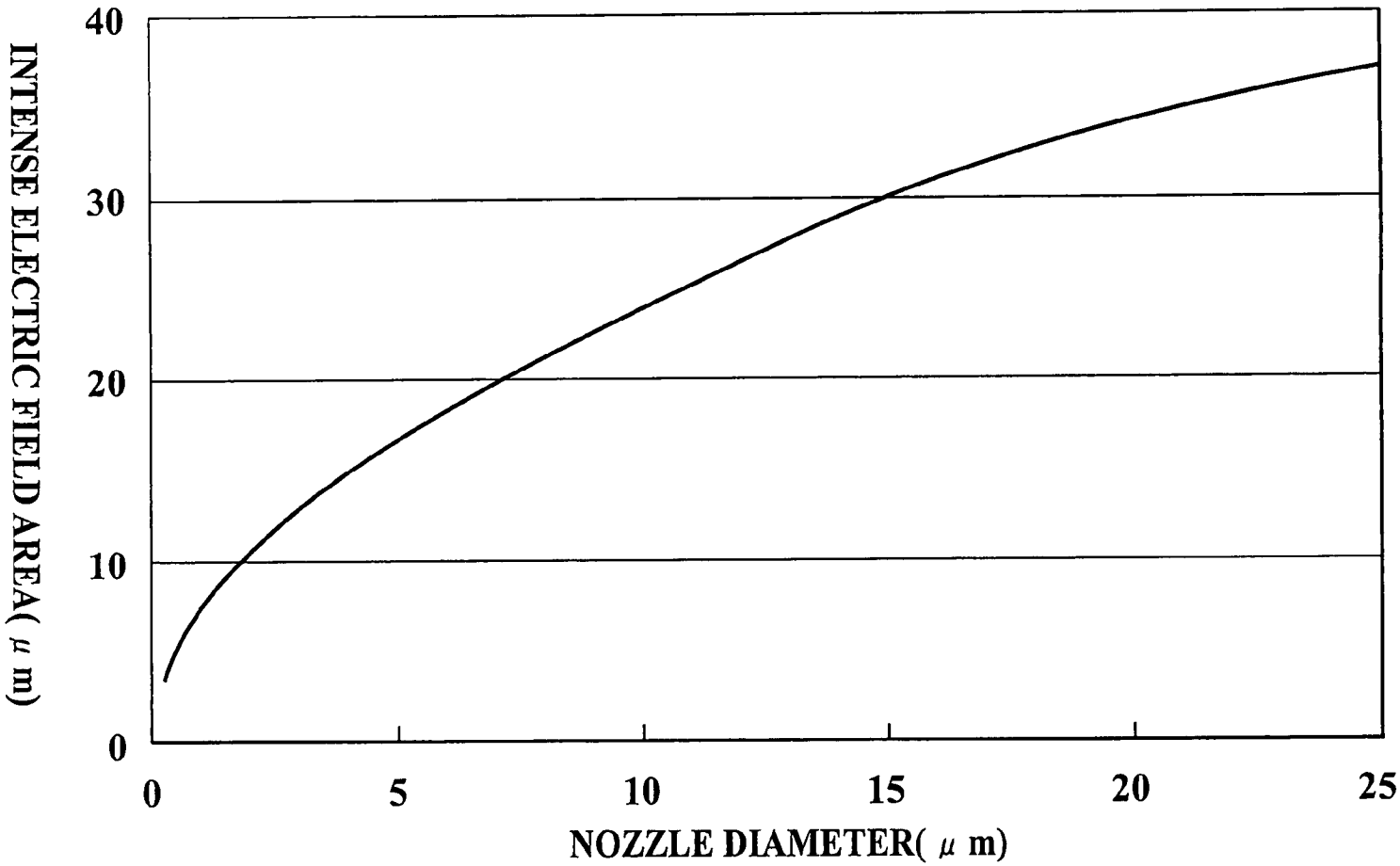
FIG. 10 is a graph described by a relation between the nozzle diameter and an area of an intense electric field.

Here, FIG. 9 is a graph showing a relation among the nozzle diameter of the nozzle, a jetting start voltage at which a droplet jetted at a nozzle edge portion starts flying, a voltage value at Rayleigh limit of the initial jetted droplet, and a ratio of the jetting start voltage to the Rayleigh limit voltage.

From the graph shown in FIG. 9, within the range of the nozzle diameter from Φ0.2[μm] to Φ4[μm], the ratio of the jetting start voltage and the Rayleigh voltage value exceeds 0.6, and a favorable result of electric charge efficiency of a droplet is obtained. Thereby it is comprehended that it is possible to perform a stable jetting within the range.

For example, in a graph represented by a relation between the nozzle diameter and an intense electric field (not less than $1\times10^6$[V/m]) area, the fact that an area of electric field concentration becomes extremely narrow when the nozzle diameter is not more than Φ0.2[μm] is indicated. Thereby, the fact that a jetted droplet is not able to sufficiently receive energy for acceleration and flying stability is reduced is indicated. Therefore, preferably the nozzle diameter is set to more than Φ0.2[μm].

Hereinafter, six embodiments to which the present invention is applied will be described.

FIRST EMBODIMENT

A first embodiment will be described with reference to FIG. 11 to FIG. 21.

Figure 11:
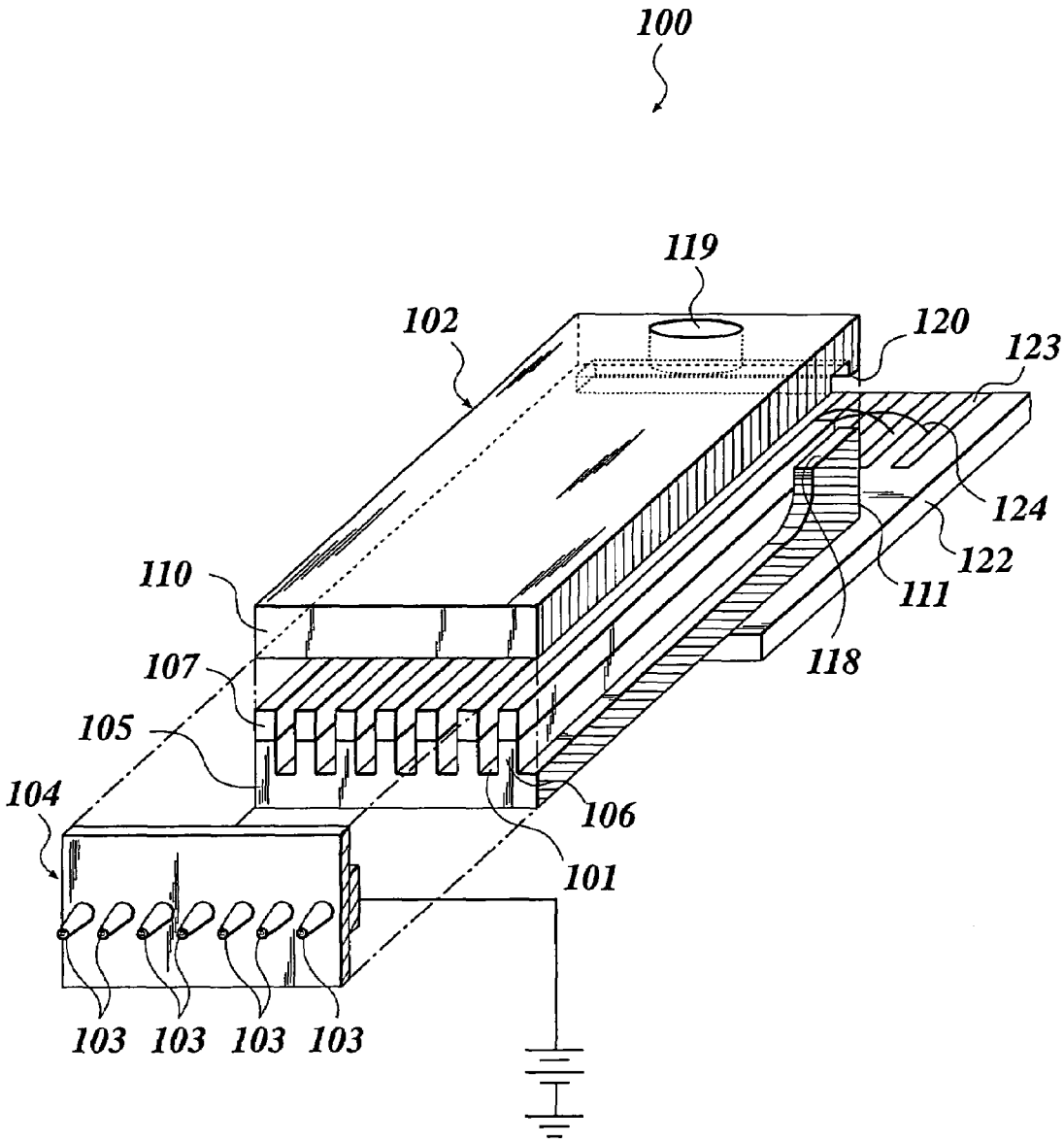
FIG. 11 is a perspective view showing an electrostatic sucking type liquid jetting head 100 in a first embodiment with a part thereof cut out.
Figure 13:
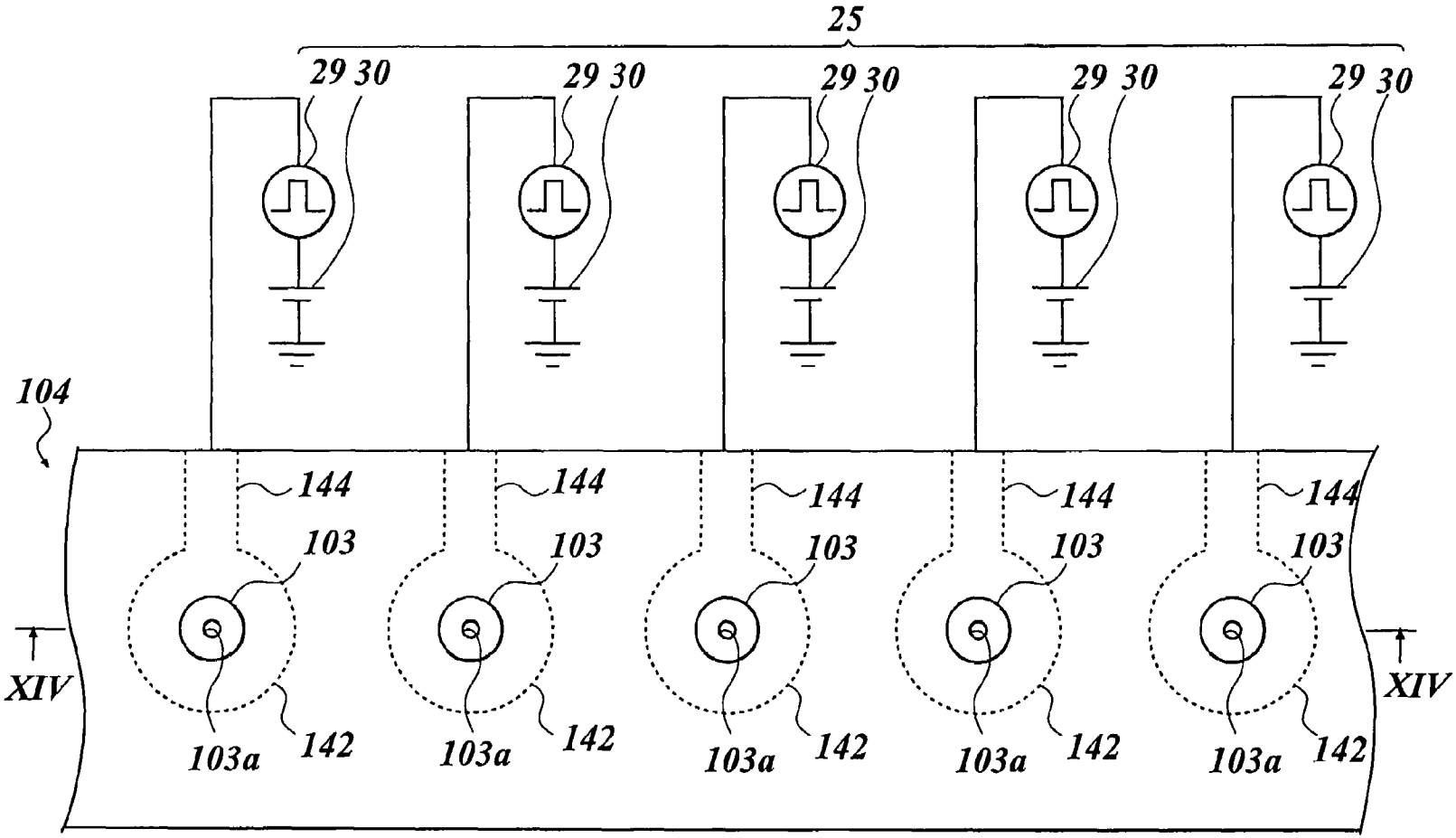
FIG. 13 is a view showing a nozzle plate 104 provided in the liquid jetting head 100.
Figure 14:
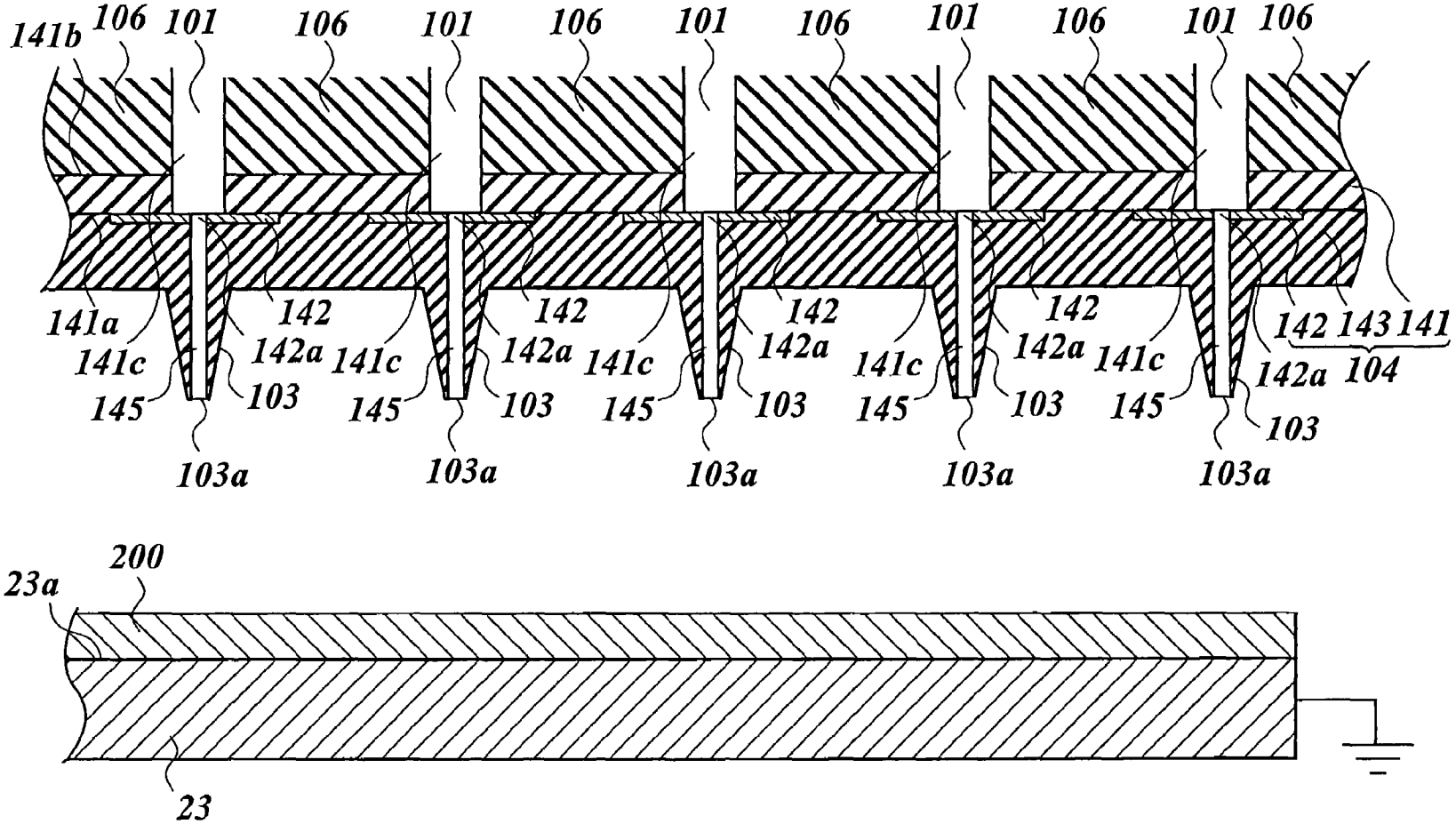
FIG. 14 is a cross-sectional view taken along a cutting line XIV-XVI shown in FIG. 13.

An electrostatic sucking type droplet jetting apparatus as an embodiment to which the present invention is applied, as shown in FIG. 11, comprises an electrostatic sucking type liquid jetting head 100 having first liquid room barriers 106, 106, . . . and second liquid room barriers 107, 107, . . . , as a convex meniscus forming section; a supplying pump for giving a supplying pressure of the liquid solution to each liquid solution supplying channel 101 of the liquid jetting head 100; and a circuit (jetting voltage applying section 25 and counter electrode 23 shown in FIG. 13 and FIG. 14) for driving the liquid jetting head 100.

The liquid jetting head 100 will be described by using FIG. 11. Here, FIG. 11 is a perspective view showing a bottom surface of the liquid jetting head 100 as the embodiment to which the present invention is applied, with the bottom surface located at the front side of the paper and with a part thereof cut out. As shown in FIG. 11, the liquid jetting head 100 comprises a liquid room structure 102 in which a plurality of liquid solution supplying channels are formed as liquid rooms, and a nozzle plate 104 having nozzles 103 being attached to a bottom portion of the liquid room structure 102, jetting chargeable liquid solution as a droplet from an edge portion thereof, having a super minute diameter and corresponding to the respective liquid solution supplying channels 101.

Figure 12:
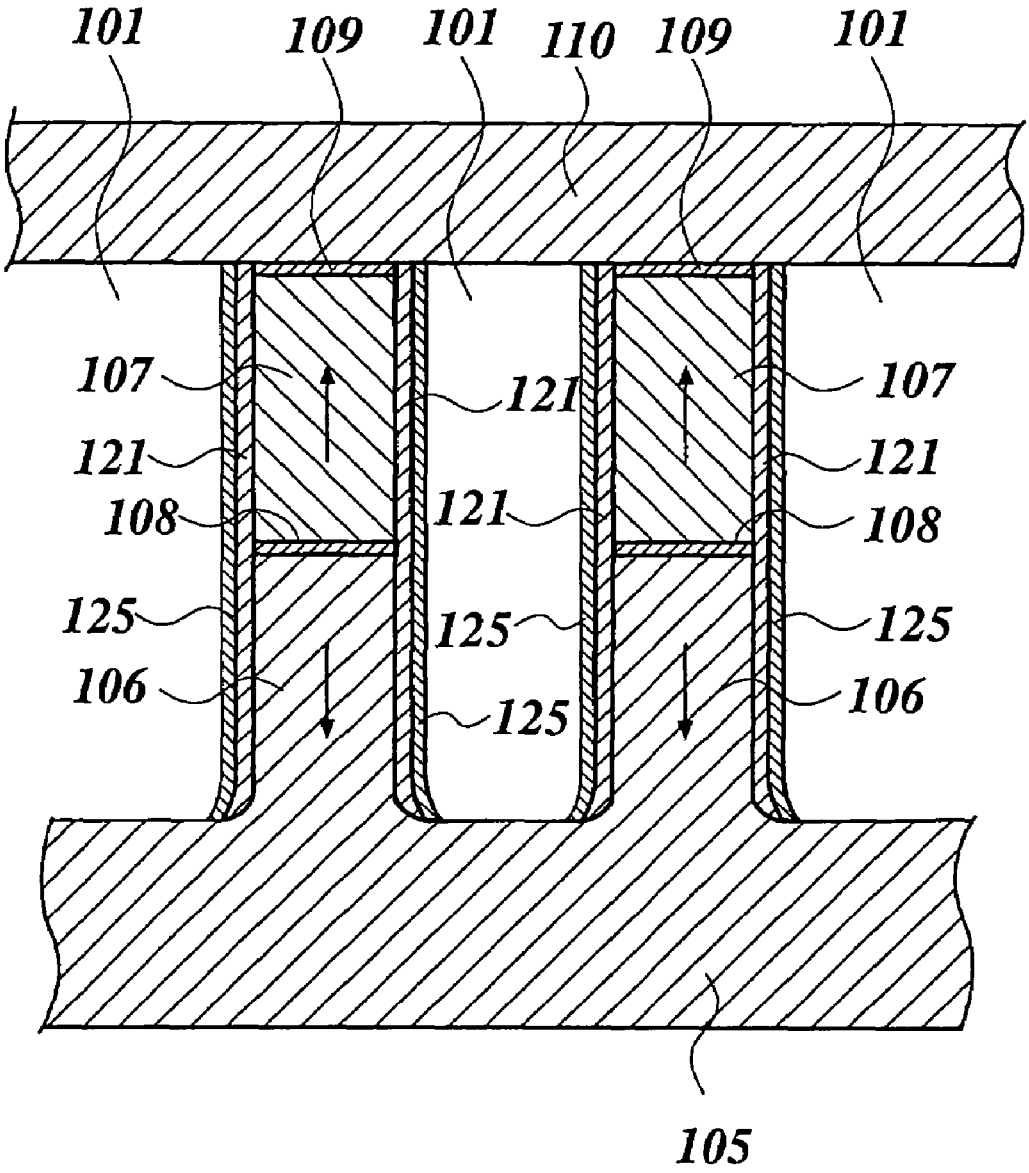
FIG. 12 is a cross-sectional view showing a liquid room structure provided in the liquid jetting head 100 seen from a bottom surface.

The liquid room structure 102 will be described. FIG. 12 is a cross-sectional view mainly showing one liquid solution supplying channel 101 by seeing the liquid room structure 102 from its bottom surface direction. As shown in FIG. 11 and FIG. 12, the liquid room structure 102 comprises a liquid room side wall 105, wherein a plurality of first liquid room barriers 106, 106, . . . formed convexly with respect to the liquid room side wall 105 are placed in parallel with each other to the liquid room side wall 105. Second liquid room barriers 107 are respectively piled up on the first liquid room barriers 106, and the second liquid room barriers 107 adhere to and are fixed to the first liquid room barriers 106 via an adhesive layer 108. Thereby, on the liquid room side wall 105, a plurality of grooves are formed by arranging a plurality of pairs of protrusions each of which comprises the first liquid room barrier 106 and the second liquid room barrier 107 in parallel with each other. Then, a cover plate 110 so adheres to and is fixed to the second liquid side walls 107, 107, . . . via an adhesive layer 109 as to face the liquid room side wall 105 and to cover the plurality of grooves. Thereby, a plurality of sectioned liquid solution supplying channels 101 are formed by a pair of 106 liquid room barrier 106, a pair of 107 liquid room barrier 107, the liquid room side wall 105 and the cover plate 110. A bottom of each liquid solution supplying channel 101 is opened at a bottom surface of this liquid room structure 102, and each liquid solution supplying channel 101 is blocked by having a nozzle plate 104, which will be described later, adhere to and fixed to the bottom surface of the liquid room structure 102. A nozzle 103 is formed at the nozzle plate 104 in correspondence with each liquid solution supplying channel 101.

Each liquid solution supplying channel 101 becomes shallow when being close to an upper edge surface 111 of the liquid room side wall 105, and a shallow groove 118 is formed in the vicinity of the upper edge surface 111. At an upper portion of the cover plate 110, a liquid entrance opening 119 and a manifold 120 connected thereto are formed. Then, with each liquid solution supplying channel 101 covered with the cover plate 110, the upper edge portion of each liquid solution supplying channel 101 is connected to a liquid supplying source in which the liquid solution is stored, via the manifold 120 and the liquid entrance opening 119. This liquid jetting head 100 comprises a supplying pump (liquid solution supplying section) for giving a supplying pressure of the liquid solution to each liquid solution supplying channel 101, and the liquid supplying source supplies the liquid solution to each liquid solution supplying channel 101 by the pressure given by this supplying pump. This supplying pump supplies the liquid solution by maintaining a supplying pressure in a range within which the liquid solution does not spill out from an edge portion of the nozzle 103, which will be described later.

A control electrode 121 is provided with the side walls of the liquid room barriers 106 and 107, and an insulating layer 125 is provided on the control electrode 121. Covering the control electrode 121 with the insulating layer 125 to make an internal wall of the liquid solution supplying channel 101 insulating prevents stroke from being generated through the liquid solution existing between a jetting electrode of the nozzle plate 104, which will be described later, and the control electrode 121. In regard to material and thickness of the insulating layer 125, it is necessary to determine them in consideration of conductivity of the liquid solution and an applying voltage. As the insulating layer 125, one formed from parylene resin according to an evaporation method, and one formed from $S_iO_2$, $S_{i3}N_4$ according to a CVD method are suitable.

At a driving base plate 122 attached to a surface being opposite to a surface of the liquid room side wall 105 at which the first liquid barriers 106 are provided, a conduction pattern 123 corresponding to each liquid solution supplying channel 101 is formed, and the conduction pattern 123 and the control electrode 121 are connected by a conductor wire 124 according to a wire bonding method.

The liquid room barriers 106 and 107 are piezoelectric ceramic plates, formed from piezoelectric ceramic material of lead zirconate titanates (PZT) having ferroelectricity, and dielectrically polarized in a laminating direction and in a direction opposing to each other. The liquid room barriers 106 and 107 change shapes by applying a voltage to the control electrode 121, and pressure is given to the liquid solution in the liquid solution supplying channel 101. However, with the pressure of the droplet barriers 106 and 107 by itself, a droplet is not jetted from the edge portion of the nozzle 103, which will be described later, and nothing but convex meniscus protruding to outside from the edge portion of the nozzle 103 is formed. In other words, these liquid room barriers 106, 106, . . . and the liquid room barriers 107, 107, . . . structure a convex meniscus forming section for forming a state where the liquid solution of each in-nozzle passage 145 rises in a convex form.

Next, the nozzle plate 104 will be described. FIG. 13 is a view showing a bottom surface of the nozzle plate 104, and FIG. 14 is a cross-sectional view taken along a cutting line XIV-XVI shown in FIG. 13. The nozzle plate 104 comprises a base plate 141 as a base being electrically insulating; a plurality of jetting electrodes 142, 142, . . . formed on a surface 141*a* of the base plate 141; and a nozzle layer 143 laminated over the whole surface 141*a* of the base plate 141 via the plurality of jetting electrodes 142, 142, . . . .

A back surface 141*b* of the base plate 141 is fixed to the bottom surface of the above-mentioned liquid room structure 102 by adhesive or the like. Further, a plurality of through holes 141*c*, 141*c*, . . . are formed at the base plate 141, and these through holes 141*c*, 141*c*, . . . are so arranged as to correspond to the liquid solution supplying channels 101 respectively, to be communicated to the respective liquid solution supplying channels 101. In other words, the through holes 141*c* structure a lower portion of the liquid solution supplying channels 101.

The jetting electrodes 142, 142, . . . are so formed as to correspond to respective through holes 141*c*. Each jetting electrode 142 is formed on the surface 141*a* of the base plate so as to block the corresponding through hole 141*c*, and each jetting electrode 142 overlaps with the corresponding through hole 141*c* when being seen from the bottom surface. In other words, each jetting electrode 142 faces the corresponding liquid solution supplying channel 101, and structures the bottom surface of the corresponding liquid solution supplying channel 101. At the jetting electrode 142, a through hole 142*a* is formed at the overlapping portion, and this through hole 142*a* is communicated to the corresponding liquid solution supplying channel 101. Further, an integrally-formed wiring 144 is connected to each jetting electrode 142, and each wiring 144 is connected to a bias power source 30, which will be described later. Although, in the drawing, when seen from the bottom surface, the jetting electrodes 142 have a ring shape and the wirings 144 have a rectangular shape, the present invention is not limited to such shapes.

A plurality of nozzles 103, 103, . . . are integrally formed at the nozzle layer 143, and the plurality of nozzle 103, 103, . . . are arranged in line. Each nozzle 103 is so formed as to stand (be suspended) perpendicularly with respect to the base plate 141. These nozzles 103, 103, . . . are so arranged as to correspond to the liquid solution supplying channels 101 respectively, and each nozzle 103 overlaps with the corresponding through hole 141*c* when being seen from the bottom surface. An in-nozzle passage 145 penetrating from its edge portion along its center line is formed at each nozzle, and a jet opening 103*a* being an end of the in-nozzle passage 145 is formed at the edge portion of each nozzle 103. The in-nozzle passage 145 is communicated to the corresponding liquid solution supplying channel 101 through the through hole 142*a* of the jetting electrode 142, and the jetting electrode 142 faces the in-nozzle passage 145. The liquid solution supplied to each liquid solution supplying channel 101 is also supplied to the through hole 141*c* and in the in-nozzle passage 145, and is directly contacted to the jetting electrode 142 in each liquid solution supplying channel 101 and the in-nozzle passage 145. Here, in the drawing, the plurality of nozzles 103, 103, . . . are arranged in line. However, they may be arranged in two lines, or arranged in a matrix form.

The nozzle layer 143 including these nozzles 103, 103, . . . has electrical insulation properties, and an inside surface of the in-nozzle passage 145 also has electrical insulation properties. Further, the nozzle layer 143 including these nozzles 103, 103, . . . may have water repellent properties (for example, the nozzle layer 143 is formed by resin having fluorine), or a water repellent layer having water repellent properties may be formed on a surface layer of the nozzles 103, 103, . . . (for example, a metal layer is formed on the surface layer of the nozzles 103, 103, . . . , and further on the metal layer, a water repellent layer by eutectoid plating between the metal and water repellent resin is formed). Here, the water repellent properties are properties to repel the liquid solution jetted by the nozzle 103. Further, by selecting a water repellent processing method corresponding to liquid solution, it is possible to control water repellent properties of the nozzle layer 143. As the water repellent processing method, a method of electrodepositing cationic or anionic resin including fluorine, of coating or sintering fluorinated high polymer, silicon resins and polymethylsiloxane, an eutectoid plating method of fluorinated high polymer, an amorphous alloy film evaporating method, and a method of making a layer such as organic silicon compound, fluorinated silicon-containing compound or the like adhere, centering on dimethylpolysiloxane system formed by plasma-polymerizing hexamethyldisiloxane as monomer according to plasma CVD method are applicable.

Further detailed description will be made regarding the respective nozzles 103. At the nozzle 103, an opening diameter at its edge portion and the in-nozzle passage 22 are constant, and as mentioned, these are formed as a super minute diameter. A shape of the nozzle 103 is formed so that a diameter thereof is narrowed toward the edge portion, and is formed as a conic trapezoid shape being boundlessly close to a conic shape. As one concrete example of a dimension of each part, preferably an inside diameter of the in-nozzle passage 145 (that is, a diameter of the jet opening 103*a*) is not more than 30[μm], further less than 20[μm], further not more than 10[μm], further not more than 8[μm] and further not more than 4[μm], and an inside diameter of the in-nozzle passage 145 is set to 1[μm] in the present embodiment. Then, an external diameter of the edge portion of the nozzle 103 is set to 2[μm], a diameter of a root of the nozzle 103 is set to 5[μm], and a height of the nozzle 103 is set to 100[μm].

Here, each dimension of the nozzle 103 is not limited to the above-mentioned one example. In particular, the nozzle inside diameter is in the range for realizing a jetting voltage being less than 1000[V], the jetting voltage enabling droplet jetting by an effect of electric field concentration, which will be described later, for example, the nozzle diameter is not more than 70[μm], more preferably, the diameter is not more than 20[μm] and a diameter by which it is possible to realize the formation of a through hole for passing the liquid solution according to a current nozzle formation technology is set to its lower limit value. Further, although preferably shapes of these nozzles 103, 103, . . . are equal to each other, different shapes are allowable.

Figure 15A:
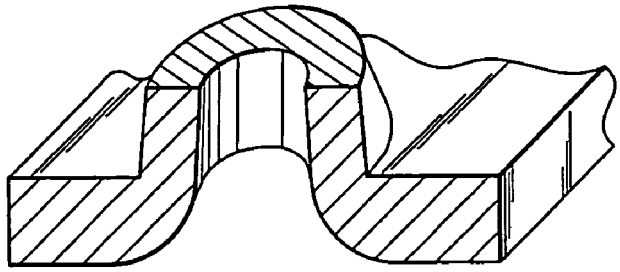
FIG. 15A is a perspective view showing a shape of an in-nozzle passage in an example of providing roundness at a liquid solution room side, with a part thereof cut out.
Figure 15B:
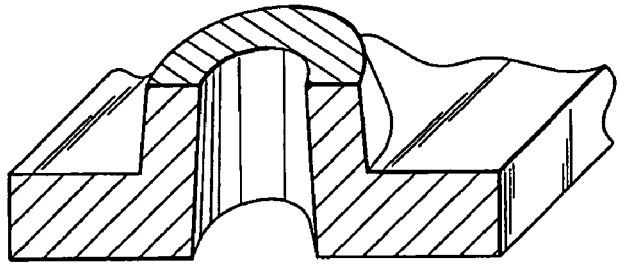
FIG. 15B is a perspective view showing a shape of the in-nozzle passage in an example of having a passage inside surface as a tapered circumferential surface, with a part thereof cut out.
Figure 15C:
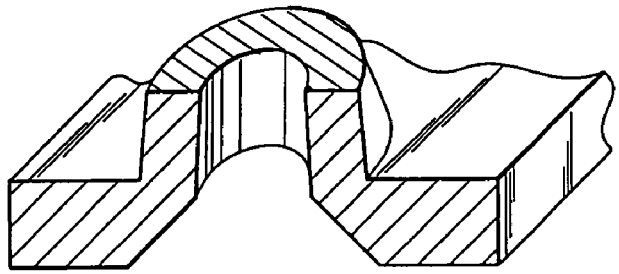
FIG. 15C is a perspective view showing a shape of the in-nozzle passage in an example of combining a tapered circumferential surface and a linear passage with a part thereof cut out.

Here, a shape of the in-nozzle passage 145 may not be formed linearly with the inside diameter constant as shown in FIG. 14. For example, as shown in FIG. 15A, it may be so formed as to give roundness to a cross-section shape at the edge portion of the liquid solution supplying channel 101 side of the in-nozzle passage 145. Further, as shown in FIG. 15B, an inside diameter at the edge portion of the liquid solution supplying channel 101 side of the in-nozzle passage 145 may be made larger than an inside diameter of the edge portion of the jetting side, and an inside surface of the in-nozzle passage 145 may be formed in a tapered circumferential surface shape. Further, as shown in FIG. 15C, only the edge portion of the later-described liquid solution supplying channel 101 side of the in-nozzle passage 145 may be formed in a tapered circumferential surface shape and the jetting edge portion side with respect to the tapered circumferential surface may be formed linearly with the inside diameter constant.

Next, a circuit structure for driving this liquid jetting head 100 will be described. This circuit for driving the liquid jetting head 100, comprises a jetting voltage applying section 25 (shown in FIG. 13) for applying a jetting voltage to each of the above-mentioned jetting electrodes 142, 142, . . . ; a facing surface 23*a* facing the above-mentioned nozzles 103, 103; . . . and a counter electrode 23 (shown in FIG. 14) for supporting a base member 200 receiving a droplet at the facing surface 23*a*.

The jetting voltage applying section 25 comprises a bias power source 30 for applying a bias voltage being direct current to the jetting electrode 142; and a jetting power source 29 for applying a pulse voltage to be superimposed to the bias voltage to have an electric potential necessary for jetting, to the jetting electrode 142, so as to correspond to each jetting electrode 142. The bias power source 30 and the jetting power source 29 may be in common for all of the jetting electrodes 142, 142, . . . , and in this case, the jetting power source 29 applies the pulse voltage to these jetting electrodes 142, 142, . . . , respectively.

In regard to a bias voltage by the bias power source 30, by applying a voltage always within a range within which jetting of the liquid solution is not performed, width of a voltage applied at the time of jetting is preliminarily reduced, and thereby responsiveness at the time of jetting is improved.

The jetting power source 29 superimposes a pulse voltage on a bias voltage only when the jetting of the liquid solution is performed and applies it to the jetting electrodes 142, 142, . . . respectively. A value of the pulse voltage is set so that the superimposed voltage V at this time satisfies a condition of the following equation.

$$h\sqrt{\frac{\gamma\pi}{\varepsilon_0 d}} > V > \sqrt{\frac{\gamma k d}{2\varepsilon_0}} \tag{1}$$

However, γ: surface tension of the liquid solution [N/m], $\epsilon_0$: electric constant [F/m], d: nozzle diameter [m], h: distance between nozzle and base member [m] and k: constant of proportionality dependent on nozzle shape (1.5<k<8.5).

With one example cited, the bias voltage is applied at DC 300[V], and the pulse voltage is applied at 100[V]. Therefore, the superimposed voltage at jetting will be 400[V].

The counter electrode 23 comprises a facing surface 23*a* being perpendicular to the nozzles 103, 103, . . . , and supports the base member 200 along the facing surface 23*a*. A distance from an edge portion of the nozzles 103, 103, . . . to the facing surface 23*a* of the counter electrode 23 is, set to 100[μm] as one example.

Further, since this counter electrode 23 is grounded, the counter electrode 23 always maintains a ground potential. Therefore, at the time of applying the pulse voltage, a jetted droplet is induced to the counter electrode 23 side by an electrostatic force according to an electric field generated between an edge portion of each nozzle 103 and the facing surface 23*a*.

Here, since the liquid jetting head 100 jets a droplet by enhancing electric field intensity according to electric field concentration at edge portions of the respective nozzles 103, 103, . . . by miniaturization of the nozzles 103, 103, . . . , it is possible to jet a droplet without the induction by the counter electrode 23. However, the induction by an electrostatic force is preferably performed between the nozzles 103, 103, . . . and the counter electrode 23. Further, it is possible to let out the electric charge of a charged droplet by grounding the counter electrode 23.

The liquid solution supplied to this liquid jetting head 100 and jetted from the liquid jetting head 100 will be described.

As examples of the liquid solution, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbitol, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large amount of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)

$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate-methacrylic acid copolymer, lauryl methacrylate.2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile. styrene copolymer, styrene.maleate copolymer, styrene. isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene. polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene.vinyl acetate copolymer, ethylene.ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semisynthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

When the liquid jetting apparatus in the present embodiment is used as a patterning method, as a representative example, it is possible to use it for display use. Concretely, it is possible to cite formation of fluorescent material of plasma display, formation of rib of plasma display, formation of electrode of plasma display, formation of fluorescent material of CRT, formation of fluorescent material of FED (Field Emission type Display), formation of rib of FED, color filter for liquid crystal display (RGB coloring layer, black matrix layer), spacer for liquid crystal display (pattern corresponding to black matrix, dot pattern and the like). The rib mentioned here means a barrier in general, and with plasma display taken as an example, it is used for separating plasma areas of each color. For other uses, it is possible to apply it to microlens, patterning coating of magnetic material, ferrodielectric substance, conductive paste (wire, antenna) and the like for semiconductor use, as graphic use, normal printing, printing to special medium (film, fabric, steel plate), curved surface printing, lithographic plate of various printing plates, for processing use, coating of adhesive, sealer and the like using the present embodiment, for biotechnological, medical use, pharmaceuticals (such as one mixing a plurality of small amount of components), coating of sample for gene diagnosis or the like.

Next, a producing method of the liquid jetting head 100 will be described.

For producing the liquid jetting head 100, after the liquid room structure 102 and the nozzle plate 104 are produced separately, the nozzle plate 104 is glued and fixed to the bottom surface of the liquid room structure 102.

For producing the liquid room structure 102, first, piezoelectric material made of titanate zirconate salts (PZT) which is to structure a liquid room side wall 105, a first liquid room barrier 106 and a second liquid room barrier 107 is prepared, and by using a doctor blade method, a screen printing method or the like, it is formed in a sheet-like shape having predetermined thickness.

Then, a piezoelectric laminating member is formed by laminating a pair of sheets with the use of adhesive which is to be an adhesive layer 108, and thereafter, a polarization processing is performed according to a known method, and thereby an upper-side sheet and a lower-side sheet are polarized in a direction of its thickness and in a direction in which they are opposed to each other.

Then, the above-mentioned piezoelectric laminating member structured by laminating the pair of sheets with a tool (for example, a diamond plate) is ground, and thereby a plurality of groove portions that will structure the liquid solution supplying channel 101 are formed in parallel on the above-mentioned piezoelectric laminating member.

Thereafter, an electrode is formed to the liquid room barriers 106 and 107 structuring the groove portions according to a known method such as plating or the like. Here, at bottom surfaces of the groove portions, an electrode is not formed. Then, when adhesive which is to be the adhesive layer 109 is coated on an upper portion of the liquid room barrier 107 and the cover plate 110 is applied, the liquid room structure 102 structured with the plurality of liquid solution channels 101 formed in parallel with each other is produced. Then, a driving base member 122 is attached to the liquid room side wall 105, and one end portion of the conductor wire 124 is connected to each electrode 11 and another end portion of the conductor wire 124 is connected to the conduction pattern 123.

Figure 16:
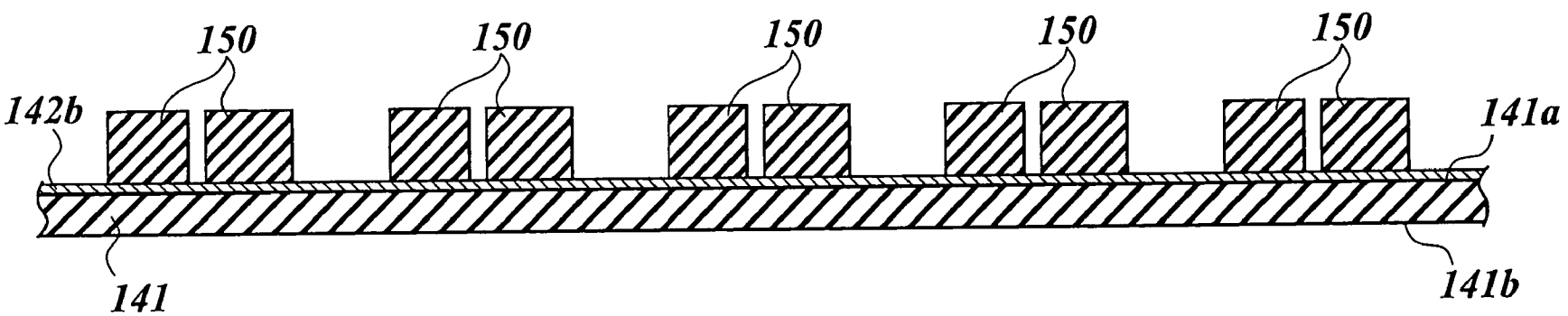
FIG. 16 is a drawing showing a step of a method for producing the above-mentioned liquid jetting head 100.

On the other hand, for producing the nozzle plate 104, as shown in FIG. 16, first, a base plate 141 having a flat plate shape is prepared (at this point, the plurality of through holes 141*c* have not been formed at the base plate 141.), a conductive coat 142*b* is formed over the whole surface of the surface 141*a* of the base plate 141 according to a coat-forming method such as a PVD method, a CVD method, a plating method or the like, and resists 150, 150, . . . are formed on this conductive coat 142*b* according to a photolithography method. Here, a shape of the resist 150 seen in a plane view is a shape combining the jetting electrode 142 and the wiring 144 seen in a bottom view. In addition, the base plate 141 may be a glass base plate, silicon wafer or a resin base plate, but has electrical isolation.

Figure 17A:
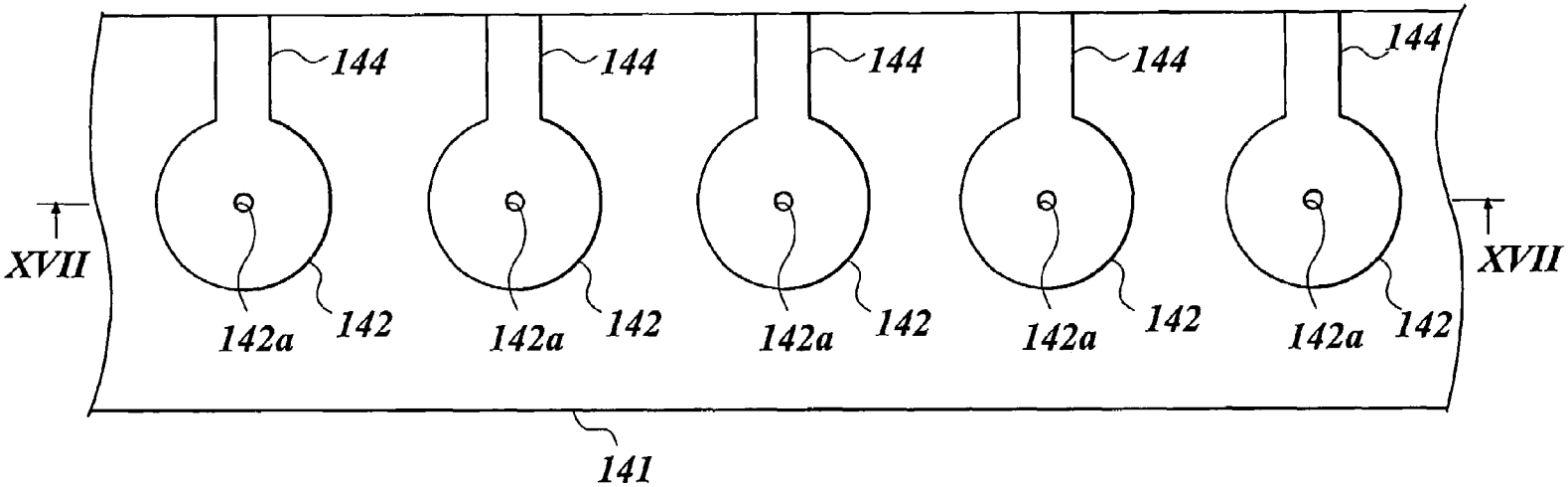
FIG. 17A is a plan view showing a step of the producing method of the above-mentioned liquid jetting head 100.
Figure 17B:
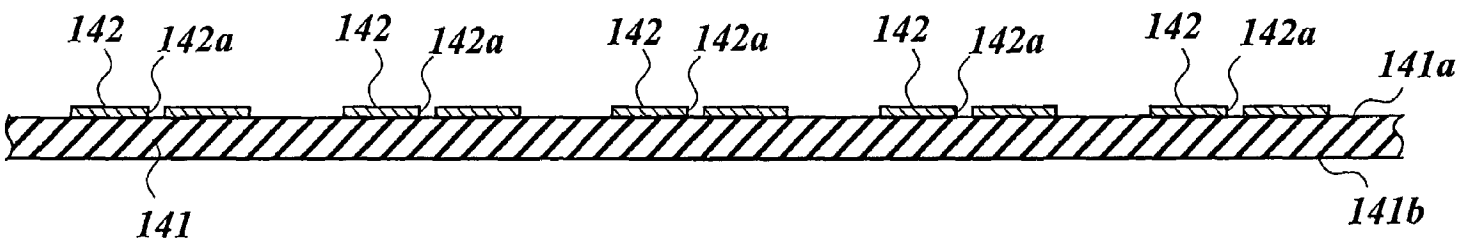
FIG. 17B is a cross-sectional view along a section line XVII-XVII.
Figure 18:
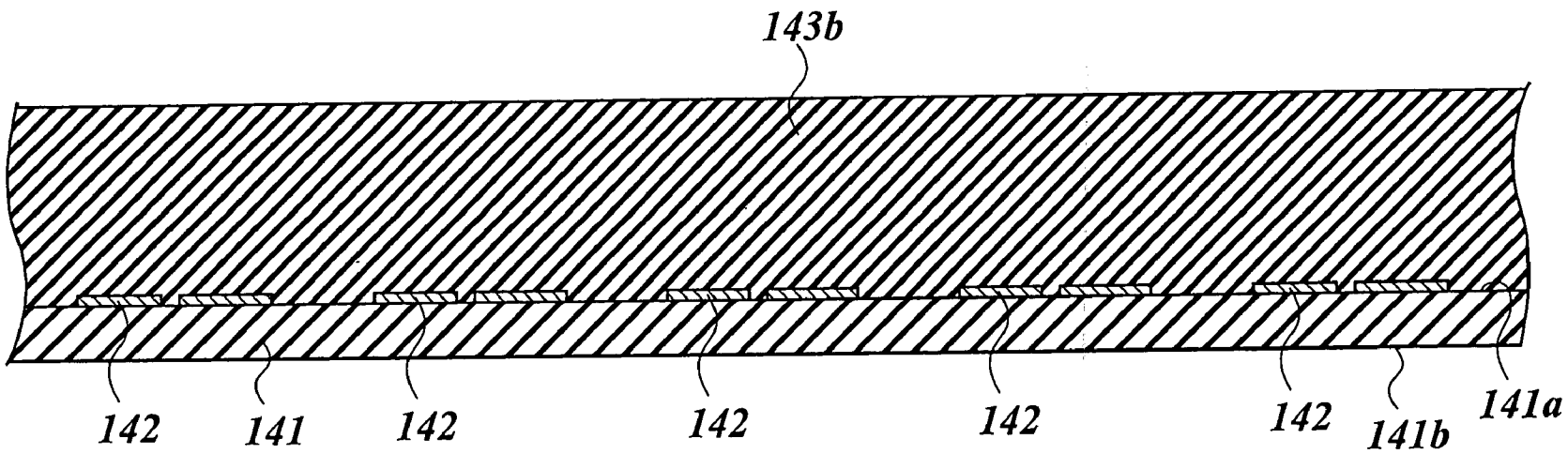
FIG. 18 is a drawing showing a step of the producing method of the above-mentioned liquid jetting head 100.

Next, when etching is applied on the conductive coat 142*b* with the use of the resists 150, 150, . . . as a mask, the conductive coat 142*b* has its shape processed, and thereafter the resists 150, 150, . . . are eliminated (refer to FIG. 17A and FIG. 17B). Since the plurality of jetting electrodes 142, 142, . . . are at once formed through the coating step, the mask step and the shape processing step in this way, productivity of the nozzle plate 104 is good.

Next, a resist layer (photosensitive resin layer) 143B is formed over the whole surface 141*a* of the base plate 141 so as to cover all of these jetting electrodes 142, 142, . . . and these wirings 144, 144, . . . (see FIG. 18). This resist layer 143*b* may be a positive type or a negative type. The resist layer 143*b* is of photosensitive resin, and as its composition, PMMA, SU8 or the like is preferable.

Next, the resist layer 143 gets exposed by electron beam, femtosecond laser or the like according to the shape of the plurality of nozzles 103, 103, . . . to be formed. In other words, when the resist layer 143*b* is a positive type, a part at the resist layer with which the through holes 142*a* of the jetting electrodes 142, 142, overlap is exposed down to a deep layer, and a part between the plurality of nozzles 103, 103, . . . is exposed down to a middle layer. On the other hand, when the resist layer 143*b* is a negative type, a part at the resist layer 143 which is to become the plurality of nozzles 103, 103, . . . is exposed. Here, the resist layer 143*b* may not be exposed by electron beam or femtosecond laser, but be exposed by visible light, ultraviolet light, excimer laser, i-line, g-line or the like. In other words, electromagnetic radiation for the exposure (light in broad sense) may be one for exposing the resist layer 143*b*.

Figure 19:
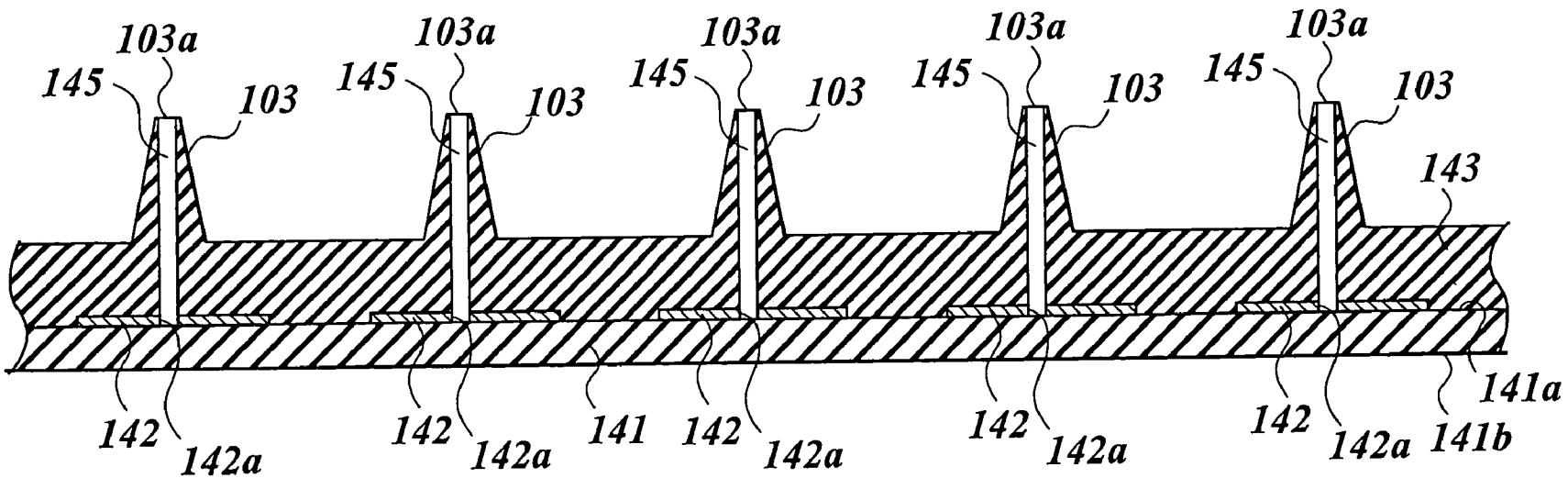
FIG. 19 is a drawing showing a step of the producing method of the above-mentioned liquid jetting head 100.

Next, by coating a developer over the resist layer 143*b*, the resist layer 143*b* is eliminated according to the shape of the exposure, and the plurality of nozzles 103, 103, . . . standing with respect to the base plate 141 are formed (refer to FIG. 19). In addition, in FIG. 19, the nozzle shape takes a conic shape or a truncated conic shape. However, it may take a flat shape without protrusion.

Here, in the case that the resist layer 143*b* is a positive type and of a photosensitive resin, since irradiation energy becomes larger when it is close to the surface side of the exposed resist layer 143*b* and conversely becomes smaller as it is closer to the base plate 141 side, solubility to the developer becomes smaller as it is closer to the base plate 141 side. Therefore, in the case that the resist layer 143*b* is a positive type, it is possible to form the nozzles 103, 103, . . . in approximately a conic shape or a truncated conic shape having a diameter becoming larger as it is close to the base plate 141 side, easily. Further, since the plurality of nozzles 103, 103, . . . are at once formed by forming the coating over the resist layer 143*b* and thereafter by only exposing/developing the resist layer 143*b*, productivity of the liquid jetting head is good.

Figure 20:
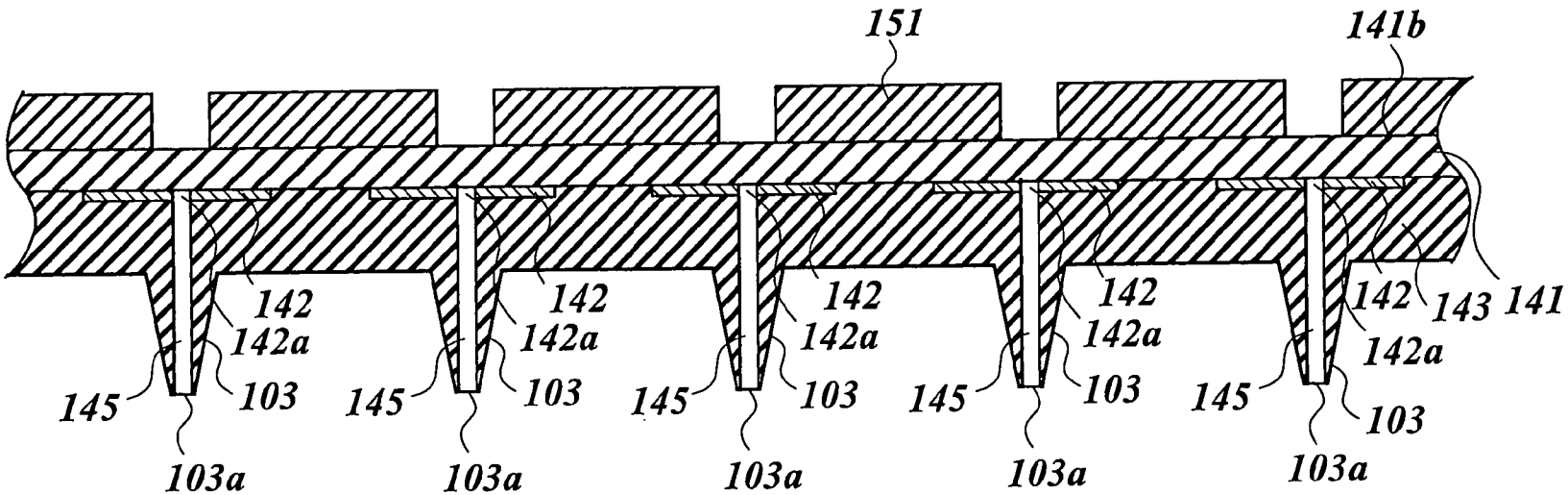
FIG. 20 is a drawing showing a step of the producing method of the above-mentioned liquid jetting head 100.

Next, a resist coating 151 is formed at the back surface 141*b* of the base plate 141 according to a photolithography method (refer to FIG. 20). Here, a shape of the resist coating seen in a plane view is a shape having an opening at a part to become the through holes 141*c*, 141*c*, . . . . Then, when etching is applied on the base plate 141 with resist coating 151 used as a mask, the plurality of through holes 141*c*, 141*c*, . . . are formed on the base plate 141, and thereafter the resist coating 151 is eliminated (refer to FIG. 21.). Thereby, the nozzle plate 104 is produced.

Figure 21:
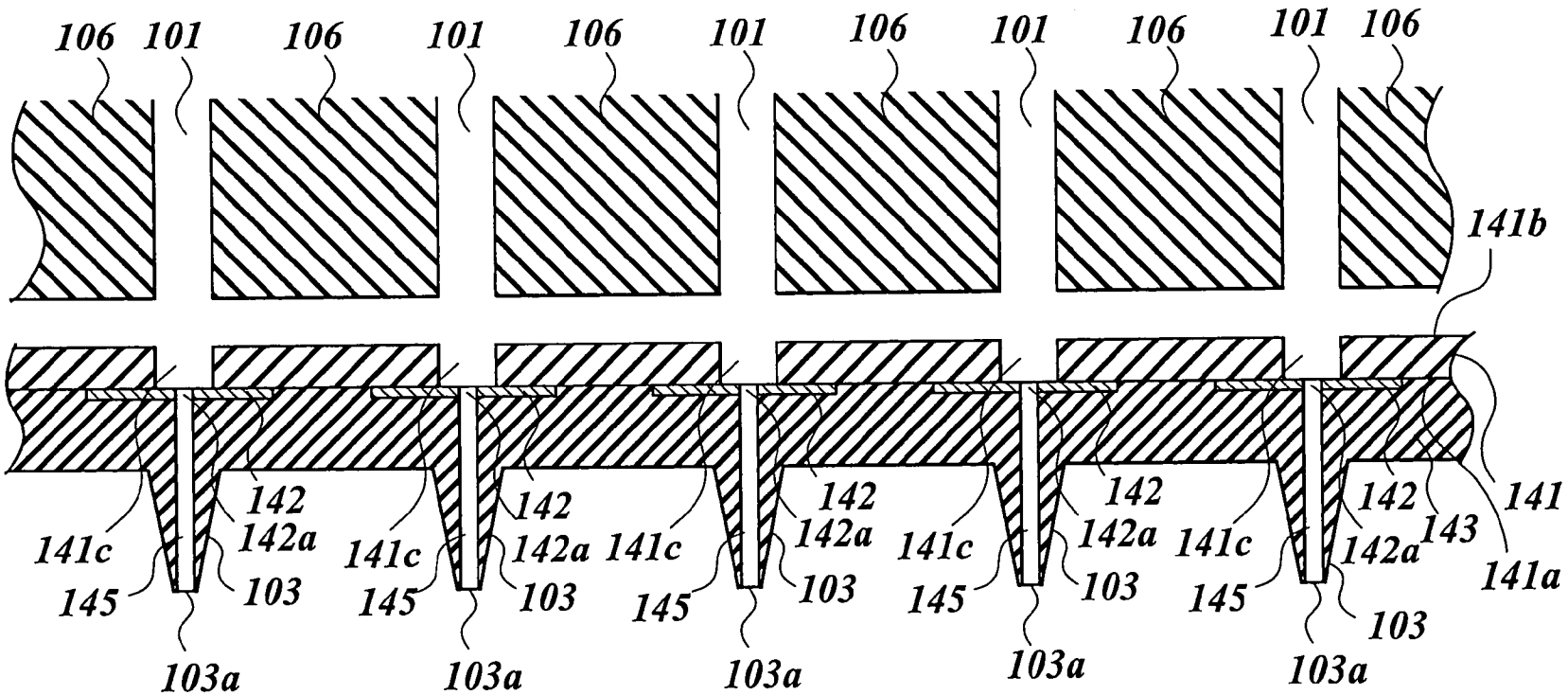
FIG. 21 is a drawing showing a step of the producing method of the above-mentioned liquid jetting head 100.

Then, by making the through holes 141*c*, 141*c*, formed on the base plate 141 face the respective liquid solution supplying channels 101 of the liquid room structure 102, the back surface 141*b* of the base plate is jointed to the bottom surface of the liquid room structure 102 (refer to FIG. 21). Further, the bias power source 30 and the jetting voltage power source 29 are electrically connected to each of the wirings 144, 144, . . . . Thereby, the liquid jetting head 100 is produced.

In addition, according to need, a water repellent processing may be applied on the surface of the nozzles 103, 103, . . . For example, the surface of the nozzles 103, 103, . . . may be so structured as to have water repellency by forming the resist layer 143 from a photosensitive resin having water repellency (for example, fluorine-containing photosensitive resin), or the surface of the nozzles 103, 103, . . . may be so structured as to have water repellency by forming a metal coat (for example, Ni, Au, Pt or the like) on the surface of the nozzle 103 with each jet opening 103*a* masked by the resist and by forming a water repellent coating formed according to eutectoid plating between its metal coating and a fluorine-containing resin after the nozzles 103, 103, . . . are formed (the resist that masks the jet opening 103*a* is to be eliminated at last.). The photosensitive resin having water repellency is one in which from a few percent to a few dozen percent of Cytop, manufactured by Asahi Glass Co., Ltd, which is formed by fluororesin is dissolved into PTFE, FEP dispersion or perfluoro solvent having mean particle diameter of approximately 0.2 μm, is dispersed and mixed to an ultraviolet-sensitive resin, and in the dispersion, FEP having lower melting point is more preferably used. Further, in the dispersion, MDF FEP 120-J (54 wt %, water-dispersion) manufactured by DuPont Co., Ltd, Fluon×AD911 (60 wt %, water-dispersion) manufactured by Asahi Glass Co., Ltd, or the like is applicable. Further, polymer for resist for F2-lithography is also a fluorine-containing photosensitive resin, such as one in which fluorine is induced to polymer main chain, and one in which fluorine is induced to side chain.

As above-mentioned producing method, since the nozzles 103, 103, . . . are formed by only exposing and developing the resist layer 143*b*, it is advantageous in view of flexibility to a shape of the nozzle 103, production cost, and correspondence to a long-length line head. For example, for producing a head disclosed in Japanese Patent Application Publication No. 2001-68827, since a silicon base plate is based and minute holes are formed on the silicon base plate, it is considered that, flexibly changing a shape of the nozzle is more convenient in the producing method in the present embodiment, producing a long-length line head is also advantageous in the producing method in the present embodiment, and production cost of the head 100 is also advantageous in the present embodiment.

Figure 22A:
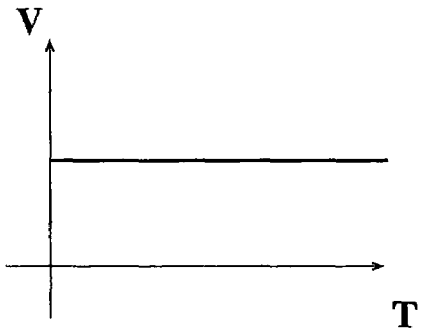
FIG. 22A is a graph showing a relation between time and a voltage applied to liquid solution in a case of not jetting.
Figure 22B:
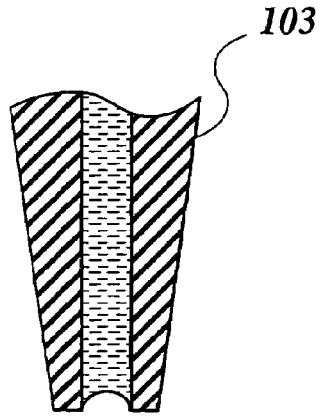
FIG. 22B is a cross-sectional view showing a state of a nozzle 103 in the case of not jetting.

Next, a driving method of the liquid jetting head 100 and a droplet jetting operation of the liquid jetting head 100 will be described. FIG. 22A is a graph showing a relation between time (horizontal axis) and a voltage applied to liquid solution (vertical axis) in a case of not jetting, FIG. 22B is a cross-sectional view showing a state of a nozzle 103 in the case of not jetting, FIG. 22C is a graph showing a relation between time (horizontal axis) and a voltage applied to the liquid solution (vertical axis) in a case of jetting, and FIG. 22D is a cross-sectional view showing a state of the nozzle 103 in the case of jetting.

In a state where chargeable liquid solution is supplied to the in-nozzle passage 145 of each nozzle 103 through the liquid entrance opening 119 and the manifold 120 by the supplying pump, and in such a state, a bias voltage is applied to the liquid solution via each jetting electrode 143 by each bias power source 30 (refer to FIG. 22A.). In such a state, the liquid solution is charged, and meniscus which dents in a reentrant form at the liquid solution is formed at an edge portion of each nozzle 103 (refer to FIG. 22B.).

Figure 22C:
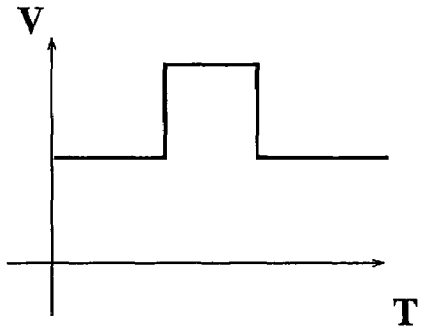
FIG. 22C is a graph showing a relation between time and a voltage applied to the liquid solution in a case of jetting.
Figure 22D:
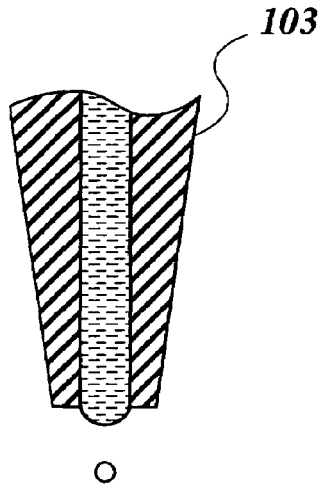
FIG. 22D is a cross-sectional view showing a state of the nozzle 103 in the case of jetting.

Then, in regard to a nozzle 103 jetting a droplet among the nozzles 103, 103, . . . , the jetting voltage power source 29 applies the pulse voltage to the liquid solution via the jetting electrode 142, and the pulse voltage is also applied to the control electrode 121 in synchronization with this pulse voltage (refer to FIG. 22C.). When the pulse voltage is applied to the control electrode 121, the liquid room barriers 106 and 107 swell and capacity of the liquid solution supplying channel 101 is reduced, and thereby a pressure of the liquid solution in the liquid solution supplying channel 101 increases.

Accordingly, meniscus in a convex form protruding to outside is formed at the edge portion of the nozzle 103. Further, since the pulse voltage is applied to the jetting electrode 142 approximately at the same time that the pulse voltage is applied to the control electrode 121, an electric field is concentrated at the top of the meniscus in a convex form protruding to outside, and after all a minute droplet is jetted to the counter electrode side against a surface tension of the liquid solution (refer to FIG. 22D).

Then, when the pulse voltage applied to the jetting electrode 142 is finished and the pulse voltage applied to the control electrode 121 is finished, the meniscus which dents in a convex form in the liquid solution is formed at the edge portion of the nozzle 103 by increasing the capacity of the liquid solution supplying channel 101, and the liquid solution is supplied to the in-nozzle passage 145 of the nozzle 103 that jetted the liquid through the liquid entrance opening 119 and the manifold 120.

In addition, in the description above, the liquid room barriers 106 and 107 swell and the capacity of the liquid solution supplying channel 101 increases with the pulse voltage applied to the control electrode 121. However, conversely, the capacity of the liquid solution supplying channel 101 may be reduced by shrinking the liquid room barriers 106 and 107 with the pulse voltage applied to the control electrode 121. However, in this case, at the time of jetting, when the pulse voltage is applied to the jetting electrode 142, the pulse voltage is not applied to the control electrode 121, and at the time of not jetting, when the bias voltage is applied to the jetting electrode 142, the pulse voltage is applied to the control electrode 121. Further, as another head driving method, by taking advantage of the fact that the jetting voltage differs depending on a meniscus position of the nozzle 103, a non-jetting voltage $V_0$ is applied to the jetting electrode 142 when a meniscus position is lower than the edge of the nozzle 103, and by applying the pulse voltage to the control electrode 121, the capacity of the liquid solution supplying channel 101 is changed, and thereby the jetting can be controlled by controlling a meniscus position jetted from the edge of the nozzle 103 being capable of jetting at the voltage $V_0$.

Further, meniscus in a convex form is formed by giving a pressure to the liquid solution in the liquid solution supplying channel 101 through the liquid room barriers 106 and 107 being piezoelectric elements, at the time of jetting. However, meniscus in a convex form may be formed by giving a pressure to the liquid solution by the film boiling of the liquid solution in the liquid solution supplying channel 101 with a heater or the like. Since convex meniscus forming section is to change the pressure of the liquid solution in the in-nozzle passage 145, the section may be a method of changing the capacity of the liquid solution supplying channel 101, and an electrostatic sucking method for changing the capacity by bending the wall of the liquid solution supplying channel 101 with an electrostatic force is possible. In addition, although jetting may be done without forming meniscus in a convex form, a case of jetting with forming meniscus in a convex form is advantageous in view of making the jetting voltage constant, safety at the droplet jetting control, and control cost.

As a method of using the above-mentioned liquid jetting head 100, for example, while the above-mentioned liquid jetting head 100 (mainly, the liquid room structure 102 and the nozzle plate 104) is moved within a plane parallel to the base member 200, relatively with respect to the base member 200, a droplet is selectively jetted from the edge portion of each nozzle 103, and thereby a pattern where droplets dropped at the surface of the base member 200 become dots is formed on the surface of the base member 200. Further, since the plurality of nozzles 103, 103, . . . are arranged in line, by moving the base member 200 in a direction being perpendicular with respect to the line of the nozzles 103, 103, . . . and by jetting a droplet selectively from the edge portion of each nozzle 103, it is possible to form a pattern where droplets dropped on the surface of the base member 200 become dots, is formed on the surface of the base member 200. Since the liquid jetting head 100 comprises the plurality of nozzles 103, 103, . . . , it is possible to form the pattern quickly. Further, it is possible to use the liquid jetting head 100 for any one of: formation of a wiring pattern of a circuit; formation of a wiring pattern of a metal super fine particle; formation of carbon nanotube, its precursor and catalytic arrangement; formation of patterning of ferroelectric ceramics and its precursor; high-orientation of high polymer molecule and its precursor; zonerefining; microbeads manipulation; active tapping; and formation of spacial configuration.

As mentioned, since the above-mentioned liquid jetting head 100 jets a droplet by the nozzle 103 having a minute diameter, which cannot be found conventionally, an electric field is concentrated by the liquid solution being in a charged state in the in-nozzle passage 145, and thereby electric field intensity is enhanced. Therefore, jetting of the liquid solution by a nozzle having a minute diameter (for example, inside diameter 100[μm]), which was conventionally regarded as substantially impossible since a voltage necessary for jetting would become too high with a nozzle having a structure in which concentration of an electric field is not performed, is now possible with a lower voltage than the conventional one.

Then, since it is a minute diameter, it is possible to do the control to easily reduce jetting quantity per unit time due to low nozzle conductance, and the jetting of the liquid solution with a sufficiently-small droplet diameter (0.8[μm] according to each above-mentioned condition) without narrowing a pulse width is realized.

Further, since the jetted droplet is charged, even though it is a minute droplet, a vapor pressure is reduced and evaporation is suppressed, and thereby the loss of mass of the droplet is reduced, the flying stabilization is achieved and the decrease of landing accuracy of the droplet is prevented.

Further, since the surface of the nozzles 103, 103, . . . has water repellency, at the time that the liquid solution should not be jetted, the liquid solution in the nozzles 103, 103, . . . does not drip nor flow. Further, since the surface of the nozzles 103, 103, . . . has water repellency, an adverse effect is not caused to the jetting of a droplet with the liquid solution adhering to the periphery of the jet opening 103*a*. Further, since the surface of the nozzles 103, 103, . . . has water repellency, the meniscus formed at the time of jetting is formed in a refined convex shape, and thereby a droplet is stably jetted.

Further, since a pressure is applied to the liquid solution in the nozzle 103 approximately at the same time that the pulse voltage is applied to the liquid solution in each nozzle 103, even though the pulse voltage applied to the jetting electrode 142 is a low voltage, a droplet is jetted. In other words, the jetting of the liquid solution by a nozzle having a minute diameter, which was regarded as substantially impossible since a voltage necessary for jetting would become too high, is now possible with a lower voltage than the conventional one.

In addition, for obtaining an electrowetting effect to the nozzle 103, an electrode (for example, the metal coating formed under the above-mentioned water repellent coating.) may be provided at a circumference of the nozzle 103, or an electrode may be provided at an inside surface of the in-nozzle passage 145 and a dielectric coating covers thereover. Then, by applying a voltage to this electrode, it is possible to enhance wettability of the inside surface of the in-nozzle passage 145 with respect to the liquid solution to which the voltage is applied by the jetting electrode 142 according to the electrowetting effect, and thereby it is possible to suitably perform the jetting and improve the responsiveness of the jetting.

Further, the jetting voltage applying section 25 always applies the bias voltage to each jetting electrode 142 for jetting a droplet by using the pulse voltage as a trigger. However, it is possible to have a structure where the jetting is performed by always applying alternate current having an amplitude necessary for jetting or a continuous rectangular wave to each jetting electrode 142 and by changing high and low of its frequency. It is essential to have the liquid solution charged for jetting a droplet, and when the jetting voltage is applied at a frequency exceeding a speed at which the liquid solution is charged, the jetting is not performed, but the jetting is performed when it is switched to a frequency at which it is possible to charge the liquid solution sufficiently. Therefore, by doing the control to apply the jetting voltage with a frequency larger than a frequency at which it is possible to jet when jetting is not performed, and to reduce the frequency to a frequency band where it is possible to perform the jetting only when the jetting is to be performed, it is possible to control the jetting of the liquid solution. In such a case, since an electric potential to be applied to the liquid solution does not have a change in itself, it is possible to improve time responsiveness even more, and thereby it is possible to improve landing accuracy of a droplet.

SECOND EMBODIMENT

A second embodiment to which the present invention is applied will be described with reference to FIG. 23 to FIG. 28.

Whole Structure of Liquid Jetting Apparatus

Figure 23:
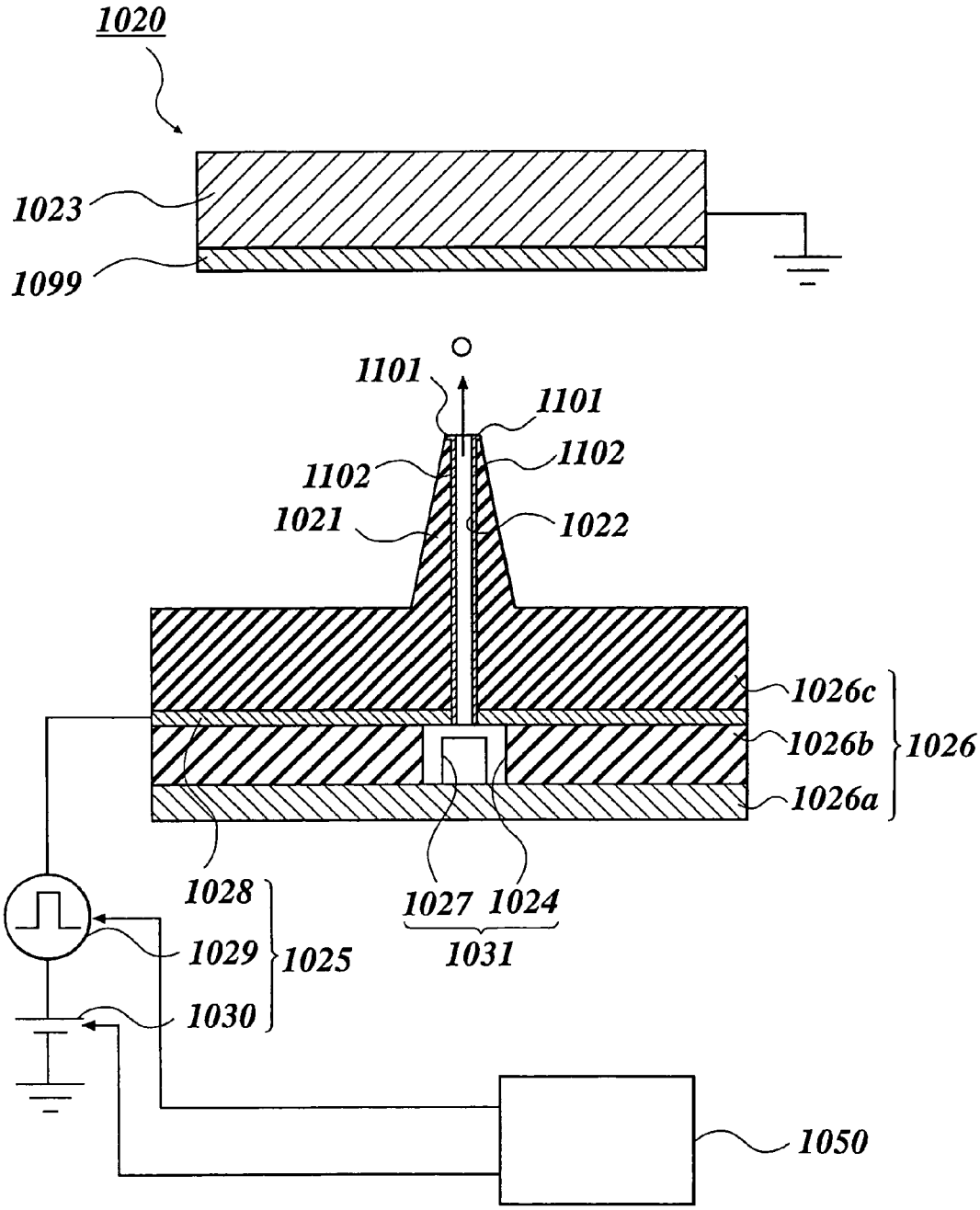
FIG. 23 is a block diagram showing a liquid jetting apparatus 1020 in a second embodiment.

FIG. 23 is a view showing a whole structure of a liquid jetting apparatus 1020 in the second embodiment to which the liquid jetting apparatus of the present invention is applied. In FIG. 23, the apparatus is shown with a part thereof cut out along a nozzle 1021. First, the whole structure of the liquid jetting apparatus 1020 will be described with reference to FIG. 23.

This liquid jetting apparatus 1020 comprises the nozzle 1021 having a super minute diameter for jetting a droplet of chargeable liquid solution from its edge portion; a counter electrode 1023 having a facing surface facing the edge portion of the nozzle 1021 and supporting a base member 1099 for receiving the landing of the droplet; a liquid solution supplying section 1031 for supplying the liquid solution to a passage 1022 in the nozzle 1021; a jetting voltage applying section 1025 for applying a jetting voltage to the liquid solution in the nozzle 1021; and an operation control section 1050 for controlling the applying of the jetting voltage by the jetting voltage applying section 1025. The above-mentioned nozzle 1021, a partial structure of the liquid solution supplying section 1031 and a partial structure of the jetting voltage applying section 1025 are integrally formed by a nozzle plate 1026.

In FIG. 23, for the convenience of a description, a state where the edge portion of the nozzle 1021 faces upward and the counter electrode 1023 is provided above the nozzle 1021, is illustrated. However, practically, the apparatus is so used that the nozzle 1021 faces in a horizontal direction or a lower direction than the horizontal direction, more preferably, the nozzle 1021 faces perpendicularly downward.

Liquid Solution

As an example of the liquid solution jetted by the above-mentioned liquid jetting apparatus 1020, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbitol, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large amount of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate.methacrylic acid copolymer, lauryl methacrylate.2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile-styrene copolymer, styrene.maleate copolymer, styrene. isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene. polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene.vinyl acetate copolymer, ethylene.ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semisynthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

When the liquid jetting apparatus 1020 is used as a patterning method, as a representative example, it is possible to use it for display use. Concretely, it is possible to cite formation of fluorescent material of plasma display, formation of rib of plasma display, formation of electrode of plasma display, formation of fluorescent material of CRT, formation of fluorescent material of FED (Field Emission type Display), formation of rib of FED, color filter for liquid crystal display (RGB coloring layer, black matrix layer), spacer for liquid crystal display (pattern corresponding to black matrix, dot pattern and the like). The rib mentioned here means a barrier in general, and with plasma display taken as an example, it is used for separating plasma areas of each color. For other uses, it is possible to apply it to microlens, patterning coating of magnetic material, ferrodielectric substance, conductive paste (wire, antenna) and the like for semiconductor use, as graphic use, normal printing, printing to special medium (film, fabric, steel plate), curved surface printing, lithographic plate of various printing plates, for processing use, coating of adhesive, sealer and the like using the present embodiment, for biotechnological, medical use, pharmaceuticals (such as one mixing a plurality of small amount of components), coating of sample for gene diagnosis or the like.

Nozzle

The above-mentioned nozzle 1021 is integrally formed with an upper surface layer 1026*c* of the nozzle plate 1026, which will be described later, and is provided to stand up perpendicularly with respect to a flat plate surface of the nozzle plate 1026. Further, at the time of jetting a droplet, the nozzle 1021 is used to perpendicularly face a receiving surface (surface where the droplet lands) of the base member 1099. Further, in the nozzle 1021, an in-nozzle passage 1022 penetrating from an edge portion of the nozzle 1021 along the nozzle center is formed. The in-nozzle passage 1022 is opened at an edge of the nozzle 1021, and thereby a jet opening to be an end of the in-nozzle passage 1022 is formed at the edge of the nozzle 1021. A diameter of the jet opening formed at the nozzle 1021 (that is, inside diameter of the nozzle 1021) is not more than 30 μm, more preferably less than 20 μm, even more preferably not more than 10 μm, even more preferably not more than 8 μm, even more preferably not more than 4 μm.

The nozzle 1021 will be described in more detail. In the nozzle 1021, an opening diameter of its edge portion and the in-nozzle passage 1022 are uniform, and as mentioned, these are so formed as to have a super minute diameter. As one concrete example of dimensions of each part, an inside diameter of the in-nozzle passage 1022 is set to 1[μm], an outside diameter of the edge portion of the nozzle 1021 is set to 2[μm], a diameter of the root of the nozzle 1021 is 5[μm], and a height of the nozzle 1021 is set to 100[μm], and a shape thereof is formed as a truncated conic shape being unlimitedly close to a conic shape. In addition, the height of the nozzle 1021 may be 0[μm].

In addition, a shape of the in-nozzle passage 1022 may not be formed linearly with having a constant inside diameter as shown in FIG. 23. For example, as shown in FIG. 15A, it may be so formed as to give roundness to a cross-section shape at the edge portion of the side of a liquid solution room 1024, which will be described later, of the in-nozzle passage 1022. Further, as shown in FIG. 15B, an inside diameter at the edge portion of the side of the liquid solution room 1024, which will be described later, of the in-nozzle passage 1022 may be set to be larger than an inside diameter of the edge portion of the jetting side, and an inside surface of the in-nozzle passage 1022 may be formed in a tapered circumferential surface shape. Further, as shown in FIG. 15C, only the edge portion of the side of the liquid solution room 1024, which will be describe later, of the in-nozzle passage 1022 may be formed in a tapered circumferential surface shape and the jetting edge portion side with respect to the tapered circumferential surface may be formed linearly with constant inside diameter.

Liquid Solution Supplying Section

The liquid supplying section 1031 is provided at a position being inside of the nozzle plate 1026 and at the root of the nozzle 1021, and comprises the liquid solution room 1024 communicated to the in-nozzle passage 1022; a supplying passage 1027 for guiding the liquid solution from an external liquid solution tank, of which illustration is omitted, to the liquid solution room 1024; and a supplying pump for giving a supplying pressure of the liquid solution to the liquid solution room 1024. The above-mentioned supplying pump supplies the liquid solution to the edge portion of the nozzle 1021, and supplies the liquid solution while maintaining the supplying pressure within a range within which the liquid solution is not dripped (refer to FIG. 24A and FIG. 24B.). Further, this supplying pump may be one using a pressure difference according to arrangement positions of the liquid solution tank and the nozzle 1021. Further, the liquid solution supplying section 1031 may, as described in a third embodiment, comprise a mechanism for changing capacity of the liquid solution room 1024 and for controlling the supplying pressure of the liquid solution (refer to FIG. 29.). As this mechanism which controls the supplying pressure of the liquid solution, one changing a voltage and changing a shape of a liquid solution room wall such as a piezoelectric element, one changing capacity of the liquid solution room with air bubble by using a heater, or one changing the liquid solution room wall with an electrostatic force, is applicable.

Jetting Voltage Applying Section

The jetting voltage applying section 1025 comprises a jetting electrode 1028 for applying a jetting voltage, the jetting electrode 1028 being provided inside of the nozzle plate 1026 and at a border position between the liquid solution room 1024 and the in-nozzle passage 1022; a bias power source 1030 for always applying a direct current bias voltage to this jetting electrode 1028; and a jetting voltage power source 1029 for applying a pulse voltage to the jetting electrode 1028 by superimposing the bias voltage thereto, to be an electric potential for the jetting.

The above-mentioned jetting electrode 1028 is directly contacted to the liquid solution in the liquid solution room 1024, for charging the liquid solution and applying the jetting voltage.

In regard to the bias voltage by the bias power source 1030, by always applying the voltage within a range within which the jetting of the liquid solution is not performed, a width of a voltage to be applied at the jetting is preliminarily reduced, herewith responsiveness at the jetting is improved.

The jetting voltage power source 1029 is controlled by the operation control section 1050, to superimpose the pulse voltage to the bias voltage to be applied only when the jetting of the liquid solution is performed. A value of the pulse voltage is set so that a superimposed voltage V at this time should satisfy a condition of the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\epsilon_0$: electric constant [F/m], d: nozzle diameter [m], h: distance between nozzle and base member [m], k: constant of proportionality dependent on nozzle shape (1.5<k<8.5).

When the superimposed voltage V is not less than a jetting start voltage $V_c$, the liquid solution is jetted from the nozzle.

As one example, the bias voltage is applied at DC300[V], and the pulse voltage is applied at 100[V]. Therefore, the superimposed voltage at jetting will be 400[V].

Nozzle Plate

The nozzle plate 1026 comprises a base layer 1026*a* placed at the lowest layer in FIG. 23; a passage layer 1026*b* placed on top of it, the passage layer 1026*b* forming a supplying passage of the liquid solution; and an upper surface layer 1026*c* formed further on top of this passage layer 1026*b*. The above-mentioned jetting electrode 1028 is inserted between the passage layer 1026*b* and the upper surface layer 1026*c*.

The above-mentioned base layer 1026*a* is formed from a silicon base plate, highly-insulating resin or ceramic, and a dissolvable resin layer is formed on top thereof and it is eliminated except for a part corresponding to a predetermined pattern for forming the supplying passage 1027 and the liquid solution room 1024, and the insulating resin layer is formed at the eliminated part. This insulating resin layer becomes the passage layer 1026*b*. Then, the jetting electrode 1028 is formed on an upper surface of this insulating resin layer by an electroless plating of a conductive element (for example NiP), and a resist resin layer having insulating properties is formed further on top thereof. Since this resist resin layer becomes the upper surface layer 1026*c*, this resin layer is formed with a thickness in consideration of a height of the nozzle 1021. Then, this insulating resist resin layer is exposed according to an electron beam method or femtosecond laser, for forming a nozzle shape. The in-nozzle passage 1022 is also formed according to a laser processing. Then, the dissolvable resin layer corresponding to the pattern of the supplying passage 1027 and the liquid solution room 1024 is eliminated, these supplying passage 1027 and the liquid solution room 1024 are communicated to each other, and the production of the nozzle plate 1026 is completed.

In addition, material of the upper surface layer 1026*c* and the nozzle 1021 may be, concretely, semiconductor such as Si or the like, conductive material such as Ni, SUS or the like, other than insulating material such as epoxy, PMMA, phenol, soda glass.

Figure 25:
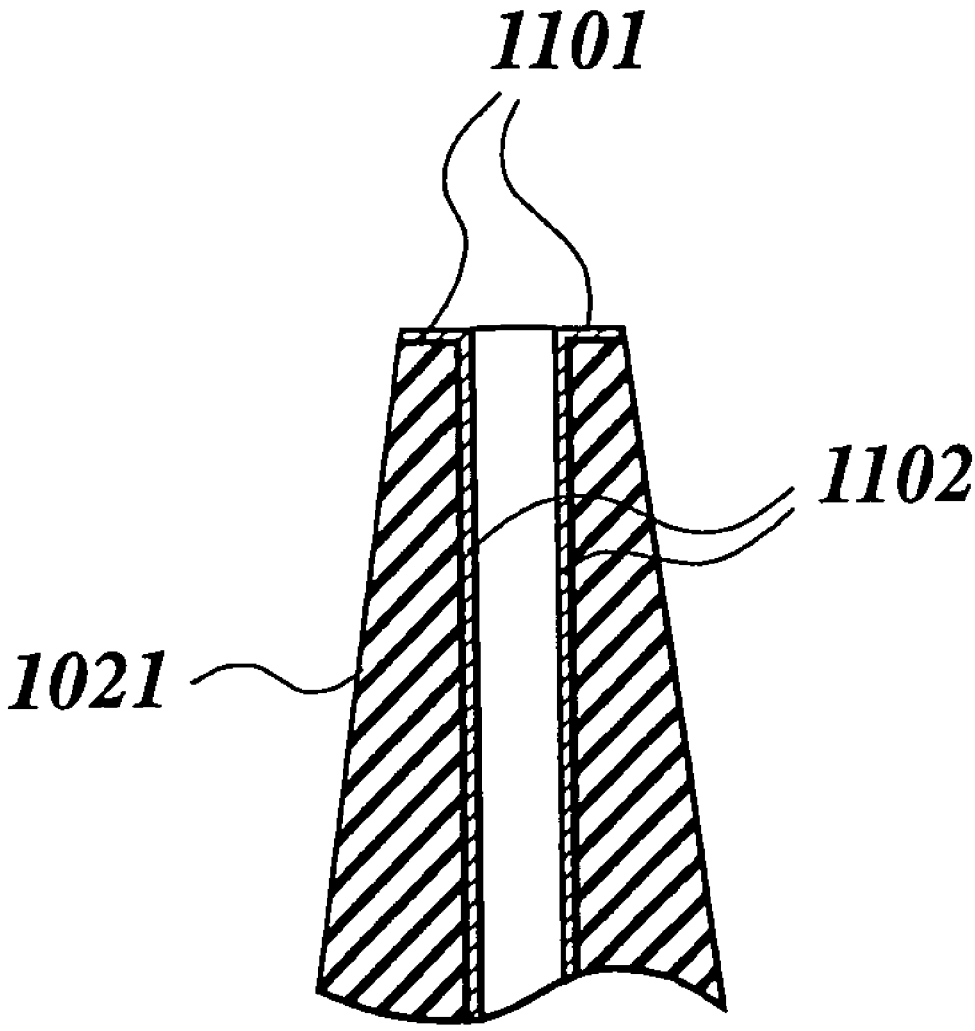
FIG. 25 is a cross-sectional view showing the nozzle 1021 of the liquid jetting apparatus 1020 in the second embodiment.

After an electroless Ni—P processing applied on a nozzle base member formed from the resist resin layer, with the eutectoid of fluorinated pitch, a coating having water repellency higher than the nozzle base member is formed. FIG. 25 is a vertical cross-sectional view of the nozzle 1021. As shown in FIG. 25, a water repellent coating 1101 is formed at a surface of the circumference of a jet opening of the nozzle 1021, and a water repellent coating 1102 is formed at an inside surface of the nozzle 1021.

Further, after the electroless Ni—P processing is applied on the nozzle base member, according to Metaflon NF plating, manufactured by C. Uemura & Co., Ltd., PTFE particles may be made eutectoid into a plating coat for forming the water repellent coating, or Product name Cytop (registered mark) manufactured by Asahi Glass Co., Ltd., or the like may be coated for forming the water repellent coating. Further, electrocoating of cationic or anionic fluorine-containing resin; coating of fluorinated high polymer, silicon resins and polydimethylsiloxane; sintering; eutectoid plating method of fluorinated high polymer; evaporation method of amorphous alloy membrane; making a coat such as organic silicon compound, fluorine-containing silicon compound or the like centering on polydimethylsiloxanes formed by plasma-polymerizing hexamethylsiloxiane as monomer according to a plasma CVD method, are available. Control of water repellency of the nozzle can be managed by selecting a processing method corresponding to liquid solution.

Further, without forming a water repellent coating on a surface of the nozzle, by forming the nozzle with fluorine-containing photosensitive resin, it is also possible to obtain a similar effect. The fluorine-containing photosensitive resin is one in which from a few percent to a few dozen percent of Cytop, manufactured by Asahi Glass Co., Ltd, which is formed by fluororesin is dissolved into PTFE dispersion, FEP dispersion or perfluoro solvent having a mean particle diameter of approximately 0.2 μm, is dispersed and mixed to ultraviolet-sensitive resin, and in the dispersion, FEP having a lower melting point is preferably used. Further, in the dispersion, MDF FEP 120-J (54 wt %, water-dispersion) manufactured by DuPont Co., Ltd, Fluon×AD911 (60 wt %, water-dispersion) manufactured by Asahi Glass Co., Ltd, or the like is applicable. Further, polymer for resist for F2-lithography is also fluorine-containing photosensitive resin, such as one in which fluorine is induced to polymer main chain, and one in which fluorine is induced to side chain.

Counter Electrode

As shown in FIG. 23, the counter electrode 1023 comprises a facing surface being perpendicular to a protruding direction of the nozzle 1021, and supports the base member 1099 along the facing surface. A distance from the edge portion of the nozzle 1021 to the facing surface of the counter electrode 1023 is, as one example, set to 100[μm].

Further, since this counter electrode 1023 is grounded, the counter electrode 1023 always maintains a grounded electric potential. Therefore, at the time of applying the pulse voltage, a droplet jetted according to an electrostatic force by an electric field generated between the edge portion of the nozzle 1021 and the facing surface is guided to a side of the counter electrode 1023.

In addition, since the liquid jetting apparatus 1020 jets a droplet by enhancing electric field intensity according to electric field concentration at the edge portion of the nozzle 1021 according to super-miniaturization of the nozzle 1021, it is possible to jet the droplet without the guiding by the counter electrode 1023. However, the guiding by an electrostatic force between the nozzle 1021 and the counter electrode 1023 is preferably performed. Further, it is possible to let out the electric charge of a charged droplet by grounding the counter electrode 1023.

Operation Control Section

The operation control section 1050 is in practice structured from a calculation device including a CPU, a ROM, a RAM and the like. The above-mentioned operation control section 1050 makes the bias power source 1030 apply a voltage continuously, and makes the jetting voltage power source 1029 apply a driving pulse voltage when receiving an input of a jetting instruction from outside.

Jetting Operation of Minute Droplet by Liquid Jetting Apparatus

An operation of the liquid jetting apparatus 1020 will be described with reference to FIG. 23 and FIG. 24.

Figure 24A:
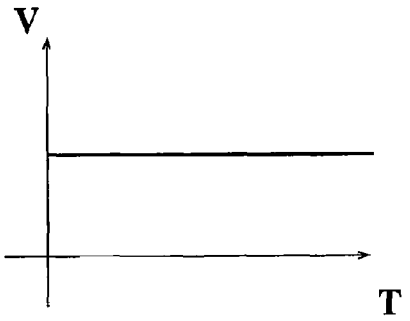
FIG. 24A is a graph showing a relation between time and a voltage applied to the liquid solution in a case of not jetting.
Figure 24B:
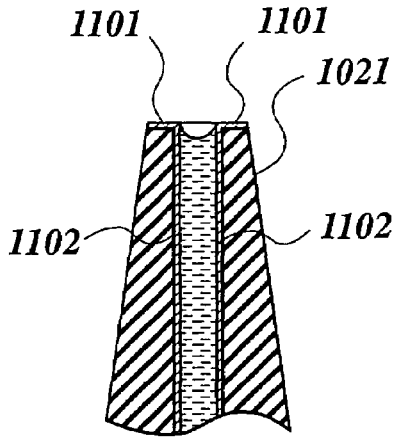
FIG. 24B is a cross-sectional view showing a state of a nozzle 1021 in the case of not jetting.
Figure 24C:
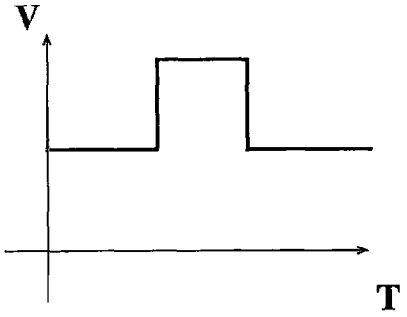
FIG. 24C is a graph showing a relation between time and a voltage applied to the liquid solution in a case of jetting.
Figure 24D:
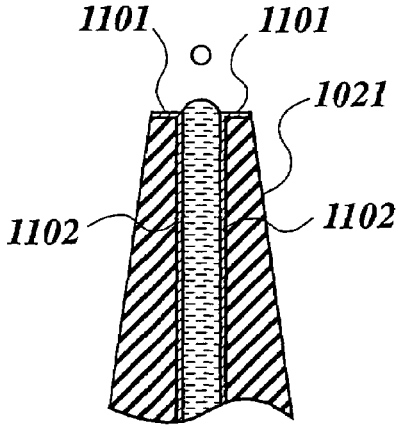
FIG. 24D is a cross-sectional view showing a state of the nozzle 1021 in the case of jetting.

Here, FIG. 24A is a graph showing a relation between time (horizontal axis) and a voltage applied to the liquid solution (vertical axis) in a case of not jetting, FIG. 24B is a vertical cross-sectional view showing a state of the nozzle 1021 in the case of not jetting, FIG. 24C is a graph showing a relation between time (horizontal axis) and a voltage applied to the liquid solution (vertical axis) in a case of jetting, and FIG. 24D is a vertical cross-sectional view showing a state of the nozzle 1021 in the case of jetting.

In a state where chargeable liquid solution is supplied to the in-nozzle passage 1022 by the liquid solution supplying section 1031, and in such a state, the bias voltage is applied to the liquid solution via the jetting electrode 1028 by the bias power source 1030 (refer to FIG. 24A.). In such a state, the liquid solution is charged, and meniscus which dents in a reentrant form by the liquid solution is formed at an edge portion of each nozzle 103 (refer to FIG. 24B.).

Then, a jetting instruction signal is inputted to the operation control section 1050, and when the jetting voltage power source 1029 applies the pulse voltage (refer to FIG. 24C.), the liquid solution is guided to the edge portion side of the nozzle 1021 by an electrostatic force according to electric field intensity of a concentrated electric field at the edge portion of the nozzle 1021, and a convex meniscus protruding to outside is formed, and an electric field is concentrated at the top of the convex meniscus, and after all a minute droplet is jetted to the counter electrode side against a surface tension of the liquid solution (refer to FIG. 24D).

Since the above-mentioned liquid jetting apparatus 1020 performs jetting of a droplet by the nozzle 1021 having a minute diameter, which was not available conventionally, an electric field is concentrated by the liquid solution in a state of being charged in the in-nozzle passage 1022, and thereby electric field intensity is enhanced. Accordingly, the jetting of the liquid solution by a nozzle having a minute diameter (for example, an inside diameter of 100[μm], which was conventionally regarded as substantially impossible since a voltage necessary for jetting would become too high with a nozzle having a structure with which concentration of an electric field is not performed, is now possible with a lower voltage than the conventional one.

Then, since it is a minute diameter, current of the liquid solution in the in-nozzle passage 1022 is limited due to low nozzle conductance. Therefore, it is possible to easily do the control to reduce the jetting current amount per unit time, and the jetting of the liquid solution with a sufficiently-small droplet diameter (0.8[μm] according to each of the above-mentioned conditions) without narrowing a pulse width is realized.

Further, since the jetted droplet is charged, a vapor pressure is reduced even with a minute droplet and evaporation is suppressed. Therefore, the loss of droplet mass is reduced, the flying stabilization is given, and the decrease of landing accuracy of a droplet is prevented.

Figure 26:
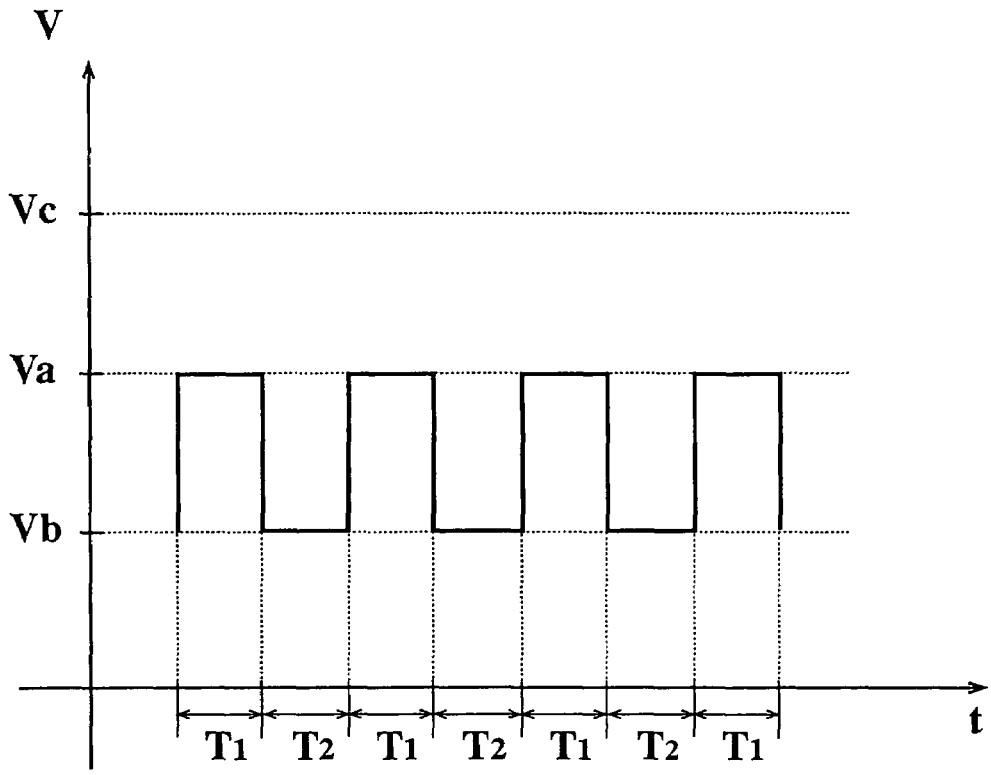
FIG. 26 is a view showing a voltage applying pattern when the liquid jetting apparatus 1020 in the second embodiment is on standby for jetting.

FIG. 26 shows a voltage applying pattern when the liquid jetting apparatus 1020 in the present embodiment is on standby for jetting. Here, the standby for jetting is a time for preparing the next jetting while the liquid jetting apparatus 1020 is functioning. In FIG. 26, the vertical axis indicates an applied voltage V and the horizontal axis indicates course of time t. While it is on standby for jetting, voltages Va and Vb which are different from each other and smaller than the jetting start voltage $V_c$ are alternately applied. Time T1 for which Va is applied and time T2 for which Vb is applied may satisfy any of: T1=T2, T1>T2 and T1<T2. The voltage applying pattern may be a pulse wave as shown in FIG. 26, or a sine wave. Therefore, charged components in the liquid solution are stirred, and a liquid level vibrates in the nozzle. As a result, the charged components in the liquid solution are not easily aggregated and the liquid solution does not easily adhere in the nozzle, whereby it is possible to prevent clogging of the nozzle 1021.

Figure 27:
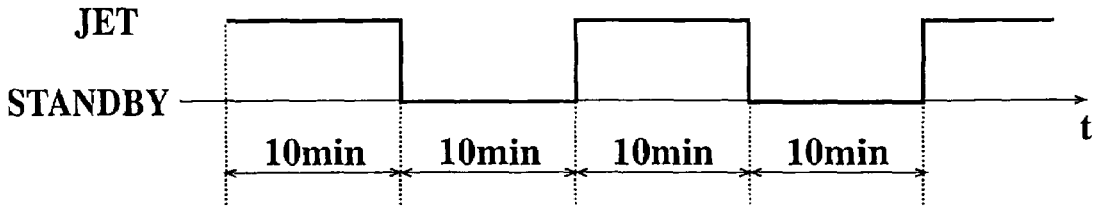
FIG. 27 is a view showing a test driving pattern of the liquid jetting apparatus 1020 in the second embodiment.

FIG. 28 is a diagram showing an experimental condition and an experimental result of an experiment example using the liquid jetting apparatus 1020 in the present embodiment. As shown in FIG. 28, cases are divided into: one in which a water repellent coating is not formed to the nozzle; one in which the water repellent coating 1101 is formed on the surface of the circumference of a jet opening of the nozzle (water repellent coating area 1), the water repellent coatings 1101 and 1102 are formed on the surface of the circumference of the jet opening of the nozzle and the inside surface of the nozzle (water repellent coating area 2); one in which the voltage shown in FIG. 26 is not applied while it is on standby for jetting; and one that the voltage is applied. Under conditions 1 to 6, an experiment regarding responsiveness and clogging is performed. As test ink, one having viscosity of 8[cP], resistivity of $10^8$[Ωcm], surface tension 30[mN/m] is used. FIG. 27 shows a test driving pattern. In FIG. 27, the horizontal axis indicates time. As shown in FIG. 27, a state of jetting for each 10 minutes and a state of standby were alternately repeated, and it was continued for 5 hours. T1=1[second] and T2=1[second]. Further, Va=380[V] and Vb=300[V].

After five hours passed, 100 points were continuously drawn on a glass plate, and evaluation of responsiveness was done by subjectively evaluating clearness of its shape and evenness, and the evaluation was done at 5 degrees of, 5: extremely good, 4: good, 3: normal, 2: a little bad, and 1: bad.

The evaluation of clogging is done so that it was OK if jetting was performed after five hours passed.

In the case of a condition 1 where a water repellent coating is not available on a nozzle surface and a voltage applying pattern of standby for jetting shown in FIG. 26 is not applied while it is on standby, clogging of the nozzle occurred at 30 minutes from the start, and it was not possible to continue the experiment.

As shown in FIG. 28, when conditions 3 and 5 are compared, than a case of forming the water repellent coating 1101 on the surface of the circumference surface of the jet opening of the nozzle, a case of forming water repellent coatings 1101 and 1102 at the circumference surface of the jet opening of the nozzle and at the inside surface of the nozzle had a better result in responsiveness.

Further, when conditions 1 and 2 are compared, a case of applying the voltage applying pattern of standby for jetting shown in FIG. 26 while on standby had a better result in responsiveness. Further, a case of a condition 4 where the water repellent coating 1101 was formed at the circumference surface of the jet opening of the nozzle had better responsiveness, and a case of a condition 6 where the water repellent coatings 1101 and 1102 are formed at the circumference surface of the jet opening of the nozzle and the inside surface of the nozzle had the best responsiveness in the experiment of this time.

When the liquid solution is fixed to the jet opening of the nozzle or inside of the nozzle, unevenness of the jetted dot occurs, and the shape becomes uneven. Therefore, it is possible to say that responsiveness can be an index that indicates a degree of clogging. From the result of the present experiment, it is possible to say that, for preventing clogging of the nozzle, it is effective to form a water repellent coating at the nozzle, and to apply a varying voltage being smaller than the jetting start voltage $V_c$, to the liquid solution in the nozzle while on standby for jetting.

Therefore, in accordance with the liquid jetting apparatus 1020 in the second embodiment, since, by vibrating a liquid level in the nozzle while it is on standby, and by stirring charged components in the liquid solution, it is possible to maintain a state where the charged components in the liquid solution are evenly dispersed, it is possible to suppress the charged components from being aggregated. Further, since it is possible to always move the liquid solution, it is possible to suppress the liquid solution from adhering in the nozzle, to prevent the liquid solution from being fixed to the nozzle 1021, and prevent clogging of the nozzle 1021.

Further, since, by making water repellency of the circumference of the jet opening of the nozzle 1021 and of the inside surface of the nozzle 1021 higher than that of the nozzle material, the liquid solution does not easily adhere to the nozzle 1021 and the liquid solution is not easily fixed to the nozzle 1021, it is possible to prevent clogging of the nozzle 1021.

THIRD EMBODIMENT

A third embodiment to which the present invention is applied will be described with reference to FIG. 29, FIG. 30A, FIG. 30B and FIG. 30C.

Figure 29:
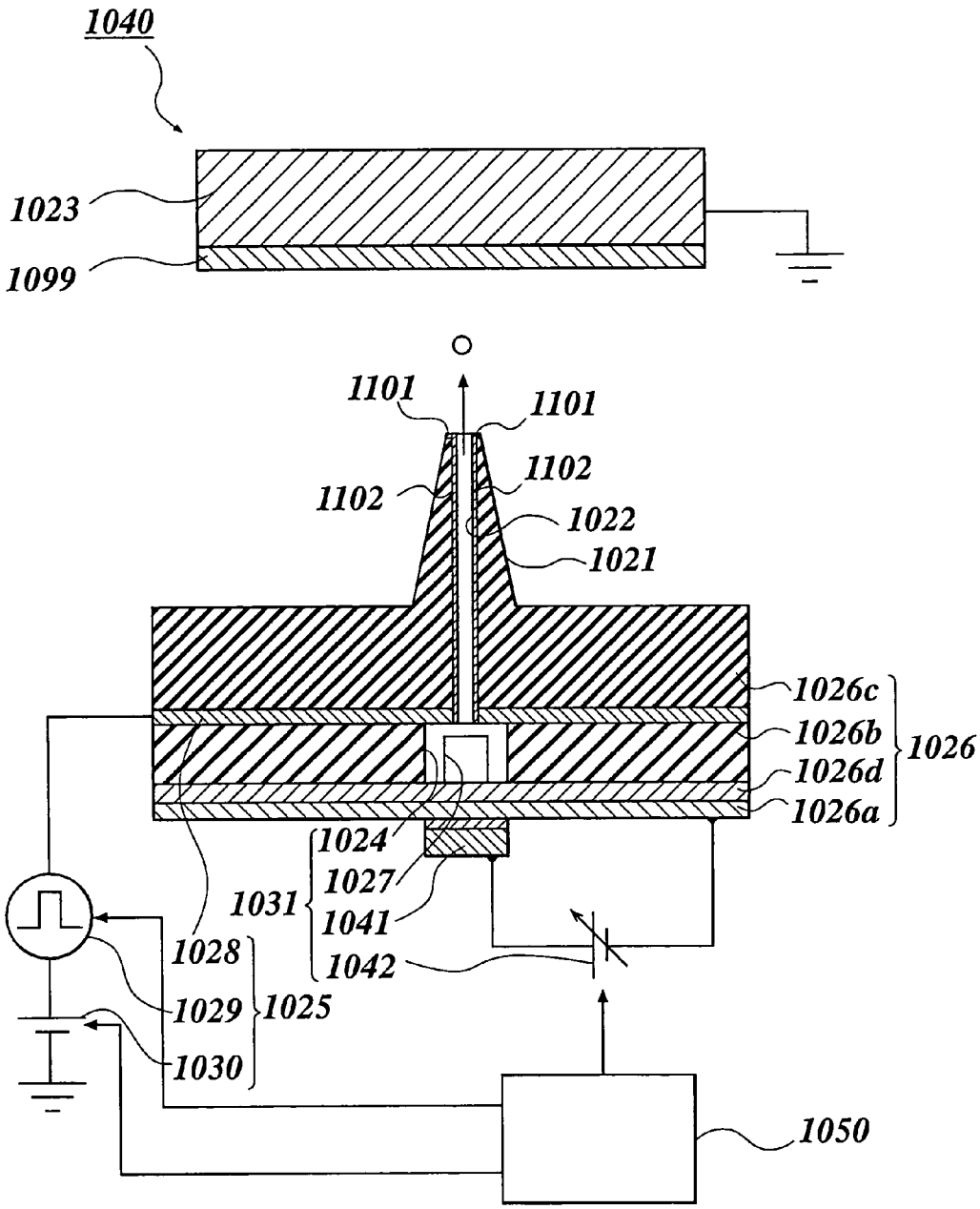
FIG. 29 is a view showing a liquid jetting apparatus 1040 in a third embodiment.
Figure 30A:
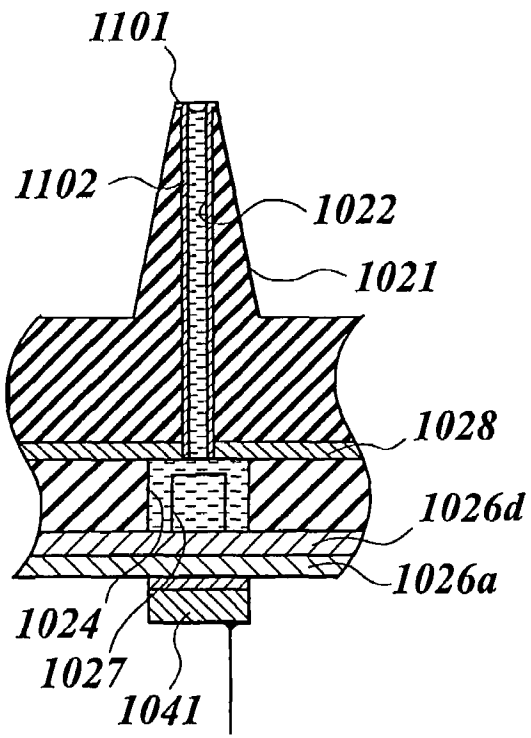
FIG. 30A is a view showing a state where liquid solution in an in-nozzle passage 1022 of the liquid jetting apparatus 1040 in the third embodiment forms reentrant meniscus at an edge portion of the nozzle 1021.
Figure 30B:
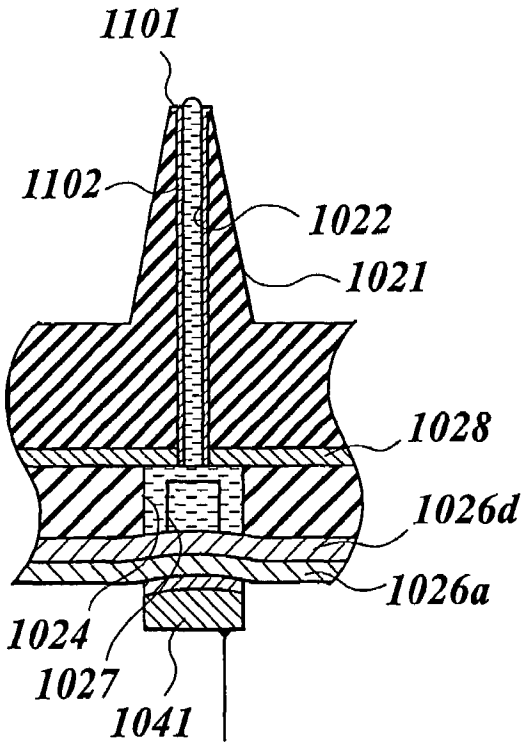
FIG. 30B is a view showing a state where the liquid solution in the in-nozzle passage 1022 of the liquid jetting apparatus 1040 in the third embodiment forms convex meniscus at the edge portion of the nozzle 1021.
Figure 30C:
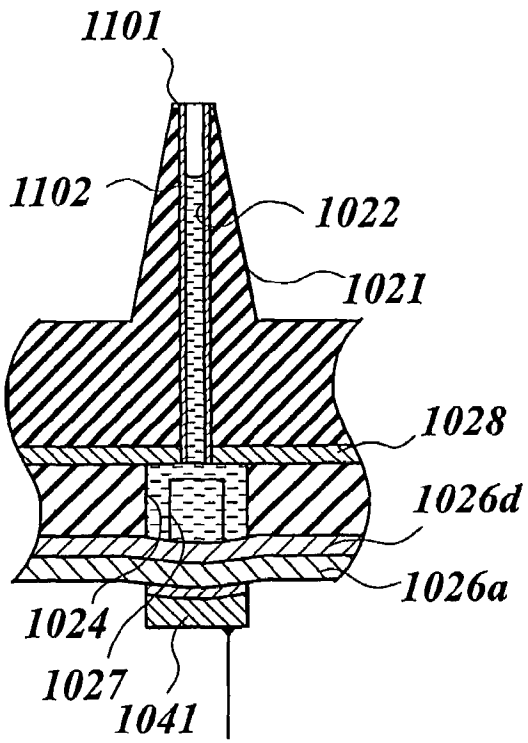
FIG. 30C is a view showing a state where a liquid level of the liquid solution in the in-nozzle passage 1022 of the liquid jetting apparatus in the third embodiment is drawn into as much as a predetermined distance.

FIG. 29 is a view showing a whole structure of a liquid jetting apparatus 1040 in the third embodiment to which the liquid jetting apparatus of the present invention is applied. In FIG. 29, a part of the liquid jetting apparatus 1040 is cut out along the nozzle 1021 to be shown. FIG. 30A is a view showing a state where liquid solution in an in-nozzle passage forms meniscus in a reentrant shape at an edge portion of the nozzle 1021. FIG. 30B is a view showing a state where the liquid solution in the in-nozzle passage 1022 forms meniscus in a convex shape at the edge portion of the nozzle 1021. FIG. 30C is a view showing a state where a liquid level of the liquid solution in the in-nozzle passage 1022 is drawn into as much as a predetermined distance. As shown in FIG. 29, FIG. 30A, FIG. 30B and FIG. 30C, in the liquid jetting apparatus 1040, an identical mark is added to a portion being identical to any portion of the liquid jetting apparatus 1020 in the second embodiment, and descriptions regarding the identical portion are omitted.

As shown in FIG. 29, a base layer 1026*a* located at the lowest layer of the nozzle plate 1026 is formed of a metal plate, and a highly-insulating resin is formed as a coating over the whole upper surface of this base layer 1026*a*, for forming an insulating layer 1026*b*.

As the liquid solution supplying section 1031, a piezo element 1041, and a driving voltage power source 1042 for applying a driving voltage for changing a shape of this piezo element 1041 are further provided. According to control by the operation control section 1050, the driving voltage power source 1042 outputs a driving voltage corresponding to a voltage value suitable for the piezo element 1041 to decrease the capacity of the liquid solution room 1024 so as to transfer from a state where the liquid solution in the in-nozzle passage 1022 forms meniscus in a reentrant shape (refer to FIG. 30A.) to a state where meniscus in a convex shape is formed (refer to FIG. 30B.). Further, according to the control by the operation control section 1050, the driving voltage power source 1042 outputs a voltage corresponding to a voltage value suitable for the piezo element 1041 to increase the capacity of the liquid solution room 1024 so as to transfer from a state where the liquid solution in the in-nozzle passage 1022 forms meniscus in a reentrant shape at the edge portion of the nozzle 1021 (refer to FIG. 30A.) to a state where the liquid level is drawn into as much as a predetermined distance (refer to FIG. 30C). In other words, by applying a predetermined voltage to the piezo element 1041 and by making the base layer 1026*a* dent in either inside or outside at a position of FIG. 29, internal capacity of the liquid solution room 1024 is decreased or increased, whereby, according to a change of the internal pressure, it is possible to form meniscus of the liquid solution in a convex shape at the edge portion of the nozzle 1021 or draw the liquid level into inside.

While it is on standby for jetting, according to control by the operation control section 1050, a predetermined voltage is applied to the piezo element 1041, and as shown in FIG. 30A and FIG. 30B, control is done so as to place the liquid level of the liquid solution within the nozzle.

In the second embodiment, by applying a varying voltage to the liquid solution in the nozzle while it is on standby for jetting so as to make the varying voltage smaller than the jetting start voltage $V_c$, an effect of preventing clogging is obtained. However, in the third embodiment, while it is on standby, by controlling a supplying pressure of the liquid solution by the liquid solution supplying section 1031 so as to locate the liquid level in the nozzle, clogging is prevented.

Further, a supplying pressure of the liquid solution may be controlled by the supplying pump of the liquid solution supplying section 1031 so as to locate the liquid level in the nozzle.

In accordance with the liquid jetting apparatus 1040 in the third embodiment, since the liquid level is within the nozzle, it is possible to prevent the liquid solution from adhering to the circumference of the nozzle 1021. Further, it is possible to prevent the liquid solution from being dried, and thereby it is possible to prevent the liquid solution from being fixed to the nozzle 1021. Therefore, it is possible to prevent clogging of the nozzle 1021.

FOURTH EMBODIMENT

A fourth embodiment to which the present invention is applied will be described with reference to FIG. 31 to FIG. 36.

Whole Structure of Liquid Jetting Apparatus

Figure 31:
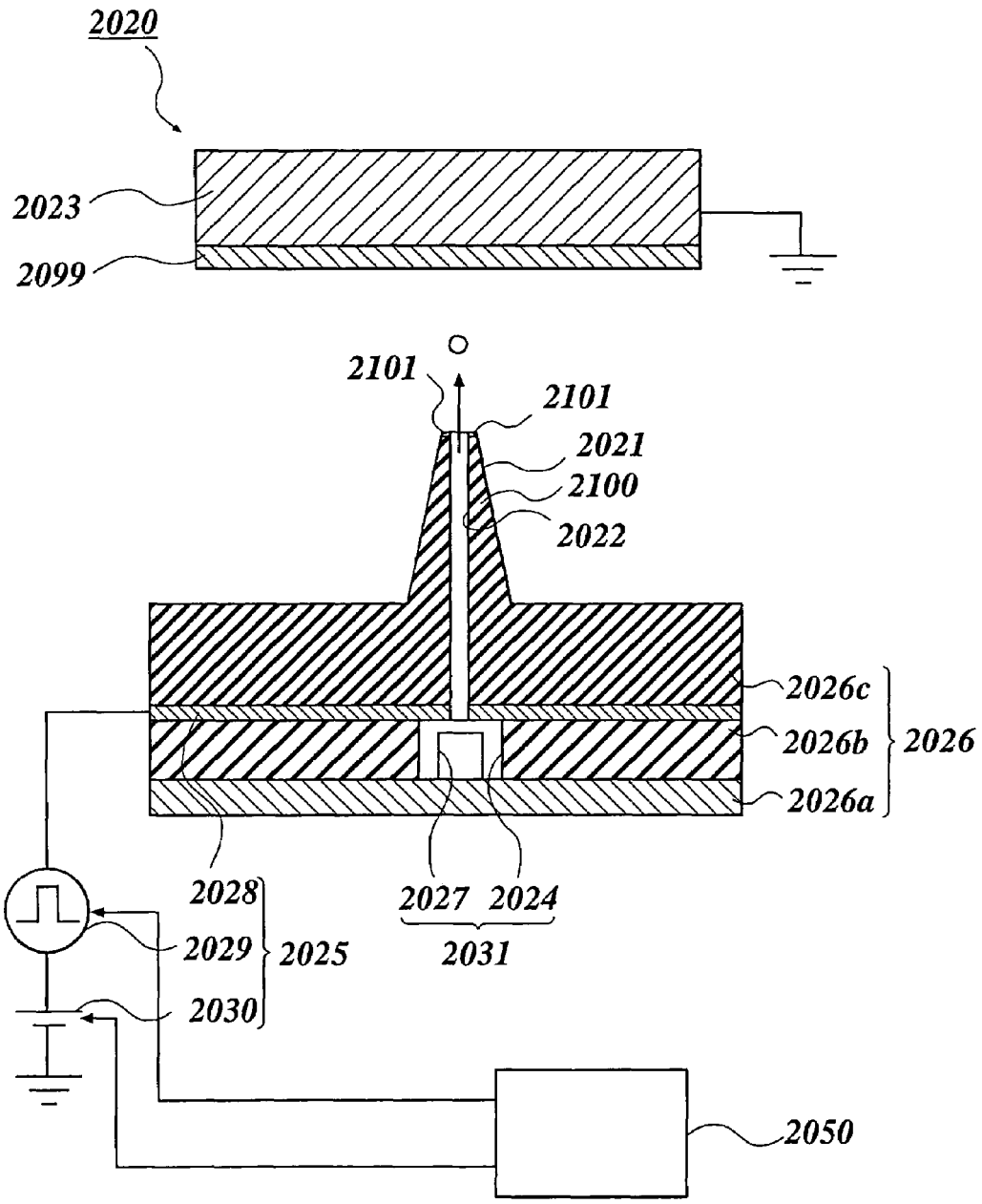
FIG. 31 is a view showing a liquid jetting apparatus in a fourth embodiment.

FIG. 31 is a view showing a whole structure of a liquid jetting apparatus 2020 in the fourth embodiment to which the liquid jetting apparatus of the present invention is applied. In FIG. 31, a part of the liquid jetting apparatus 2020 is cut out along a nozzle 2021 to be shown. First, the whole structure of the liquid jetting apparatus 3020 will be described with reference to FIG. 31.

This liquid jetting apparatus 2020 comprises the nozzle 2021 being a super minute diameter for jetting a droplet of chargeable liquid solution from its edge portion; a counter electrode 2023 having a facing surface facing to the edge portion of the nozzle 2021 and supporting a base member 2099 for receiving landing of the droplet at the facing surface; a liquid solution supplying section 2031 for supplying the liquid solution to a passage 2022 in the nozzle 2021; a jetting voltage applying section 2025 for applying a jetting voltage to the liquid solution in the nozzle 2021; and an operation control section 2050 for controlling the applying of the jetting voltage by the jetting voltage applying section 2025. In addition, the above-mentioned nozzle 2021, a partial structure of the liquid solution supplying section 2031 and a partial structure of the jetting voltage applying section 2025 are integrally formed by a nozzle plate 2026.

In addition, in FIG. 31, for the convenience of descriptions, the case that the edge portion of the nozzle 2021 faces upward and the counter electrode 2023 is provided above the nozzle 2021 is illustrated. However, practically, the apparatus is so structured that the nozzle 2021 faces in a horizontal direction or a lower direction than the horizontal direction, more preferably, the nozzle 2021 faces perpendicularly downward.

Liquid Solution

As an example of the liquid solution jetted by the above-mentioned liquid jetting apparatus 2020, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbitol, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large amount of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate.methacrylic acid copolymer, lauryl methacrylate.2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile. styrene copolymer, styrene.maleate copolymer, styrene. isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene. polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene.vinyl acetate copolymer, ethylene.ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semisynthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

When the liquid jetting apparatus 2020 is used as a patterning method, as a representative example, it is possible to use it for display use. Concretely, it is possible to cite formation of fluorescent material of plasma display, formation of rib of plasma display, formation of electrode of plasma display, formation of fluorescent material of CRT, formation of fluorescent material of FED (Field Emission type Display), formation of rib of FED, color filter for liquid crystal display (RGB coloring layer, black matrix layer), spacer for liquid crystal display (pattern corresponding to black matrix, dot pattern and the like). The rib mentioned here means a barrier in general, and with plasma display taken as an example, it is used for separating plasma areas of each color. For other uses, it is possible to apply it to microlens, patterning coating of magnetic material, ferrodielectric substance, conductive paste (wire, antenna) and the like for semiconductor use, as graphic use, normal printing, printing to special medium (film, fabric, steel plate), curved surface printing, lithographic plate of various printing plates, for processing use, coating of adhesive, sealer and the like using the present embodiment, for biotechnological, medical use, pharmaceuticals (such as one mixing a plurality of small amount of components), coating of sample for gene diagnosis or the like.

Nozzle

The above-mentioned nozzle 2021 is integrally formed with an upper surface layer 2026*c* of the nozzle plate 2026, which will be described later, and is provided to stand up perpendicularly with respect to a flat plate surface of the nozzle plate 2026. Further, at the time of jetting a droplet, the nozzle 2021 is so used as to perpendicularly face a receiving surface (surface where the droplet lands) of the base member 2099. Further, in the nozzle 2021, an in-nozzle passage 2022 penetrating from its edge portion along the nozzle center is formed. The in-nozzle passage 2022 is opened at an edge of the nozzle 2021, and thereby a jet opening is formed at the edge of the nozzle 2021.

The nozzle 2021 will be described in more detail. In the nozzle 2021, an opening diameter at its edge portion and the in-nozzle passage 1022 are uniform, and as mentioned, these are formed as a super minute diameter. A diameter of the jet opening formed at the nozzle 2021 (that is, an inside diameter of the nozzle 2021) is not more than 30 μm, more preferably less than 20 μm, even more preferably not more than 10 μm, even more preferably not more than 8 μm, even more preferably not more than 4 μm. As one concrete example of dimensions of each part, an inside diameter of the in-nozzle passage 2022 is set to 1[μm], an outside diameter of the edge portion of the nozzle 2021 is set to 2[μm], a diameter of the root of the nozzle 2021 is 5[μm], and a height of the nozzle 2021 is set to 100[μm], and its shape is formed as a truncated conic shape being unlimitedly close to a conic shape. In addition, the height of the nozzle 2021 may be 0[μm].

In addition, a shape of the in-nozzle passage 2022 may not be formed linearly with constant inside diameter as shown in FIG. 31. For example, as shown in FIG. 15A, it may be so formed as to give roundness to a cross-section shape at the edge portion of the side of a liquid solution room 2024, which will be described later, of the in-nozzle passage 2022. Further, as shown in FIG. 15B, an inside diameter at the edge portion of the side of the liquid solution room 2024, which will be described later, of the in-nozzle passage 2022 may be set to be larger than an inside diameter of the edge portion at the jetting side, and an inside surface of the in-nozzle passage 2022 may be formed in a tapered circumferential surface shape. Further, as shown in FIG. 15C, only the edge portion at the side of the liquid solution room 2024, which will be describe later, of the in-nozzle passage 2022 may be formed in a tapered circumferential surface shape and the jetting edge portion side with respect to the tapered circumferential surface may be formed linearly as a constant inside diameter.

Liquid Solution Supplying Section

The liquid supplying section 2031 is provided at a position being inside of the nozzle plate 2026 and at the root of the nozzle 2021, and comprises the liquid solution room 2024 communicated to the in-nozzle passage 2022; a supplying passage 2027 for guiding the liquid solution from an external liquid solution tank, of which illustration is omitted, to the liquid solution room 2024; and a supplying pump for giving a supplying pressure of the liquid to the liquid solution room 2024.

Figure 32A:
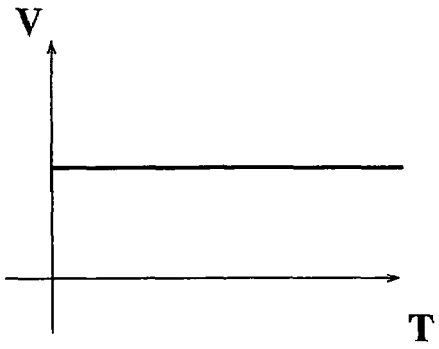
FIG. 32A is a graph showing a relation between time and a voltage applied to the liquid solution in a case of not jetting.

The above-mentioned supplying pump supplies the liquid solution to the edge portion of the nozzle 2021, and supplies the liquid solution while maintaining the supplying pressure within a not-dripping range (refer to FIG. 32A.).

Further, the supplying pump may be structured, including a case of using a pressure difference according to arrangement positions of the liquid solution tank and the nozzle 2021, by only a liquid solution supplying passage without providing a liquid solution supplying section separately.

Jetting Voltage Applying Section

The jetting voltage applying section 2025 comprises a jetting electrode 2028 for applying a jetting voltage, the jetting electrode 2028 being provided inside of the nozzle plate 2026 and at a border position between the liquid solution room 2024 and the in-nozzle passage 2022; a bias power source 2030 for constantly applying a direct current bias voltage to this jetting electrode 2028; and a jetting voltage power source 2029 for applying a pulse voltage to the jetting electrode 2028 with the bias voltage superimposed, to be an electric potential for jetting.

The above-mentioned jetting electrode 2028 is directly contacted to the liquid solution in the liquid solution room 2024, for charging the liquid solution and applying the jetting voltage.

In regard to the bias voltage by the bias power source 2030, by always applying a voltage within a range within which jetting of the liquid solution is not performed, width of a voltage to be applied at jetting is preliminarily reduced, herewith responsiveness at jetting is improved.

The jetting voltage power source 2029 is controlled by the operation control section 2050, and superimposes the pulse voltage to the bias voltage to be applied only when jetting of the liquid solution is performed. A value of the pulse voltage is set so that a superimposed voltage V at this time satisfies a condition of the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\epsilon_0$: electric constant [F/m], d: nozzle diameter [m], h: distance between nozzle and base member [m], k: proportionality constant dependent on nozzle shape (1.5<k<8.5).

As one example, the bias voltage is applied at DC300[V], and the pulse voltage is applied at 100[V]. Therefore, the superimposed voltage at jetting will be 400[V].

Nozzle Plate

The nozzle plate 2026 comprises a base layer 2026*a* placed at the lowest layer in FIG. 31; a passage layer 2026*b* placed on top thereof, the passage layer 2026*b* forming a supplying passage of the liquid solution; and an upper surface layer 2026*c* formed further on top of this passage layer 2026*b*. The above-mentioned jetting electrode 2028 is inserted between the passage layer 2026*b* and the upper surface layer 2026*c*.

The above-mentioned base layer 2026*a* is formed of a silicon base plate, highly-insulating resin or ceramic, and a dissolvable resin layer is formed on top thereof and it is eliminated except for a part corresponding to a predetermined pattern for forming the supplying passage 2027 and the liquid solution room 2024, and the insulating resin layer is formed at the eliminated part. This insulating resin layer becomes the passage layer 2026*b*. Then, the jetting electrode 2028 is formed on an upper surface of this insulating resin layer with an electroless plating of a conductive element (for example, NiP), and a resist resin layer having insulating properties is formed further on top thereof. Since this resist resin layer becomes the upper surface layer 2026*c*, this resin layer is formed with thickness in consideration of a height of the nozzle 2021. Then, this insulating resist resin layer is exposed according to an electron beam method or femtosecond laser, for forming a nozzle shape. The in-nozzle passage 2022 is also formed according to a laser processing. Then, the dissolvable resin layer corresponding to the pattern of the supplying passage 2027 and the liquid solution room 2024 is eliminated, these supplying passage 2027 and the liquid solution room 2024 are communicated, and the production of the nozzle plate is completed.

In addition, material of the upper surface layer 2026*c* and the nozzle 2021 may be, concretely, semiconductor such as Si or the like, conductive material such as Ni, SUS or the like, other than insulating material such as epoxy, PMMA, phenol, soda glass.

Figure 33A:
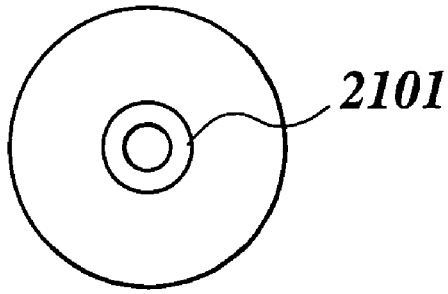
FIG. 33A is a plan view showing the nozzle 2021 of the liquid jetting apparatus 2020 in a fourth embodiment, seen from a jet opening side.
Figure 33B:
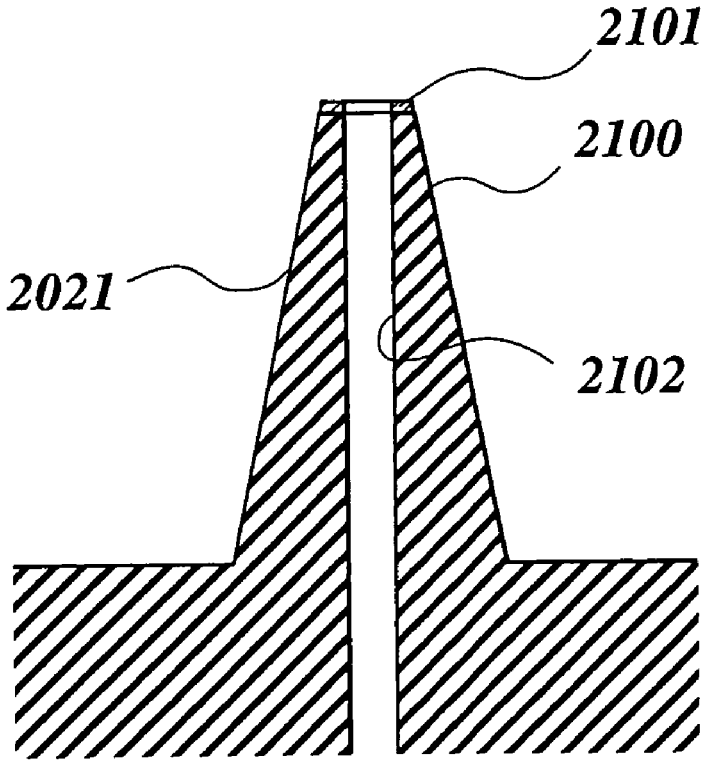
FIG. 33B is a cross-sectional view showing the nozzle 2021 of the liquid jetting apparatus 2020 in the fourth embodiment.

After an electroless Ni—P processing is applied on a nozzle base member formed from the resist resin layer, with the eutectoid of fluorinated pitch, a coating having water repellency higher than the nozzle base member is formed. FIG. 33B is a vertical cross-sectional view of the nozzle 2021. As shown in FIG. 33A and FIG. 33B, a jet opening is formed at the edge portion of the nozzle 2021. On the edge surface of the nozzle 2021 surrounding the jet opening, a water repellent coating 2101 is formed. The water repellent coating 2101 is formed in a ring shape surrounding the jet opening. Since an inside surface 2102 of the nozzle is formed by exposing a nozzle base member 2100 as-is, the water repellent coating 2101 has higher water repellency than the inside surface 2102 of the nozzle 2021. The inside surface of the nozzle 2021 is a wall surface of the in-nozzle passage 2022.

Further, product name Cytop (registered mark) manufactured by Asahi Glass Co., Ltd., or the like may be coated for forming the water repellent coating, or after the electroless Ni—P processing on the nozzle base member, according to Metaflon NF plating, manufactured by C. Uemura & Co., Ltd., PTFE particles may be made eutectoid into a plating coat for forming the water repellent coating. Further, electrocoating of cationic or anionic fluorine-containing resin; coating of fluorinated high polymer, silicon resins and polydimethylsiloxane; sintering; eutectoid plating method of fluorinated high polymer; evaporation method of amorphous alloy membrane; making a coat such as organic silicon compound, fluorine-containing silicon compound or the like centering on polydimethylsiloxanes formed by plasma-polymerizing hexamethylsiloxiane as monomer according to a plasma CVD method, are available.

Control of water repellency of the nozzle 2021 can be managed by selecting a processing method corresponding to liquid solution. It is preferable to select the liquid solution and the water repellent processing method so as to set a contact angle between the liquid solution and material of the circumference of the jet opening of the nozzle 2021 to not less than 45 degree. Thereby, it is possible to provide a state where the liquid solution does not easily spread to the circumference of the jet opening of the nozzle 2021, and it is possible to increase a curvature of the convex meniscus to even higher level at the edge portion of the nozzle 2021. As the result, it is possible to make a droplet minute. Further, since it is possible to form meniscus having a minute diameter, an electric field is easily concentrated to the top of the meniscus, and therefore it is possible to make the jetting voltage become a low voltage. Further, preferably the liquid solution wets with the material of the nozzle 2021 having the edge portion at which the jet opening is formed by a contact angle of not less than 90 degree, and more preferably it wets by a contact angle of not less than 130 degree.

Further, without forming a water repellent coating on a surface of the nozzle 2021, by forming the nozzle 2021 from a fluorine-containing photosensitive resin, it is also possible to obtain a similar effect. The fluorine-containing photosensitive resin is, one in which from a few percent to a few dozen percent of Cytop, manufactured by Asahi Glass Co., Ltd, which is formed by fluororesin is dissolved into PTFE dispersion, FEP dispersion or perfluoro solvent having mean particle diameter of approximately 0.2 μm, is dispersed and mixed to ultraviolet-sensitive resin, and in the dispersion, FEP having lower melting point is preferable. Further, in the dispersion, MDF FEP 120-J (54 wt %, water-dispersion) manufactured by DuPont Co., Ltd, Fluon×AD911 (60 wt %, water-dispersion) manufactured by Asahi Glass Co., Ltd, or the like is applicable. Further, polymer for resist for F2-lithography is also fluorine-containing photosensitive resin, such as one in which fluorine is induced to polymer main chain, and one in which fluorine is induced to side chain.

Counter Electrode

As shown in FIG. 31, the counter electrode 2023 comprises a facing surface perpendicular to a protruding direction of the nozzle 2021, and supports the base member 2099 along the facing surface. A distance from the edge portion of the nozzle 2021 to the facing surface of the counter electrode 2023 is, as one example, set to 100[μm]

Further, since this counter electrode 2023 is grounded, it always maintains a grounded potential. Therefore, at the time of applying the pulse voltage, a droplet jetted by an electrostatic force by an electric field generated between the edge portion of the nozzle 2021 and the facing surface is guided to a side of the counter electrode 2023.

In addition, since the liquid jetting apparatus 2020 jets a droplet by enhancing electric field intensity by electric field concentration at the edge portion of the nozzle 2021 according to super-miniaturization of the nozzle 2021, it is possible to jet the droplet without the guiding by the counter electrode 1023. However, the guiding by an electrostatic force between the nozzle 2021 and the counter electrode 2023 is preferably performed. Further, it is possible to let out the electric charge of a charged droplet by grounding the counter electrode 2023.

Operation Control Section

The operation control section 2050 is in practice structured from a calculation device including a CPU, a ROM, a RAM and the like. The above-mentioned operation control section 2050 makes the bias power source 2030 apply a voltage continuously, and makes the jetting voltage power source 2029 apply a driving pulse voltage when receiving an input of a jetting instruction from outside.

Jetting Operation of Minute Droplet by Liquid Jetting Apparatus

An operation of the liquid jetting apparatus 2020 will be described with reference to FIG. 31 and FIG. 32.

Figure 32B:
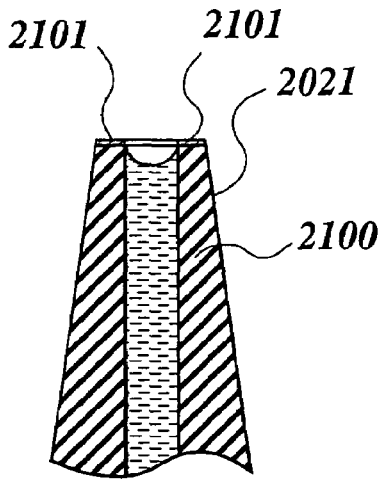
FIG. 32B is a cross-sectional view showing a state of a nozzle 2021 in the case of not jetting.
Figure 32C:
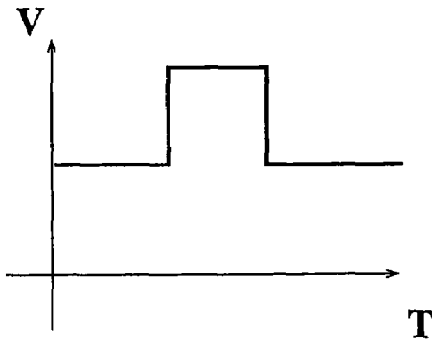
FIG. 32C is a graph showing a relation between time and a voltage applied to the liquid solution in a case of jetting.
Figure 32D:
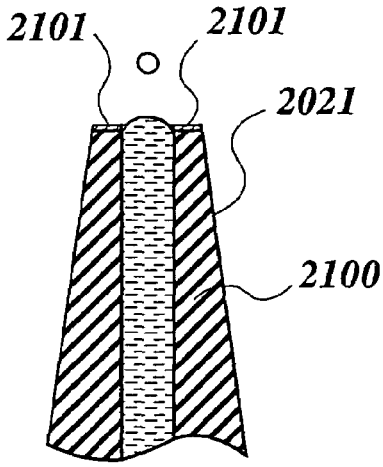
FIG. 32D is a cross-sectional view showing a state of the nozzle 2021 in the case of jetting.

Here, FIG. 32A is a graph showing a relation between time (horizontal axis) and a voltage applied to the liquid solution (vertical axis) in a case of not jetting, FIG. 32B is a vertical cross-sectional view showing a state of the nozzle 2021 in the case of not jetting, FIG. 32C is a graph showing a relation between time (horizontal axis) and a voltage applied to the liquid solution (vertical axis) in a case of jetting, and FIG. 32D is a vertical cross-sectional view showing a state of the nozzle 2021 in the case of jetting.

In a state where chargeable liquid solution is supplied to the in-nozzle passage 2022 by the liquid solution supplying section 2031, and in such a state, the bias voltage is applied to the liquid solution via the jetting electrode 2028 by the bias power source 1030 (refer to FIG. 32A.). In such a state, the liquid solution is charged, and meniscus which dents in a reentrant form by the liquid solution is formed at an edge portion of each nozzle 2021 (refer to FIG. 32B.).

Then, a jetting instruction signal is inputted to the operation control section 2050, and when the jetting voltage power source 2029 applies the pulse voltage (refer to FIG. 32C.), the liquid solution is guided to the edge portion side of the nozzle 2021 by an electrostatic force according to electric field intensity of a concentrated electric field at the edge portion of the nozzle 2021, and convex meniscus protruding to outside is formed, and an electric field is concentrated at the top of the convex meniscus, and after all a minute droplet is jetted to the counter electrode side against a surface tension of the liquid solution (refer to FIG. 32D).

Since the above-mentioned liquid jetting apparatus 2020 performs jetting of a droplet by the nozzle 2021 having a minute diameter, which was not available conventionally, an electric field is concentrated by the liquid solution in a state of being charged in the in-nozzle passage 2022, and thereby electric field intensity is enhanced. Accordingly, the jetting of the liquid solution by a nozzle having a minute diameter (for example, an inside diameter of 100[μm], which was conventionally regarded as substantially impossible since a voltage necessary for jetting would become too high with a nozzle having a structure with which concentration of an electric field is not performed, is now possible with a lower voltage than the conventional one.

Then, since it is a minute diameter, current of the liquid solution in the in-nozzle passage 2022 is limited due to low nozzle conductance. Therefore, it is possible to easily do the control to reduce the jetting current amount per unit time, and the jetting of the liquid solution with a sufficiently-small droplet diameter (0.8[μm] according to each of the above-mentioned conditions) without narrowing a pulse width is realized.

Further, since the jetted droplet is charged, a vapor pressure is reduced even with a minute droplet and evaporation is suppressed. Therefore, the loss of droplet mass is reduced, the flying stabilization is given, and the decrease of landing accuracy of a droplet is prevented.

Figure 34A:
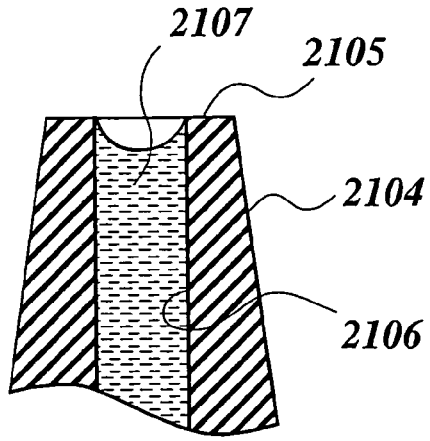
FIG. 34A is a cross-sectional view showing a state where reentrant meniscus is formed at an edge of a nozzle 2104 in a case of not providing a water repellent coating, as a comparison example to the liquid jetting apparatus 2021 in the fourth embodiment.
Figure 34B:
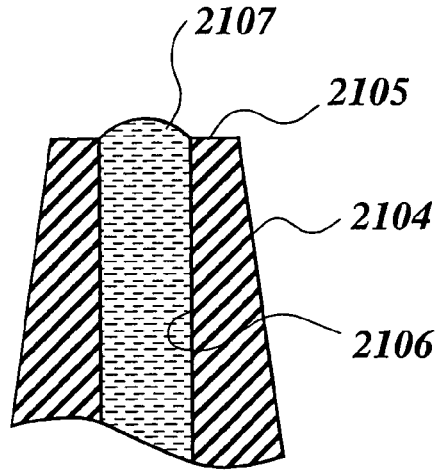
FIG. 34B is a cross-sectional view showing a state where convex meniscus is formed after the reentrant meniscus is formed at the edge of the nozzle 2104.
Figure 34C:
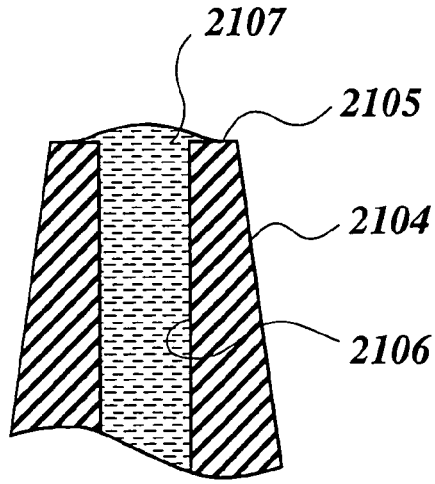
FIG. 34C is a cross-sectional view showing a state where the liquid solution spreads at the nozzle 2104 after the convex meniscus is formed at the edge of the nozzle 2104.

FIG. 34A, FIG. 34B and FIG. 34C are vertical cross-sectional views of the nozzle 2104 in a case of not providing a water repellent coating, as a comparison example of the liquid jetting apparatus 2020 in the present embodiment. Processes of forming convex meniscus at the nozzle edge are shown in the order of FIG. 34A, FIG. 34B and FIG. 34C. In FIG. 34A, FIG. 34B and FIG. 34C, water repellency of the edge surface 2105 of the nozzle 2104 and water repellency of the inside surface 2106 of the nozzle 2104 are equal. When the liquid solution 2107 moves to the jet opening, meniscus denting in a reentrant shape as shown in FIG. 34A becomes meniscus in a convex shape as shown in FIG. 34B, and therefore the curvature becomes larger. However, since water repellency of the edge surface 2105 of the nozzle 2104 and water repellency of the inside surface 2106 of the nozzle 2104 are equal and the liquid solution easily wets and spreads from the jet opening of the nozzle 2104, the limit of the curvature for forming meniscus with nozzle diameter as diameter thereof is small. Accordingly, as shown in FIG. 34C, before the curvature of the meniscus becomes large, the liquid solution 2107 wets and spreads from the jet opening of the nozzle 2104, and therefore it is difficult to jet a minute droplet.

Figure 35A:
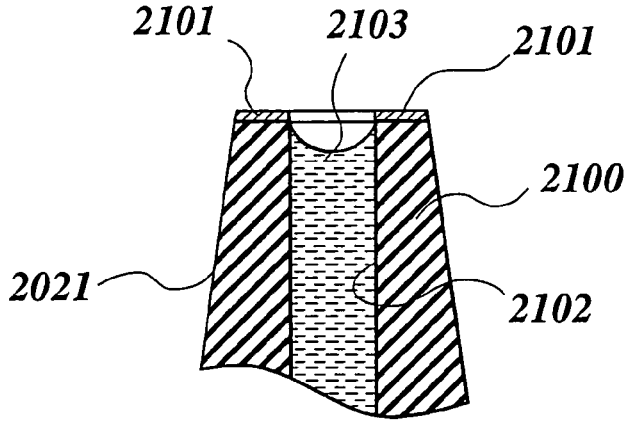
FIG. 35A is a cross-sectional view showing a state where reentrant meniscus is formed at an edge of the nozzle 2021 of the liquid jetting apparatus 2020 in the fourth embodiment.
Figure 35B:
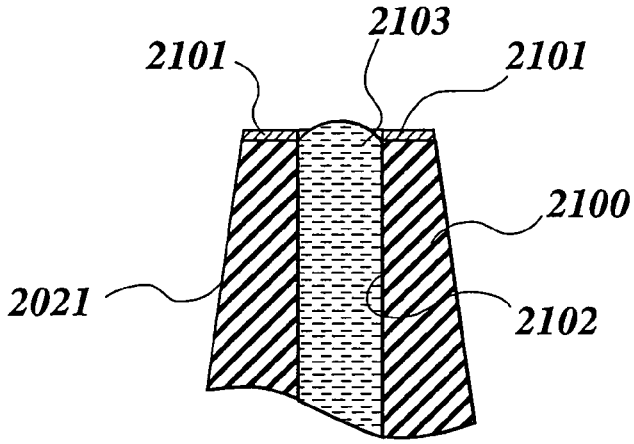
FIG. 35B is a cross-sectional view showing a state where convex meniscus is formed after the reentrant meniscus is formed at the edge of the nozzle 2021.
Figure 35C:
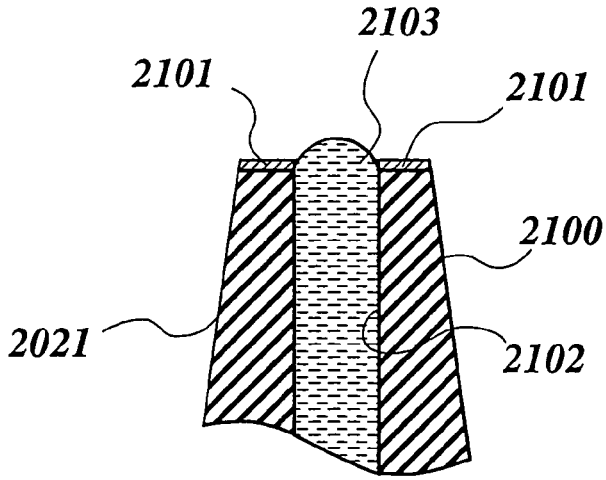
FIG. 35C is a cross-sectional view showing a state where a curvature of the meniscus becomes larger after the convex meniscus is formed at the edge of the nozzle 2021.

FIG. 35A, FIG. 35B and FIG. 35C are vertical cross-sectional views of the nozzle 2021 of the liquid jetting apparatus 2020 in the present embodiment. Processes of forming convex meniscus at the nozzle edge of the liquid jetting apparatus 2020 in the present embodiment are shown in the order of FIG. 34A, FIG. 34B and FIG. 34C. At the edge surface of the nozzle 2021, a water repellent coating 2101 is formed. Since the water repellent coating 2101 formed at the edge surface of the nozzle has higher water repellency than that of the inside surface 2102 of the nozzle 2021, the liquid solution 2103 does not easily adheres to the nozzle edge surface, and therefore the liquid solution 2103 does not wet and spread from the jet opening of the nozzle 2021. When the liquid solution moves to the jet opening, meniscus denting in a reentrant shape as shown in FIG. 35A becomes meniscus in convex meniscus shown in FIG. 35B, and the curvature becomes larger. As shown in FIG. 35C, compared to the case shown in FIG. 34 of not providing a water repellent coating, it is possible to increase a curvature of the meniscus at even higher level. Therefore, an electric field is concentrated with even higher concentration according to the top of the meniscus, for jetting a droplet. Therefore, as the present embodiment, forming a coating having higher water repellency than that of the nozzle material 2100 at the edge surface of the nozzle 2021 is effective for making a droplet minute.

Further, since it is possible to form meniscus having a minute diameter, an electric field is easily concentrated to the top of the meniscus, and therefore it is possible to make the jetting voltage become a low voltage.

Figure 36A:
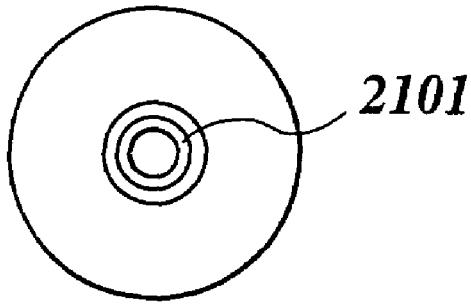
FIG. 36A is a plan view showing another nozzle 2021 from a jet opening side.
Figure 36B:
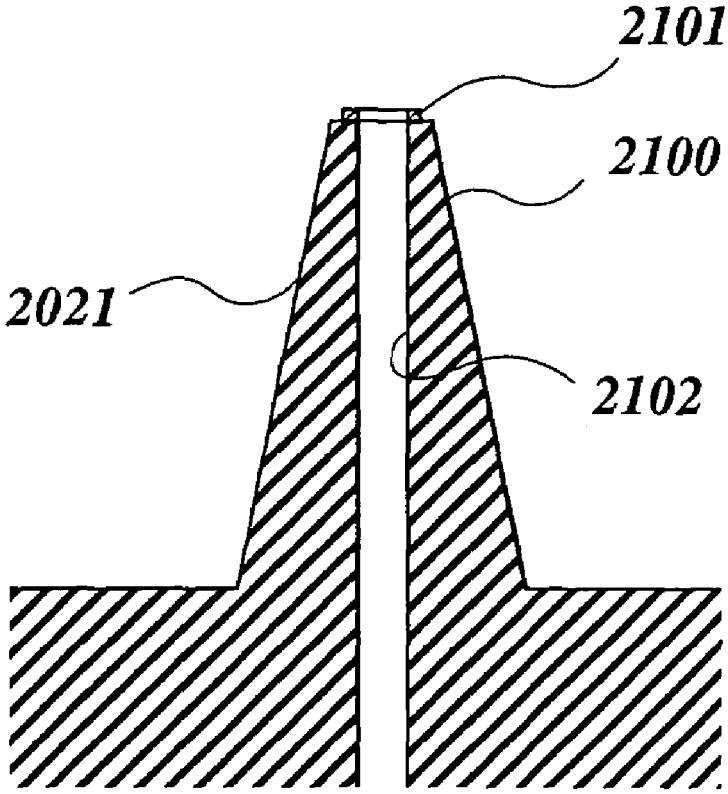
FIG. 36B is a cross-sectional view showing another nozzle 2021.

FIG. 36A and FIG. 36A show a nozzle 2021 which is different from the nozzle 2021 shown in FIG. 33A and FIG. 33B. The nozzle shown in FIG. 36A and FIG. 36B can be used as the nozzle 2021 of the liquid jetting apparatus 2020 shown in FIG. 31. FIG. 36A is a plan view showing the nozzle 2021 seen from a jet opening side. FIG. 36B is a cross-sectional view showing the nozzle 2021. In the nozzle 2021 shown in FIG. 33A and FIG. 33B, the coating 2101 having higher water repellency than that of the nozzle material 2100 is formed over the whole edge surface of the nozzle 2021 at which the jet opening of the nozzle 2021 opens. In the nozzle 2021 shown in FIG. 36A and FIG. 33B, the water repellent coating 2101 having higher water repellency than that of the nozzle material 2100 may be formed at only an inside portion of the edge surface of the nozzle 2021.

In any case, for making a jetted droplet minute, preferably the inside diameter of the coating in a ring shape surrounding the jet opening is equal to the inside diameter of the nozzle 2021.

Further, continuing from the water repellent coating formed at the edge surface of the nozzle 2021, a water repellent coating may also be formed at the periphery surface of the nozzle 2021.

Here, in order to obtain the electrowetting (Electrowetting) effect to the nozzle 2021, an electrode may be provided at the periphery of the nozzle 2021, or an electrode may be provided at the inside surface of the in-nozzle passage 2022 and a dielectric coating covers on top thereof. Then, by applying a voltage to this electrode, with respect to the liquid solution to which the jetting electrode 2028 applies the voltage, it is possible to enhance wettability of the inside surface of the in-nozzle passage according to the electrowetting effect, it is possible to smoothly supply the liquid solution to the in-nozzle passage 2022. Accordingly, it is possible to perform the jetting suitably, and to improve responsiveness of the jetting.

Further, the jetting voltage applying section 2025 constantly applies the bias voltage and jets a droplet by using the pulse voltage as a trigger. However, it is possible to have a structure where jetting is performed by always applying alternate current with amplitude necessary for jetting or continuous rectangular wave and by changing its frequency high or low. It is essential to charge the liquid solution for jetting a droplet, and when the jetting voltage is applied at frequency exceeding a speed at which the liquid solution is charged, the jetting is not performed, while the jetting is performed when it is switched to a frequency at which it is possible to charge the liquid solution sufficiently. Therefore, by doing the control to apply the jetting voltage at a frequency larger than a frequency at which it is possible to jet when jetting is not performed, and to reduce the frequency to frequency band where it is possible to jet only when the jetting is performed, it is possible to control the jetting of the liquid solution. In such a case, since an electric potential to be applied to the liquid solution does not have a change itself, it is possible to improve time responsiveness even more, and thereby it is possible to improve landing accuracy of a droplet.

FIFTH EMBODIMENT

Figure 37:
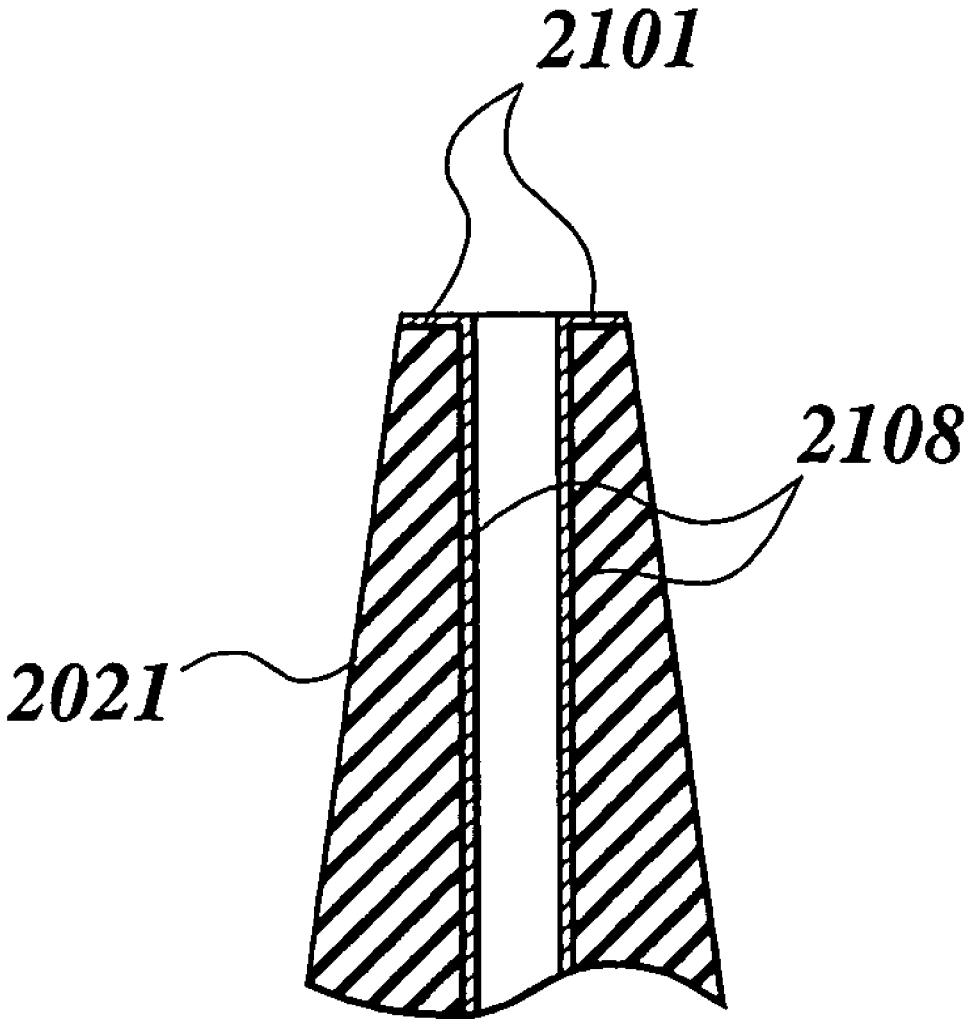
FIG. 37 is a cross-sectional view showing the nozzle 2021 of a liquid jetting apparatus in a fifth embodiment.

With reference to FIG. 37, a fifth embodiment to which the present invention is applied will be described.

FIG. 37 is a vertical cross-sectional view of a nozzle 2021 in a liquid jetting apparatus in the fifth embodiment to which the liquid jetting apparatus of the present invention is applied. The liquid jetting apparatus in the fifth embodiment comprises, instead of the nozzle 2021 shown in FIG. 33A and FIG. 33B, the nozzle 2021 shown in FIG. 37. In regard to a part of the liquid jetting apparatus in the fifth embodiment which is identical to any part of the liquid jetting apparatus 2020 in the fourth embodiment, descriptions are omitted.

In the fourth embodiment, as shown in FIG. 33B, a water repellent coating 2101 formed in a ring shape surrounding the jet opening is formed on the edge surface of the nozzle 2021 at which the jet opening of the nozzle 2021 opens, and further, a water repellent coating 2108 is formed at an inside surface of the nozzle 2021.

FIG. 38 shows a condition and a result of an experiment for comparing an effect of a water repellent coating processing at the nozzle. As shown in FIG. 38, cases are divided into: one of not forming a water repellent coating at the nozzle 2021; one of forming the water repellent coating 2101 at the circumference surface of the jet opening of the nozzle 2021 (water repellent coating area 1); and one of forming water repellent coatings 2101 and 2108 at the circumference surface of the jet opening of the nozzle 2021 and at an inside surface of the nozzle (water repellent coating area 2), and regarding the cases of forming a water repellent coating, a contact angle θ between test ink liquid and the circumferential material of the jet opening of the nozzle 2021 is changed by adjusting wettability of the test ink liquid according to a type of activator and loadings, and under conditions 1 to 9, an experiment regarding a minimum jetting voltage and responsiveness is performed.

As the test ink liquid, one having a viscosity of 8[cP], a resistivity of $10^8$[Ωcm], and a surface tension 30[mN/m] was used. As a water repellent processing to the nozzle 2021, a coating such as fluorine-containing silicon compounds of polydimethylsiloxanes or the like formed by plasma-polymerizing hexamethyldisiloxane as monomer according to a plasma CVD method was fixed as much as a few dozen [nm] to a glass capillary nozzle having inside diameter of 1[μm] and outside diameter of 2[μm]. An injection condition was to inject to an Si base plate at gap: 200[μm]. A minimum jetting voltage was set to a voltage at which the jetting of a droplet starts, and evaluation of responsiveness was done by subjectively evaluating clearness of its shape and evenness, and the evaluation was done at 5 degrees of, 5: extremely good, 4: good, 3: normal, 2: a little bad, and 1: bad.

As shown in FIG. 38, as a contact angle θ between the test ink liquid and the circumferential material of the jet opening of the nozzle 2021 becomes larger, the minimum jetting voltage becomes lower, and responsiveness results even better. The contact angle θ is preferably $45° \leqq \theta \leqq 180°$, and more preferably $130° \leqq \theta \leqq 180°$. Further, the case of forming a water repellent coating at the water repellent coating area 2 has lower minimum jetting voltage than the case of forming a water repellent coating at the water repellent coating area 1, and also has better responsiveness in the evaluation result.

As shown in the experimental result, as the contact angle θ becomes larger, since the test ink liquid less easily wets and spreads to the circumference of the jet opening of the nozzle 2021, it is possible to increase a curvature of the convex meniscus at even higher level at the nozzle edge portion, and therefore it is possible to concentrate an electric field at the top of the meniscus with even higher concentration. Accordingly, it is possible to make a droplet minute, and it is possible to make the jetting voltage become a low voltage.

Further, in the case of forming the water repellent coating 2108 at the inside surface of the nozzle 2021 in addition to the circumference surface of the jet opening of the nozzle 2021, since the test ink liquid less easily wets and spreads in the nozzle, it is possible to make the jetting voltage become an even lower voltage. Further, since it is possible to suppress the liquid solution from adhering to the inside surface of the nozzle 2021, it is possible to prevent clogging of the nozzle 2021.

SIXTH EMBODIMENT

A sixth embodiment too which the present invention is applied will be described with reference to FIG. 39 to FIG. 41.

Whole Structure of Liquid Jetting Apparatus

Figure 39:
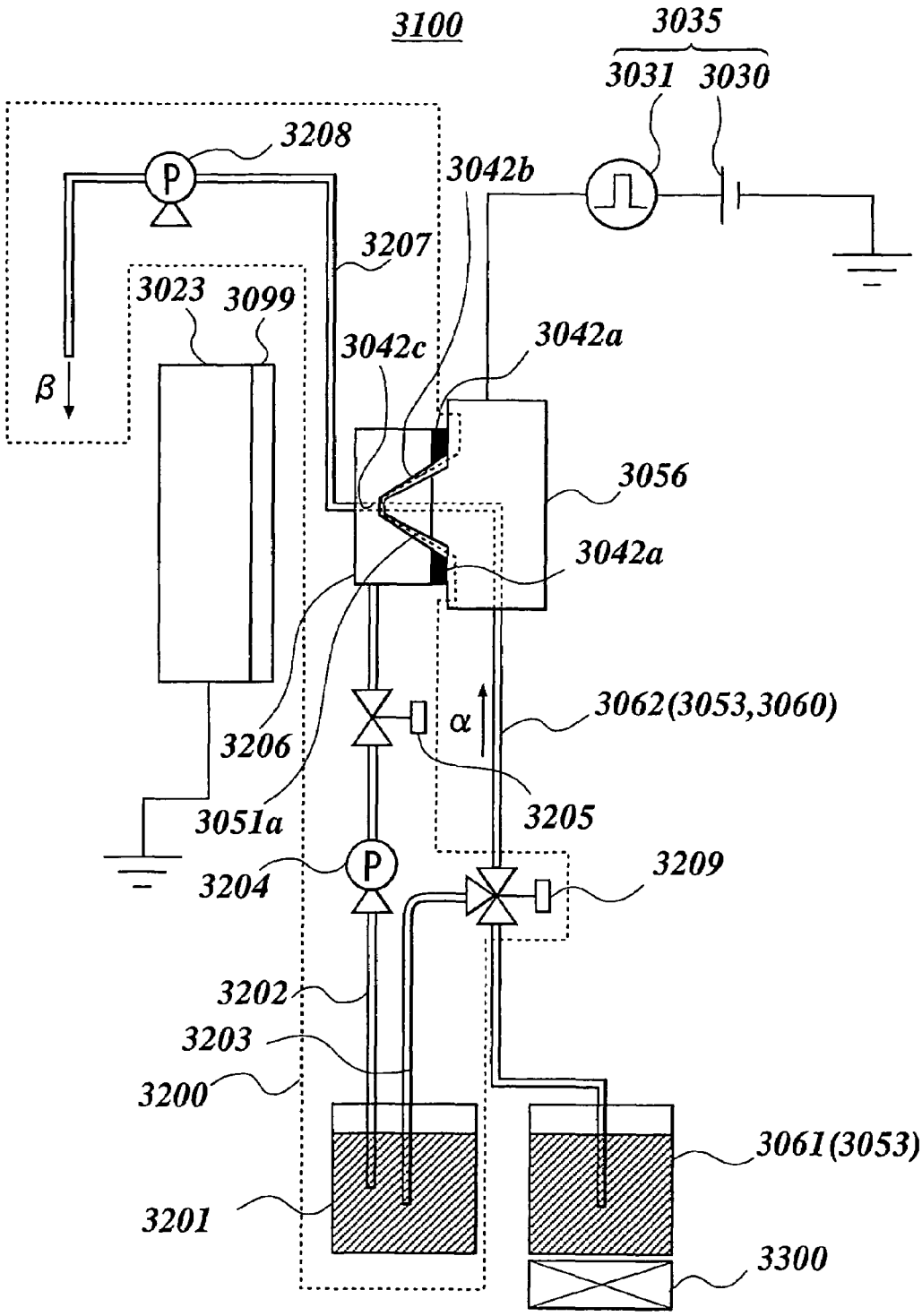
FIG. 39 is a block diagram showing a liquid jetting apparatus 3100 in a sixth embodiment.

FIG. 39 shows a whole structure of a liquid jetting apparatus 3100 in the sixth embodiment. FIG. 40 shows a structure directly relating to a jetting operation of the liquid jetting apparatus 3100. In FIG. 40, a state where a part of the liquid jetting apparatus 3100 is cut out along a nozzle 3051 is shown. First, the whole structure of the liquid jetting apparatus 3020 will be described with reference to FIG. 39 and FIG. 40.

Figure 40:
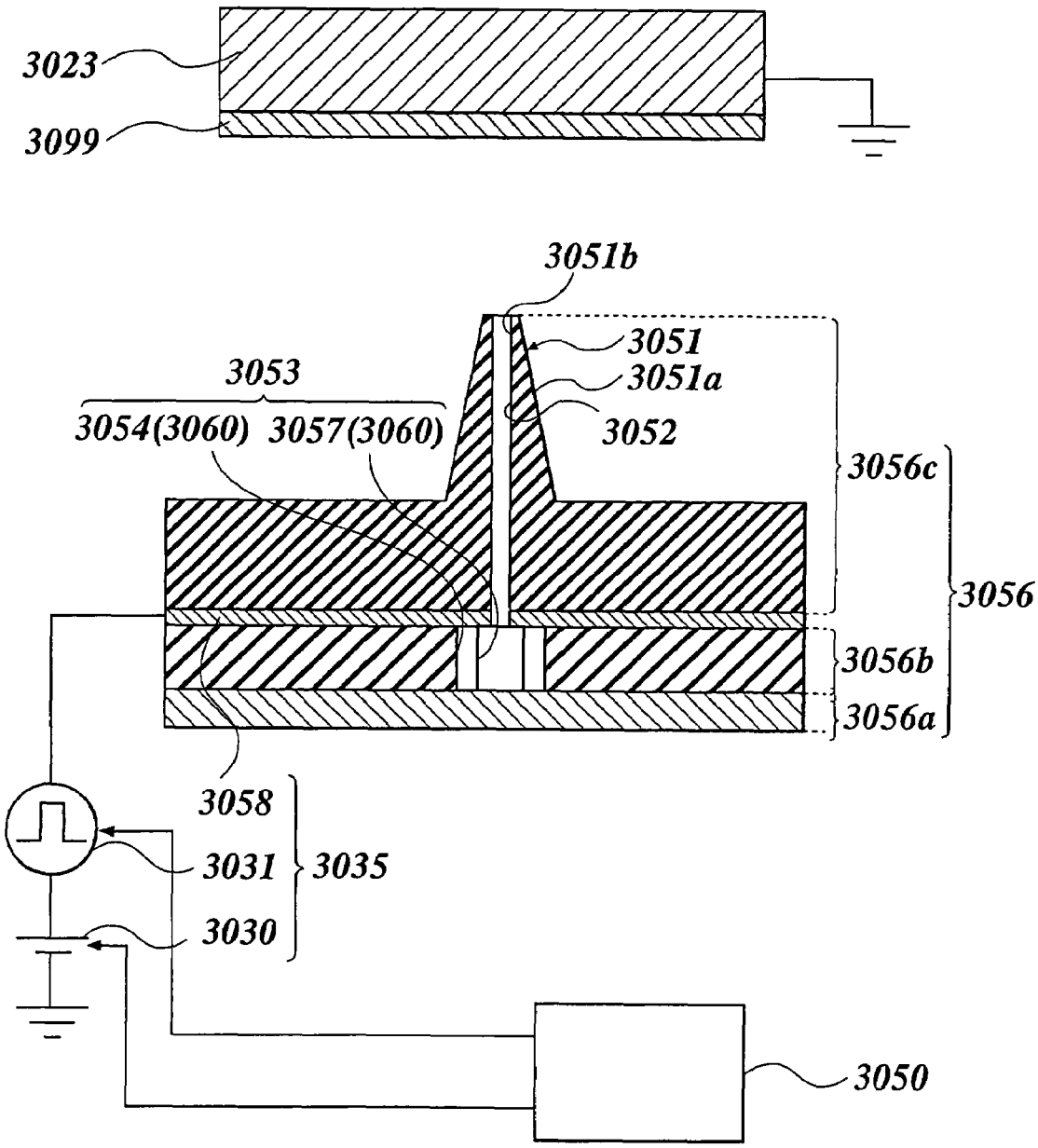
FIG. 40 is a view showing a structure directly relating to a jetting operation of the liquid solution, in the structure of the liquid jetting apparatus 3100.

As shown in FIG. 39 and FIG. 40, the liquid jetting apparatus 3100 comprises: the nozzle 3051 having a super minute diameter for jetting a droplet of chargeable liquid solution from its edge portion; a counter electrode 3023 having a facing surface facing the edge portion of the nozzle 3051 and supporting a base member 3099 for receiving the landing of the droplet; a liquid solution supplying section 3035 for supplying the liquid solution in the nozzle 3051; a jetting voltage applying section 3035 for applying a jetting voltage to the liquid solution in the nozzle 3051; an operation control section 3050 for controlling the applying of the jetting voltage by the jetting voltage applying section 3035; a cleaning device 3200 for cleaning the nozzle 3051 and a supplying passage 3060 with cleaning solvent; and a vibration generating device 3300 for giving a vibration to fine particles in the liquid solution. In addition, the above-mentioned nozzle 3051, a partial structure of the liquid solution supplying unit 3053 and a partial structure of the jetting voltage applying section 3035 are integrally formed by a nozzle plate 3056.

Further, for the convenience of descriptions, a state where the edge portion of the nozzle 3051 faces in a side direction in FIG. 39 and the edge portion of the nozzle 3051 faces upward. However, practically, it is used so that the nozzle 3051 faces in a horizontal direction or a lower direction than the horizontal direction, more preferably the nozzle 3051 faces perpendicularly downward.

Here, structures directly relating to jetting of a droplet by the liquid jetting apparatus 3100 (structures excluding the cleaning device 3200 and the vibration generating device 3300) will be in advance described based on FIG. 40.

Liquid Solution

As an example of the liquid solution jetted by the above-mentioned liquid jetting apparatus 3100, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbitol, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large amount of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate.methacrylic acid copolymer, lauryl methacrylate.2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile. styrene copolymer, styrene.maleate copolymer, styrene.isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene. polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene.vinyl acetate copolymer, ethylene.ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semisynthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

When the liquid jetting apparatus 3100 is used as a patterning method, as a representative example, it is possible to use it for display use. Concretely, it is possible to cite formation of fluorescent material of plasma display, formation of rib of plasma display, formation of electrode of plasma display, formation of fluorescent material of CRT, formation of fluorescent material of FED (Field Emission type Display), formation of rib of FED, color filter for liquid crystal display (RGB coloring layer, black matrix layer), spacer for liquid crystal display (pattern corresponding to black matrix, dot pattern and the like). The rib mentioned here means a barrier in general, and with plasma display taken as an example, it is used for separating plasma areas of each color. For other uses, it is possible to apply it to microlens, patterning coating of magnetic material, ferrodielectric substance, conductive paste (wire, antenna) and the like for semiconductor use, as graphic use, normal printing, printing to special medium (film, fabric, steel plate), curved surface printing, lithographic plate of various printing plates, for processing use, coating of adhesive, sealer and the like using the present embodiment, for biotechnological, medical use, pharmaceuticals (such as one mixing a plurality of small amount of components), coating of sample for gene diagnosis or the like.

Nozzle

The above-mentioned nozzle 3051 is integrally formed with an upper surface layer 3056*c* of the nozzle plate 3056, which will be described later, and is provided to stand up perpendicularly with respect to a flat plate surface of the nozzle plate 3056. Further, in the nozzle 3051, an in-nozzle passage 3052 penetrating from its edge portion along the nozzle center is formed. The in-nozzle passage 3052 is opened at an edge of the nozzle 3051, and thereby a jet opening being an end of the in-nozzle passage 3052 is formed at the edge of the nozzle 3051.

The nozzle 3051 will be described in more detail. In the nozzle 3051, an opening diameter of its edge portion and the in-nozzle passage 3052 are uniform, and as mentioned, these are formed as a super minute diameter. As one concrete example of dimensions of each part, an inside diameter of the in-nozzle passage 3052 (that is, a diameter of the jet opening formed at the edge of the nozzle 3051) is not more than 30[μm], preferably nor less than 20[μm], more preferably not more than 10[μm], more preferably not more than 8[μm], and more preferably not more than 4[μm], and in the present embodiment, the inside diameter of the in-nozzle passage 3052 is set to 1[μm]. Then, an outside diameter at the edge portion of the nozzle 3051 is set to 2[μm], a diameter of the root of the nozzle 3051 is 5[μm], and a height of the nozzle 3051 is set to 100[μm], and its shape is formed as a truncated conic shape being unlimitedly close to a conic shape. In addition, the height of the nozzle 3051 may be 0[μm].

In addition, a shape of the in-nozzle passage 3052 may not be formed linearly with a constant inside diameter as shown in FIG. 40. For example, as shown in FIG. 15A, it may be so formed as to give roundness to a cross-section shape at the edge portion of the side of a liquid solution room 3054, which will be described later, of the in-nozzle passage 3052. Further, as shown in FIG. 15B, an inside diameter at the edge portion of the side of the liquid solution room 3054, which will be described later, of the in-nozzle passage 3052 may be set to be larger than an inside diameter of the edge portion of the jetting side, and an inside surface of the in-nozzle passage 3052 may be formed in a tapered circumferential surface shape. Further, as shown in FIG. 15C, only the edge portion of the side of the liquid solution room 3054, which will be describe later, of the in-nozzle passage 3052 may be formed in a tapered circumferential surface shape and the jetting edge portion side with respect to the tapered circumferential surface may be formed linearly with a constant inside diameter.

Liquid Solution Supplying Unit

The liquid solution supplying unit 3053 comprises a liquid solution containing unit 3061 and a supplying tube 3062, and in addition, comprises the liquid solution room 3054 and a connecting passage 3057 inside of the nozzle plate 3056.

Here, the supplying passage 3060 is structured from the supplying tube 3062, the connecting passage 3057 and the liquid solution room 3054.

The liquid solution containing unit 3061 contains the liquid solution to be supplied to the nozzle 3051. Further, the liquid solution containing unit 3061 supplies the liquid solution to the liquid solution room 3054 by a moderate pressure according to its own weight. However, the liquid solution containing unit 3061 is not capable of supplying the liquid solution in the in-nozzle passage 3052 due to low conductivity by a super minute diameter. Unlike the drawing, normally for giving a current pressure according to its own weight, the liquid solution containing unit 3061 is placed at a higher position than the nozzle plate 3056. Here, the supplying of the liquid solution from the liquid solution containing unit 3061 to the nozzle 3051 is also possible by a sucking pump 3208, which will be described later.

The supplying tube 62 has one edge portion connected to the liquid solution containing unit 3061, and another edge portion is connected to the connecting passage 3057, for supplying the liquid solution in the liquid solution containing unit 3061 to the connecting passage 3057. Further, in the middle of the supplying tube 3062, a three-way switching valve 3209 (will be described later) structuring the cleaning device 3200 is provided.

The connecting passage 3057 is communicated to the supplying tube 3062, and supplies the liquid solution to the liquid solution room 3054.

The liquid solution room 3054 is provided at a position to be a root of the nozzle 3051, and is communicated to the connecting passage 3057 and the in-nozzle passage 3052, and supplies the liquid solution that is supplied to the connecting passage 3057 to the in-nozzle passage 3052.

Jetting Voltage Applying Section

The jetting voltage applying section 3035 comprises: a jetting electrode 3058 for applying a jetting voltage, the jetting electrode 3058 being provided inside of the nozzle plate 3056 and at a border position between the liquid solution room 3054 and the in-nozzle passage 3052; a bias power source 3030 for constantly applying a direct current bias voltage to this jetting electrode 3058; and a jetting voltage power source 3031 for applying a pulse voltage to the jetting electrode 3058 with the bias voltage superimposed, to be an electric potential for jetting.

The above-mentioned jetting electrode 3058 is directly contacted to the liquid solution in the liquid solution room 3054, for charging the liquid solution and applying the jetting voltage.

In regard to the bias voltage by the bias power source 3030, by constantly applying a voltage within a range within which jetting of the liquid solution is not performed, a width of a voltage to be applied at jetting is preliminarily reduced, herewith responsiveness at jetting is improved.

The jetting voltage power source 3031 is controlled by the operation control section 3050, and superimposes the pulse voltage to the bias voltage to be applied only when jetting of the liquid solution is performed. A value of the pulse voltage is set so that a superimposed voltage V at this time satisfies a condition of the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\epsilon_0$: electric constant [F/m], d: nozzle diameter (m], h: distance between nozzle and base member [m], k: proportionality constant dependent on nozzle shape (1.5<k<8.5).

As one example, the bias voltage is applied at DC300[V], and the pulse voltage is applied at 100[V]. Therefore, the superimposed voltage at jetting will be 400[V].

Nozzle Plate

The nozzle plate 3056 comprises: a base layer 3056*a* placed at the lowest layer in FIG. 40; a passage layer 3056*b* placed on top thereof, the passage layer 3056*b* forming a supplying passage of the liquid solution; and an upper surface layer 3056*c* formed further on top of this passage layer 3056*b*. The above-mentioned jetting electrode 3058 is inserted between the passage layer 3056*b* and the upper surface layer 3056*c*.

The above-mentioned base layer 3056*a* is formed from a silicon base plate, highly-insulating resin or ceramic, and a dissolvable resin layer is formed on top thereof and it is eliminated except for a part corresponding to a predetermined pattern for forming the connecting passage 3057 and the liquid solution room 3054, and the insulating resin layer is formed at the eliminated part. This insulating resin layer becomes the passage layer 3056*b*. Then, the jetting electrode 3058 is formed on an upper surface of this insulating resin layer with an electroless plating of a conductive element (for example, NiP), and a resist resin layer having insulating properties is formed further on top thereof. Since this resist resin layer becomes the upper surface layer 3056*c*, this resin layer is formed with thickness in consideration of a height of the nozzle 3051. Then, this insulating resist resin layer is exposed to an electron beam method or femtosecond laser, for forming a nozzle shape. The in-nozzle passage 3052 is also formed by a laser processing. Then, the dissolvable resin layer corresponding to the pattern of the connecting passage 3057 and the liquid solution room 3054 is eliminated, these connecting passage 3057 and the liquid solution room 3054 are communicated, and the nozzle plate 3056 is completed.

In addition, material of the nozzle plate 3056 and the nozzle 3051 may be, concretely, semiconductor such as Si or the like, conductive material such as Ni, SUS or the like, other than insulating material such as epoxy, PMMA, phenol, soda glass, quartz glass or the like. However, in a case of forming the nozzle plate 3056 and the nozzle 3051 from conductive material, at least at the edge portion edge surface of the edge portion of the nozzle 3051, more preferably at the circumferential surface of the edge portion, a coating from insulating material is preferably provided. This is because, by forming the nozzle 3051 from insulating material or forming the insulating material coating at its edge portion surface, at the time of applying the jetting voltage to the liquid solution, it is possible to effectively suppress leakage of electric current from the nozzle edge portion to the counter electrode 3023.

Counter Electrode

The counter electrode 3023 comprises a facing surface perpendicular to a protruding direction of the nozzle 3051, and supports the base member 3099 along the facing surface. A distance from the edge portion of the nozzle 3051 to the facing surface of the counter electrode 3023 is, as one example, set to 100[μm].

Further, since this counter electrode 3023 is grounded, it always maintains a grounded potential. Therefore, at the time of applying the pulse voltage, a droplet jetted by an electrostatic force by an electric field generated between the edge portion of the nozzle 3051 and the facing surface is guided to a side of the counter electrode 3023.

In addition, since the liquid jetting apparatus 3100 jets a droplet by enhancing electric field intensity by electric field concentration at the edge portion of the nozzle 3051 according to the super-miniaturization of the nozzle 3051, it is possible to jet the droplet without the guiding by the counter electrode 3023. However, the guiding by an electrostatic force between the nozzle 3051 and the counter electrode 3023 is preferably performed. Further, it is possible to let out the electric charge of a charged droplet by grounding the counter electrode 3023.

Operation Control Section

The operation control section 3050 is in practice structured from a calculation device including a CPU, a ROM, a RAM and the like. The above-mentioned operation control section 3050 makes the bias power source 3030 apply a voltage continuously, and makes the jetting voltage power source 3031 apply a driving pulse voltage when receiving an input of a jetting instruction from outside.

Jetting Operation of Minute Droplet by Liquid Jetting Apparatus

An operation of the liquid jetting apparatus 3100 will be described with reference to FIG. 40, FIG. 41A, FIG. 41B, FIG. 41C and FIG. 41D.

Figure 41A:
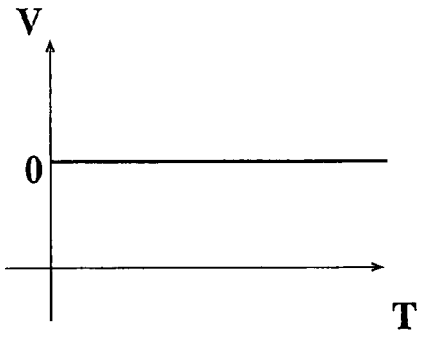
FIG. 41A is a graph showing a relation between time and a voltage applied to the liquid solution in a case of not jetting.
Figure 41B:
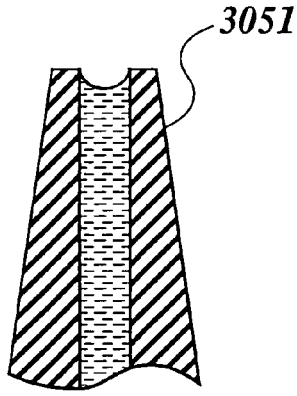
FIG. 41B is a cross-sectional view showing a state of a nozzle 3051 in the case of not jetting.
Figure 41C:
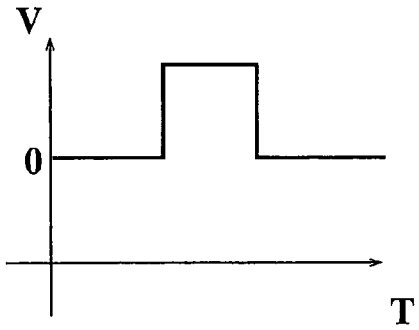
FIG. 41C is a graph showing a relation between time and a voltage applied to the liquid solution in a case of jetting.

In a state where chargeable liquid solution is supplied to the in-nozzle passage 3052 by the sucking pump 3208, and in such a state, the bias voltage is applied to the liquid solution via the jetting electrode 3058 by the bias power source 3030 (refer to FIG. 41A.). In such a state, the liquid solution is charged, and meniscus which dents in a reentrant form by the liquid solution is formed at an edge portion of the nozzle 3041 (refer to FIG. 41B.).

Figure 41D:
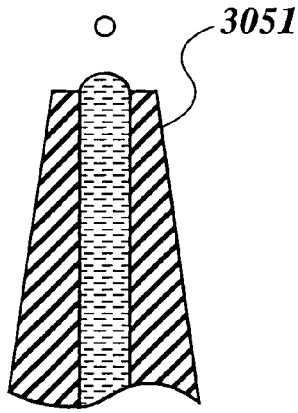
FIG. 41D is a cross-sectional view showing a state of the nozzle 3051 in the case of jetting.

Then, a jetting instruction signal is inputted from the operation control section 3050 to the jetting voltage power source 3031, and when the jetting voltage power source 3031 applies the pulse voltage (refer to FIG. 41C.), the liquid solution is guided to the edge portion side of the nozzle 3051 by an electrostatic force according to electric field intensity of a concentrated electric field at the edge portion of the nozzle 3051, and convex meniscus protruding to outside is formed, and an electric field is concentrated by the top of the convex meniscus, and after all a minute droplet is jetted to the counter electrode side against a surface tension of the liquid solution (refer to FIG. 41D).

Since the above-mentioned liquid jetting apparatus 3100 jets a droplet by the nozzle 3051 having a minute diameter, which was not available conventionally, an electric field is concentrated by the liquid solution in a state of being charged in the in-nozzle passage 3052, and thereby electric field intensity is enhanced. Accordingly, the jetting of the liquid solution by a nozzle having a minute diameter (for example, inside diameter 100[μm], which was conventionally regarded as substantially impossible since a voltage necessary for jetting would become too high with a nozzle having a structure with which concentration of an electric field is not performed, is now possible with a lower voltage than the conventional one.

Then, since it is a minute diameter, it is possible to easily do the control to reduce the jetting current amount per unit time due to low nozzle conductance, and the jetting of the liquid solution with sufficiently small droplet diameter (0.8[μm] according to each of the above-mentioned conditions) without narrowing a pulse width is realized.

Further, since the jetted droplet is charged, a vapor pressure is reduced even with a minute droplet and evaporation is suppressed. Therefore, the loss of droplet mass is reduced, the flying stabilization is given and the decrease of landing accuracy of a droplet is prevented.

Cleaning Device

Next, the cleaning device 3200 will be described with reference to FIG. 39 and FIG. 41.

The cleaning device 3200 comprises: a cleaning solvent containing unit 3201; a first supplying passage 3002; a second supplying passage 3203; an upstream side pump 3204; an open-close valve 3205; a cap member 3206; a communicating tube 3207; a sucking pump 3208; and the three-way switching valve 3209.

The cleaning solvent containing unit 3201 contains cleaning solvent for cleaning the nozzle 3051 and the supplying passage 3060.

The first supplying passage 3202 has one edge portion communicated to the cleaning solvent containing unit 3201 and has another edge portion connected to the cap member 3206, and structures a passage for supplying the cleaning solvent in the cleaning solvent containing unit 3201 to the cap member 3206. Further, in the middle of the first supplying passage 3202, the upstream side pump 3204 and the open-close valve 3205 are provided.

The upstream side pump 3204 is provided at a position being an upstream side with respect to the open-close valve 3205 along a supplying direction of the cleaning solvent of the first supplying passage 3202, and generates a sucking force for supplying the cleaning solvent to the cap member 3206.

The open-close valve 3205 is capable of switching open and close between the cleaning solvent containing unit 3201 and the cap member 3206.

The cap member 3206 comprises a reentrant portion 3042*b* formed corresponding to a contour shape of the nozzle 3051 and a packing 3042*a* formed at a circumference of the reentrant portion 3042*b*.

The reentrant portion 3042*b* comprises predetermined number of jetting holes (illustration omitted) at a surface facing an outside surface 3051 of its nozzle 3051. These jetting holes are communicated to the first supplying passage 3202, and are capable of jetting the cleaning solvent supplied via the first supplying passage 3202 to the outside surface 3051*a* of the nozzle 3051. In other words, the cap member 3206 structures a head portion having a jet opening capable of jetting the cleaning solvent toward the nozzle outside surface 3051*a*.

Further, at the deepest part of the reentrant portion 3042*b*, a sucking hole 3042*c* communicated to the communicating tube 3207 is formed.

Therefore, when the cap member 3206 is attached to the nozzle plate 3056 in a state where the nozzle 3051 is inserted to the reentrant portion 3042*b*, high airtightness to outside is realized, and thereby it is possible to suck an air in the nozzle 3051 effectively. Further, it is possible to perform jetting of the cleaning solvent to the nozzle outside surface 3051*a* and sucking of the jetted cleaning solvent by the sucking pump 3208 (will be described later) via a single cap member 3206.

The sucking pump 3208 is provided in the middle of the communicating tube 3207, and generates a sucking force for sucking the liquid solution and the cleaning solvent. In other words, by performing a sucking operation at the time of cleaning in the nozzle 3041 and the supplying passage 3060, the sucking pump 3208 functions as a cleaning solvent circulating section for circulating the cleaning solvent in the nozzle 3051 and in the supplying passage 3060 by sucking the cleaning solvent from the cleaning solvent containing unit 3201, and also functions as a liquid solution supplying section for supplying the liquid solution to the nozzle 3051 along a supplying direction α by sucking the liquid solution from the liquid solution containing unit 3061.

In addition, the liquid solution or the cleaning solvent sucked by the sucking pump 3208 is drained from an edge portion being an opposite side to the sucking hole 3042*c* of the communicating tube 3207 along an arrow β direction to outside.

The second supplying passage 3203 has one edge portion communicated to the cleaning solvent containing unit 3201 and has another edge portion connected to the three-way switching valve 3209, and structures a passage for supplying the cleaning solvent in the cleaning solvent containing unit 3201 to the three-way switching valve 3209.

The three-way switching valve 3209 is capable of switching open and close of the communication between the cleaning solvent containing unit 3201 and the nozzle 3051. In other words, at the time of circulating the cleaning solvent in the supplying passage 3060 and in the nozzle 3051, the three-way switching valve 3209 makes the communication between the cleaning solvent containing unit 3201 and the nozzle 3051 open, and at the time of supplying the liquid solution to the nozzle 3051, the three-way switching valve 3209 makes the communication between the liquid solution containing unit 3061 and the nozzle 3051 open. Thereby, it is possible to easily switch the communication between the supplying of the liquid solution to the nozzle 3051 by a single sucking pump 3208 and the circulating of the cleaning solvent in the nozzle 3051 and in the supplying passage 3060.

Vibration Generating Device

Next, the vibration generating device 3300 will be described.

The vibration generating device 3300 is provided to be adjacent to the liquid solution containing unit 3061, for example, the vibration generating device 3300 is placed below the liquid solution containing unit 3061 as shown in FIG. 39. Then, by irradiating supersonic waves to the liquid solution in the liquid solution containing unit 3061 to give a vibration to the liquid solution, the vibration generating device 3300 puts fine particles included in the liquid solution in a dispersed state.

Maintenance of Liquid Jetting Apparatus

Next, maintenance of the liquid jetting apparatus 3100 by the cleaning device 3200 and the vibration generating device 3300 will be described.

Here, by carrying out the maintenance of the liquid jetting apparatus 3100 at the time of stopping the jetting of the liquid solution from the nozzle 3051, especially at the time of not performing the jetting of the liquid solution for a long time, a jetting state of the liquid solution is improved. Further, the above-mentioned maintenance may be carried out when the jetting of the liquid solution is not suitably performed because clogging is occurring at the nozzle 3051, or when the liquid jetting apparatus 3100 is in a state where the liquid jetting apparatus 3100 has not been used since being manufactured.

As the maintenance of the liquid jetting apparatus 3100, concretely, three types that are: cleaning in the nozzle 3051 and the supplying passage 3060; cleaning of the nozzle outside surface 3051*a*; and vibration of fine particles in the liquid solution can be cited.

Cleaning in Nozzle and in Supplying Passage

Hereinafter, cleaning in the nozzle 3051 and in the supplying passage 3060 will be described.

In a case of cleaning in the nozzle 3051 and in the supplying passage 3060, first, the three-way switching valve 3209 puts the communication between the cleaning solvent containing unit 3201 and the nozzle 3051 in an open state. Further, the outside surface 3051*a* of the nozzle 3051 is put in a state of being covered with the cap member 3206 by attaching the cap member 3206 to the nozzle 3051.

Next, by activating the sucking pump 3208 for sucking in the nozzle 3051 via the cap member 3206, the liquid solution existing in the supplying passage 3060 and in the nozzle 3051 is sucked, and the cleaning solvent in the cleaning solvent containing unit 3201 is sucked for circulating the cleaning solvent in the supplying passage 3060 and in the nozzle 3051 in the same direction as the supplying direction α of the liquid solution. Thereby, aggregates of fine particles in the liquid solution existing in the supplying passage 3060 or in the nozzle 3051, impurities such as contaminant, solid contents in the liquid solution or the like are drained to outside from the communicating tube 3207 along with the liquid solution, and the cleaning solvent fills in the supplying passage 3060 and the nozzle 3051, instead of the liquid solution. At this time, even if fixing contents are generated at the inside surface of the supplying passage 3060 or in the nozzle 3051 due to solidified liquid solution in the supplying passage 3060 or in the nozzle 3051, the fixing contents are eliminated according to a cleaning effect by the cleaning solvent.

Here, the circulating of the cleaning solvent in the supplying passage 3060 and in the nozzle 3051 may be continuously done by constantly actuating the sucking pump 3208 (this state is hereafter called "circulating state"), or it is possible to have a state where the cleaning solvent is filled in the supplying passage 3060 and in the nozzle 3051 by stopping the actuation of the sucking pump 3208 at a predetermined timing (hereafter, it is called "filled state"). For example, by putting it in the filled state, it is possible to have a state where the cleaning solvent is staying in the supplying passage 3060 and in the nozzle 3051, and thereby it is possible to secure time for the cleaning solvent to act on the aggregates of fine particles, impurities or the like, sufficiently. Thereby, it is possible to make the cleaning solvent effectively act on the fixing contents at the inside surface of the supplying passage 3060 or in the nozzle 3051, without using large amount of the cleaning solvent compared to the case of always circulating the cleaning solvent.

In addition, the filled state may continue for a predetermined period until the jetting of the liquid solution by the liquid jetting apparatus 3100 is restarted, or may be switched to the circulating state at a predetermined timing so as to repeat the circulating state and the filled state alternately. Thereby, since pushing the fixing contents to outside by the move of the cleaning solvent in the circulating state and the cleaning action on the fixing contents of the cleaning solvent staying in the filled state can be repeatedly carried out, it is possible to effectively clean in the supplying passage 3060 and in the nozzle 3051.

In this way, since it is possible to clean in the nozzle 3051 and in the supplying passage 3060, even if the nozzle 3051 is a nozzle 3051 having a super minute diameter, clogging of the nozzle 3051 at the time of jetting the liquid solution does not easily occur, and thereby it is possible to prevent clogging of the nozzle 3051.

In addition, for the purpose of cleaning in the supplying passage 3060, the three-way switching valve 3209 is preferably placed as close as possible to the side of the liquid solution containing unit 3061 at the supplying tube 3062. That is because, in other words, compared to the case of placing the three-way switching valve 3209 to the side of the nozzle 3051 at the supplying tube 3062, it is possible to do the cleaning by circulating the cleaning solvent to larger area in the supplying tube 3062.

Cleaning of Nozzle Outside Surface

Hereinafter, cleaning of the nozzle outside surface 3051*a* will be described.

Cleaning of the outside surface 3051*a* of the nozzle 3051 is carried out after the above-mentioned cleaning in the nozzle 3051 and in the supplying passage 3060. In other words, in a state where the cap member 3206 is attached to the nozzle 3051, the three-way switching valve 3209 puts the communication between the cleaning solvent containing unit 33201 and the nozzle 3051 in a close state, and the open-close valve 3205 puts the communication between the cap member 3206 and the cleaning solvent containing unit 3201 in an open state.

Next, by actuating the upstream side pump 3204, the cleaning solvent in the cleaning solvent containing unit 3201 is sucked via the first supplying passage 3202, and the cleaning solvent is jetted toward the outside surface 3051*a* of the nozzle 3051 from a jetting hole of the cap member 3206, and by actuating the sucking pump 3208, the cleaning solvent staying in the reentrant portion 3042*b* by being jetted from the jetting hole is sucked via a sucking hole 3042*c*. Thereby, since it is possible to make the cleaning solvent act on the fixing contents in a state of being fixed at the outside surface 3051*a* of the nozzle 3051, especially at a liquid solution jet opening 3051*b* (refer to FIG. 2) of the nozzle 3051 by repeating the jetting of the liquid solution from the nozzle 3051, it is possible to clean the outside surface 3051*a* of the nozzle 3051 by eliminating the fixing contents according to the cleaning action of the cleaning-solvent.

In this way, the fixing contents at the edge portion of the nozzle 3051, at which clogging easily occurs, can be eliminated by cleaning with the cleaning solvent jetted toward a nozzle hole from the cap member 3206, and continuously, inside of the nozzle 3051 and a supplying passage of the jetting liquid solution can be smoothly cleaned by a sucking operation by the sucking pump 3208.

Here, the cleaning of the outside surface 3051*a* of the nozzle 3051 may be carried out along with the cleaning by the circulation of the cleaning solvent in the nozzle 3051 and in the supplying passage 3060, and thereby, it is possible to enhance operation efficiency at the maintenance in view of preventing clogging of the nozzle 3051.

Further, jetting the cleaning solvent to the outside surface of the nozzle 3051 perpendicularly at least with respect to the nozzle edge surface having a nozzle shape of a protruding type, is important, and faster circulation is more preferable.

Vibration of Fine Particles in Liquid Solution

Hereinafter, a vibration of fine particles in the liquid solution will be described.

In a case of carrying out a vibration of fine particles in the liquid solution, by actuating the vibration generating device 3300, supersonic waves are irradiated to the liquid solution in the liquid solution in the liquid solution containing unit 3061. Thereby, fine particles included in the liquid solution are dispersed with the vibration given to the liquid solution, and a density of the fine particles in the liquid solution is put in an unbiased state. In other words, for example, even if aggregates of fine particles are formed in the liquid solution, since irradiation of supersonic waves crushes the aggregates, bias of the density of fine particles in the liquid solution is erased.

In this way, aggregates of fine particles formed by aggregating fine particles in the liquid solution are not easily generated, and at the time of supplying the liquid solution from the liquid solution containing unit 3061 to the nozzle 3051, it is possible to reduce the possibility of the aggregates clogging at the nozzle 3051, and also possible to reduce the possibility of aggregates of fine particles being fixed to the nozzle 3051 or the supplying passage 3060.

Further, by irradiating supersonic waves from outside of the liquid solution containing unit 3061, it is possible to give vibration to the liquid solution without contacting the liquid solution, and thereby it is possible to suitably disperse fine particles in the liquid solution. Accordingly, it is possible to enhance operation efficiency in view of dispersion of fine particles in the liquid solution.

In addition, a vibration of fine particles in the liquid solution may be carried out at a predetermined timing, or may be carried out every time at supplying the liquid solution to the nozzle 3051. Further, a vibration of fine particles in the liquid solution may be carried out in a state where the liquid solution is not supplied to the nozzle 3051, especially at the time of cleaning in the nozzle 3051 and in the supplying passage 3060, or cleaning the nozzle outside surface 3051*a*. In other words, in a case of performing jetting of the liquid solution as soon as the completion of cleaning in the nozzle 3051 and in the supplying passage 3060, or the nozzle surface 3051*a*, by carrying out the vibration of fine particles in the liquid solution in advance, it is possible to efficiently supply the liquid solution in which aggregates of fine particles do not exist to the nozzle 3051.

Further, the present invention is not limited to the above-mentioned embodiments, and various improvements and changes of design may be applied without departing the gist of the present invention.

For example, by having a structure where the cleaning solvent is supplied to the outside surface of the nozzle 3051, or in the supplying passage 3060 and in the nozzle 3051 after vibration having high frequency of mega-Hertz is given to the cleaning solvent in the first supplying passage 3202 or in the supplying tube 3062 by a predetermined vibration generating section, it is possible to easily clean and eliminate submicronic fine particles, which are difficult to eliminate with normal streaming cleaning solvent.

In addition, in the above-mentioned embodiment, cleaning in the nozzle 3051 and in the supplying passage 3060 is carried out with the cleaning solvent. However, the present invention is not limited to this, and it is possible to prevent clogging of the nozzle 3051 by at least circulating the cleaning solvent in the nozzle 3051 to carry out the cleaning. In other words, the cleaning solvent contained in the cleaning solvent containing unit 3201 may be directly guided in the nozzle 3051 without intervening the supplying passage 3060 for the circulation.

Further, at the time of cleaning the nozzle outside surface 3051*a*, the cleaning solvent is supplied to the cap member 3206 by the actuation of the upstream side pump 3204. However, the present invention is not limited to this. For example, jetting of the cleaning solvent to the nozzle outside surface 3051*a* and sucking of the jetted cleaning solvent may be carried out by only the sucking pump 3208 without the upstream side pump 3204 provided. Thereby, since it is possible to simplify the structure of the cleaning device 3200, it is possible to carry out operations regarding the cleaning by the cleaning device 3200, easily.

Theoretical Description of Liquid Jetting by Liquid Jetting Apparatus

Hereinafter, a theoretical description of liquid jetting in each of the above-mentioned embodiments and a description of a basic example based on this will be made. In addition, all the contents such as a nozzle structure, material of each part and properties of jetted liquid, a structured added around the nozzle, a control condition regarding a jetting operation and the like in the theory and the basic example described hereafter may be, needless to say, applied in each of the above-mentioned embodiments as much as possible.

Approach to Realize Applying Voltage Decrease and Stable Jetting of Minute Droplet Amount Previously, jetting of a droplet with exceeding a range determined by the following conditional equation was considered impossible.

$$d < \frac{\lambda_c}{2} \tag{4}$$

Where, $\lambda_c$ is growth wavelength [m] at liquid level of the liquid solution for making it possible to jet a droplet from the nozzle edge portion by an electrostatic sucking force, and it can be calculated by $$\lambda_c = 2\Pi\gamma h^2/\epsilon_0 V^2.$$

$$d < \frac{\pi\gamma h^2}{\varepsilon_0 V^2} \tag{5}$$

$$V < h\sqrt{\frac{\pi\gamma}{\varepsilon_0 d}} \tag{6}$$

In each of the embodiments to which the present invention is applied, a role in an electrostatic sucking type inkjet method played by the nozzle is reconsidered, in an area where attempt was not made since it was conventionally regarded as impossible to jet, it is possible to form a minute droplet by using a Maxwell force or the like.

An equation for approximately expressing a jetting condition or the like for the approach to reduce a driving voltage and to realize jetting of minute droplet amount in this way is derived and therefore described hereafter.

Descriptions hereafter can be applied to the liquid jetting apparatus described in each of the above-mentioned embodiments.

Figure 42:
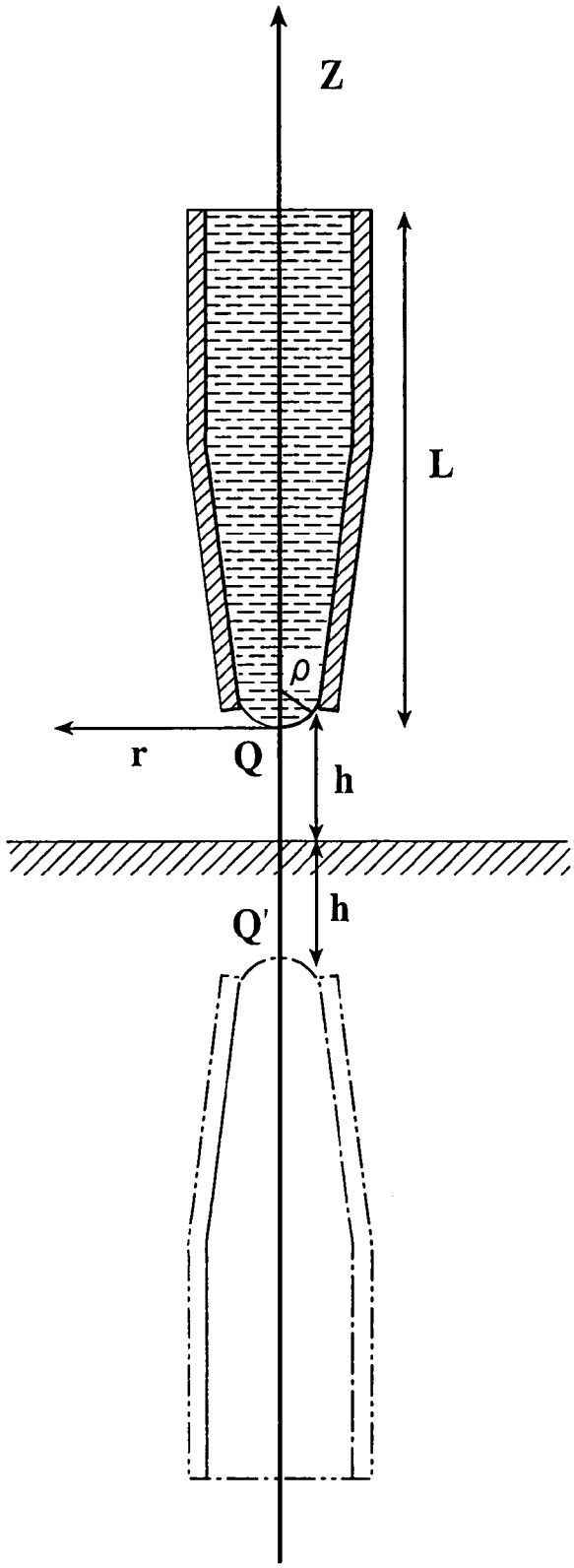
FIG. 42 is a view for describing a calculation of an electric field intensity of the nozzle of each embodiment.

Assuming that conductive liquid solution is filled to a nozzle of inside d and the nozzle is perpendicularly placed with a height h with respect to an infinite plane conductor as a base member at this moment. This state is shown in FIG. 42. At this time, it is assumed that electric charge induced at the nozzle edge portion is concentrated to a hemisphere portion of the nozzle edge, and is approximately expressed in the following equation.

$$Q = 2\pi\epsilon_0 \alpha V d \tag{7}$$

where Q: electric-charge-induced at the nozzle edge portion [C], $\epsilon_0$: electric constant [F/m], h: distance between nozzle and base member [m], r: radius of a diameter of inside of the nozzle [m], and V: total voltage applied to the nozzle. α: proportionality constant dependent on a nozzle shape or the like, taking around 1 to 1.5, especially takes approximately 1 when d<<h.

Further, when the base plate as the base member is a conductive base plate, it is considered that an image charge Q' having opposite sign is induced to the symmetrical position in the base plate. When the base plate is insulating material, similarly an image charge Q' of opposite sign is induced to the symmetrical position determined by a conductivity.

By the way, electric field intensity $E_{loc}$[V/m] of the edge portion of convex meniscus at the nozzle edge portion is, when a curvature radius of the convex meniscus is assumed to be R[m], given as $$E_{loc} = \frac{V}{kR} \tag{8}$$

where k: proportionality constant, though being different depending on a nozzle shape or the like, taking around 1.5 to 8.5, and in most cases considered approximately 5 (P. J. Birdseye and D. A. Smith, Surface Science, 23 (1970) 198-210).

Now, for ease, we assume d/2=R. This corresponds to a state where the conductive liquid solution rises in a hemisphere shape having the same radius as the nozzle radius according to a surface tension.

We consider a balance of pressure affecting liquid of the nozzle edge. First, when a liquid area at the nozzle edge portion is assumed to be S[$m^2$], electrostatic pressure is given as $$P_e = \frac{Q}{S}E_{loc} \approx \frac{Q}{\pi d^2/2}E_{loc} \tag{9}$$

From the equations (7), (8) and (9), it is assumed that $\alpha=1$, $$P_e = \frac{2\varepsilon_0 V}{d/2}\cdot\frac{V}{k\cdot d/2} = \frac{8\varepsilon_0 V^2}{k\cdot d^2} \tag{10}$$

Meanwhile, when a surface tension of the liquid at the nozzle edge portion is $P_s$, $$P_s = \frac{4\gamma}{d} \tag{11}$$

where, $\lambda$: surface tension [N/m].

A condition under which jetting of fluid occurs is, since it is a condition where the electrostatic pressure exceeds the surface tension, given as $$P_e > P_s \tag{12}$$

By using a sufficiently-small nozzle diameter, it is possible to make the electrostatic pressure exceed the surface tension. According to this relational equation, when a relation between V and d is calculated, $$V > \sqrt{\frac{\gamma k d}{2\varepsilon_0}} \tag{13}$$

gives the minimum voltage of jetting. In other words, from the equation (6) and the equation (13), $$h\sqrt{\frac{\gamma\pi}{\varepsilon_0 d}} > V > \sqrt{\frac{\gamma k d}{2\varepsilon_0}} \tag{1}$$

gives an operation voltage in the embodiments of the present invention.

Dependency of a jetting limit voltage $V_c$ with respect to a nozzle of a certain radius d is shown in the above-mentioned FIG. 9. From this drawing, when a concentration effect of an electric field by the minute nozzle is considered, the fact that the jetting start voltage decreased according to the decrease of the nozzle diameter was revealed.

In a case of making a conventional consideration with respect to an electric field, that is, an electric field which is only defined by a voltage applied to a nozzle and by a distance between counter electrodes, as the nozzle becomes smaller, a voltage necessary for jetting increases. On the other hand, focusing on local electric field intensity, due to nozzle miniaturization, it is possible to decrease the jetting voltage.

The jetting according to electrostatic sucking is based on charging of liquid (liquid solution) at the nozzle edge portion. Speed of the charging is considered to be approximately a time constant determined by dielectric relaxation.

$$\tau = \frac{\varepsilon}{\sigma} \tag{2}$$

When it is assumed that dielectric constant of the liquid solution $\epsilon$ is 10 F/m, and liquid solution conductivity $\sigma$ is $10^{-6}$ S/m, $\tau=1.854\times10^{-6}$ sec is obtained. Alternatively, when a critical frequency is set to $f_c$[Hz], $$f_c = \frac{\sigma}{\varepsilon} \tag{14}$$

is obtained. It is considered that jetting is impossible because it is not possible to react to the change of an electric field having faster frequency than this $f_c$. When estimation regarding the above-mentioned example is made, the frequency takes around 10 kHz. At this time, in a case of a nozzle radius of 2 μm and a voltage of a little under 500V, it is possible to estimate that current in the nozzle G is $10^{-13}$ $m^3$/s. In a case of the liquid of the above-mentioned example, since it is possible to perform the jetting at 10 kHz, it is possible to achieve minimum jetting amount at one cycle of around 10 fl (femto liter, 1 fl=$10^{-16}$ l).

In addition, each of the above-mentioned embodiments, as shown in FIG. 23, is characterized by a concentration effect of an electric field at the nozzle edge portion and by an act of an image force induced to the counter base plate. Therefore, it is not necessary to have the base plate or a base plate supporting member electrically conductive as conventionally, or to apply a voltage to these base plate or base plate supporting member. In other words, as the base plate, it is possible to use a glass base plate being electrically insulating, a plastic base plate such as polyimide, a ceramics base plate, a semiconductor base plate or the like.

Further, in each of the above-mentioned embodiments, the applying voltage to an electrode may be any of plus or minus.

Further, by maintaining a distance between the nozzle and the base plate not more than 500[μm], it is possible to make the jetting of the liquid solution easy. Further, preferably, the nozzle is maintained constant with respect to the base member by doing a feedback control according to a nozzle position detection.

Further, the base member may be mounted on a base member holder being either electrically conductive or insulating to be maintained.

Figure 43:
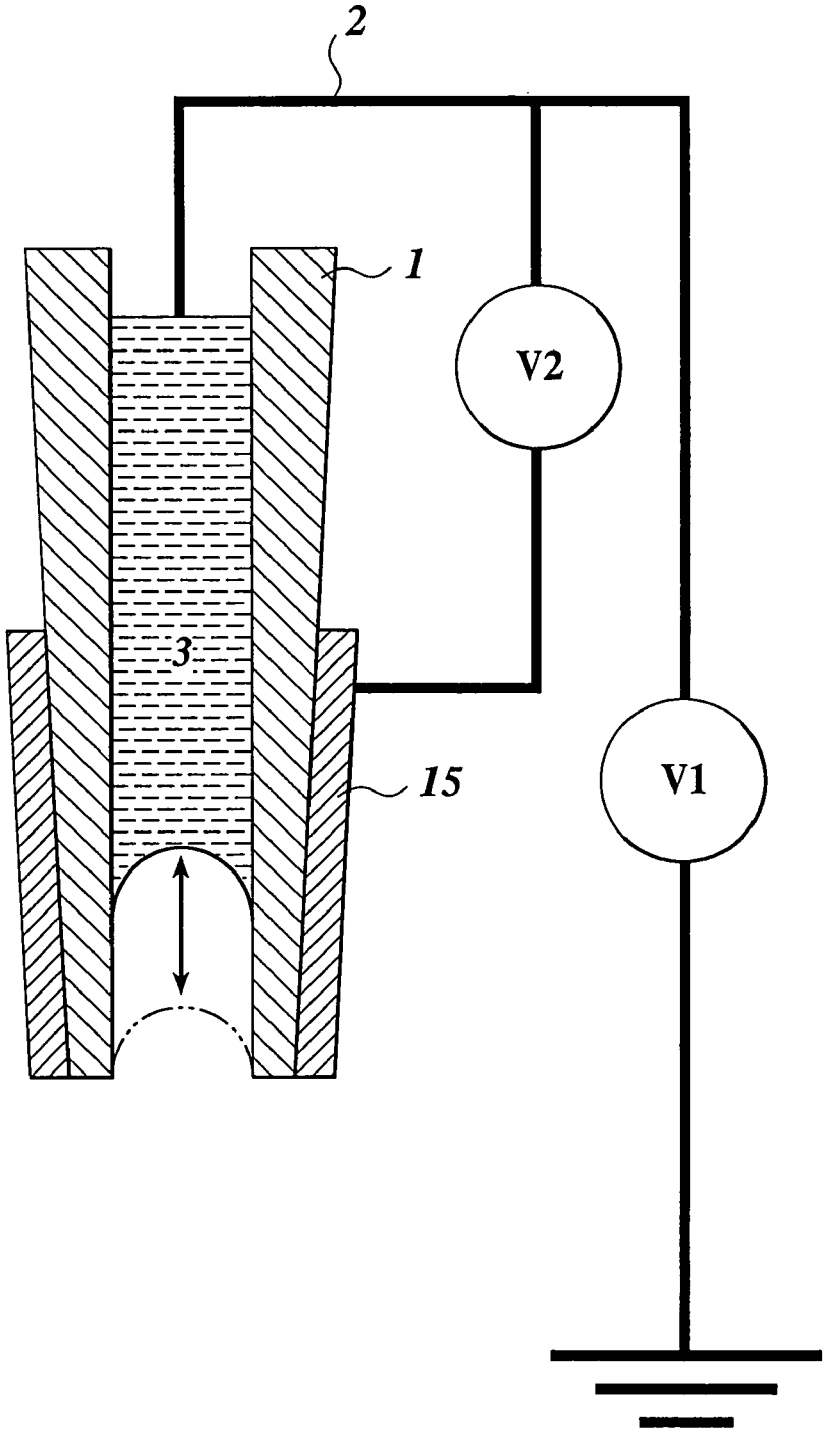
FIG. 43 is a side cross-sectional view of a liquid jetting mechanism.

FIG. 43 shows a side cross-sectional view of a nozzle part of the liquid jetting apparatus as one example of another basic example to which the present invention is applied. At a side surface portion of a nozzle 1, an electrode 15 is provided, and a controlled voltage is applied between the electrode 15 and an in-nozzle liquid solution 3. The purpose of this electrode 15 is, an electrode for controlling Electrowetting effect. When a sufficient electric field covers an insulator structuring the nozzle, it is expected that the Electrowetting effect occurs even without this electrode. However, in the present basic example, by doing the control using this electrode more actively, the role of a jetting control is also achieved. In the case that the nozzle 1 is structured from insulating material, a nozzle tube at the nozzle edge portion is 1 μm, a nozzle inside diameter is 2 μm and an applying voltage is 300V, it becomes Electrowetting effect of approximately 30 atmospheres. This pressure is insufficient for jetting but has a meaning in view of supplying the liquid solution to the nozzle edge portion, and it is considered that control of the jetting is possible by this control electrode.

The above-mentioned FIG. 9 shows dependency of nozzle diameter of the jetting start voltage in the embodiment to which the present invention is applied. As the nozzle of the liquid jetting apparatus, one shown in the liquid jetting head 100 shown in FIG. 11, one shown in FIG. 23, one shown in FIG. 31 and one shown in FIG. 40 are used. As the nozzle becomes smaller, the jetting start voltage decreases, and the fact that it was possible to perform jetting at a lower voltage than conventionally was revealed.

In each of the above-mentioned embodiments, conditions for jetting the liquid solution are respective functions of: a distance between nozzle and base plate (h); an amplitude of applying voltage (V); and an applying voltage frequency (f), and it is necessary to satisfy certain conditions respectively as the jetting conditions. Adversely, when any one of the conditions is not satisfied, it is necessary to change another parameter.

Figure 44:
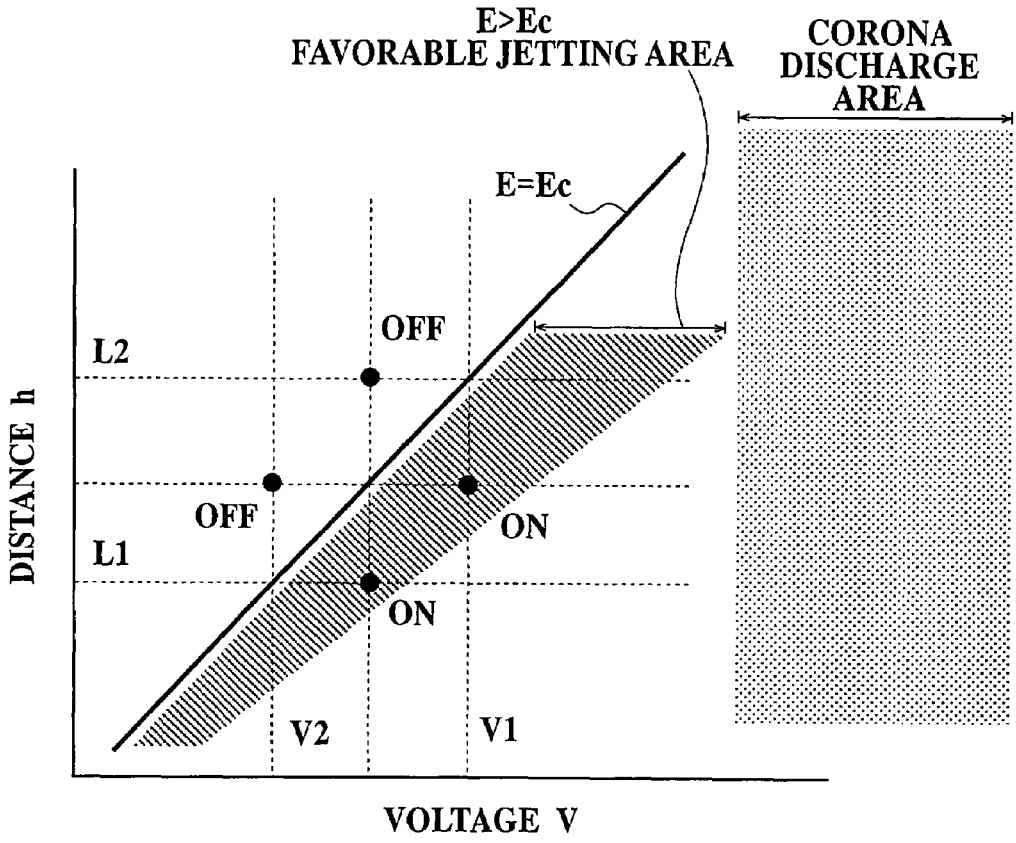
FIG. 44 is a view for describing a jetting condition according to a relation of distance-voltage in the liquid jetting apparatus of each embodiment.

This state will be described with reference to FIG. 44.

First, for jetting, a certain critical electric field $E_c$ exists, where jetting is not performed unless an electric field is not less than the electric field $E_c$. This critical electric field is a value changed according to the nozzle diameter, a surface tension of the liquid solution, viscosity or the like, and it is difficult to perform the jetting when the value is not more than $E_c$. At not less than the critical electric field $E_c$, that is, at jetting capable electric field intensity, approximately a proportional relation arises between the distance between nozzle and base plate (h) and the amplitude of applying voltage (V), and when the distance between nozzle and base plate is squeezed, it is possible to make the critical applying voltage V smaller.

Adversely, when the distance between nozzle and base member h is made extremely apart for making the applying voltage V larger, even if the same electric field intensity is maintained, according to an effect such as corona discharge or the like, blowout of fluid droplet, that is, burst occurs.

INDUSTRIAL APPLICABILITY

In accordance with the present invention, since the nozzle is formed by only exposing and developing a photosensitive resin layer, it is possible to have a benefit in view of flexibility of a nozzle shape, adaptability of a line head having large number of nozzle, and production cost.

Further, since a plurality of nozzle shapes are formed and the respective in-nozzle passages are communicated to an electrode, it is possible to apply the jetting voltage to the liquid solution supplied to the respective in-nozzle passages via the electrode. By applying the jetting voltage to the electrode, a droplet is jetted from the edge portion of the nozzle shape, and a pattern corresponding to a dot made by the droplet that has landed on the base member is formed on the base member. Since a plurality of such nozzle shapes are formed on the base plate, it is possible to form the pattern quickly.

In such a case, it is possible to jet a droplet without providing a counter electrode facing the edge portion of the nozzle. For example, in a state where a counter electrode does not exist, when the base member is so placed as to face the nozzle edge portion, an image charge having opposite polarity is induced at a position being plane symmetry to the nozzle edge portion with respect to a receiving surface of the base member when the base member is conductive material, and an image charge having opposite polarity is induced at a symmetrical position determined according to dielectric constant of the base member with respect to the receiving surface of the base member when the base member is insulating material. Then, flying of droplet is performed according to an electrostatic force between the charge induced at the nozzle edge portion and the image charge.

Further, since the liquid solution in the in-nozzle passage rises in a convex shape at the edge portions of the respective nozzle shapes, an electric field is concentrated to the convex portion of the liquid solution even when a voltage applied to the electrode is low, and electric field intensity is significantly enhanced. Therefore, even when a voltage applied to the electrode is low, a droplet is jetted from the edge portion of the nozzle shape.

Further, in accordance with the present invention, since the liquid level is within the nozzle, the liquid solution is suppressed from adhering around the nozzle jet opening, and thereby it is possible to prevent the liquid solution from being dried. Further, since it is possible to maintain a state where charged components are uniformly dispersed in the liquid solution, it is possible to prevent the charged components from being aggregated, and possible to consistently move the liquid solution. Further, since a repeating voltage which oscillates within a smaller voltage range than the jetting start voltage is applied, it is possible to stir the charged components in the liquid solution in a state where a droplet is not jetted, it is possible to suppress the charged components from being aggregated, and it is possible to consistently move the liquid solution. As above, it is possible to prevent the liquid solution from adhering to the nozzle, and it is possible to prevent clogging of the nozzle.

Further, in accordance with the present invention, since a coating having high water repellency is so formed as to surround the jet opening of the nozzle, the effect that the liquid solution does not easily wet and spread to outside from the inside diameter of the coating is obtained. Further, since the nozzle is formed from a fluorine-containing photosensitive resin, the effect that the liquid solution does not easily wet and spread is obtained. Since a contact angle between the liquid solution and the material of the circumference of the jet opening of the nozzle is not less than 45 degree, further not less than 90 degree or further not less than 130 degree, the effect that the liquid solution does not easily wet and spread to the circumference of the jet opening of the nozzle is obtained. As above, at the nozzle edge portion, it is possible to create a large curvature of the convex meniscus at a higher level, and it is possible to concentrate an electric field at the top of the meniscus with higher concentration. As a result, it is possible to make a droplet minute. Further, since it is possible to form meniscus having a minute diameter, an electric field is easily concentrated to the top of the meniscus, and thereby it is possible to make the jetting voltage become a low voltage.

Further, in accordance with the present invention, since the cleaning solvent is circulated in the nozzle, or both in the nozzle and in the supplying passage, for example, aggregates of fine particles existing in the nozzle or in the supplying passage are drained to outside, and it is possible to clean in the nozzle and in the supplying passage. Further, even in a state where the aggregates of fine particles adhere to the inside surface of the supplying passage or in the nozzle, by eliminating the aggregates from the inside surface of the supplying passage according to a cleaning effect of the circulated cleaning solvent, it is possible to clean the inside surface of the supplying passage and in the nozzle. Further, for example, impurities such as contaminant existing in the nozzle or in the supplying passage, solid contents generated by solidifying the liquid solution or the like can be eliminated by the cleaning solvent. As above, since it is possible to clean in the nozzle and in the supplying passage, even with a nozzle having the nozzle diameter of not more than 30 μm, clogging of the nozzle at the time of jetting the liquid solution does not easily occur, and it is possible to prevent clogging of the nozzle.

Further, in accordance with the present invention, by using a nozzle having a super minute diameter, which was not conventionally available, it is possible to concentrate an electric field to the nozzle edge portion and to enhance electric field intensity. In this case, it is possible to jet a droplet without providing a counter electrode facing the edge portion of the nozzle. Flying of the droplet is performed according to an electrostatic force between the charge induced at the nozzle edge portion and the image charge at the base member side.

Therefore, it is possible to suitably jet a droplet when the base member is either conductive material or insulating material. Further, it is possible to make the existence of a counter electrode not necessary. Further, thereby, it is possible to reduce the number of equipments in the apparatus structure. Therefore, when the present invention is applied to a business-use inkjet system, it is possible to contribute to improving the productivity of the whole system, and also possible to reduce the cost.

Further, since a voltage is applied by the jetting voltage applying section, it is possible to apply the voltage to the liquid solution with a simple structure. Further, by having an electric potential difference between an applying voltage by a liquid-supplying-use electrode provided outside of a portion where the inside surface of the nozzle is insulating and an applying voltage by the jetting voltage applying section, it is possible to obtain the electrowetting effect, and by the improvement of wettability in the nozzle, it is possible to smoothen the supplying of the liquid solution to the nozzle having a super minute diameter.

Further, by making a nozzle more minute, it is possible to concentrate an electric field to the nozzle edge portion even more. As a result, it is possible to make a formed droplet minute and has a stable shape, and also possible to reduce the total applying voltage.

The invention claimed is:

1. A producing method of an electrostatic sucking type liquid jetting head having a plurality of nozzles for jetting liquid solution as a droplet from a nozzle edge, comprising:

forming a plurality of jetting electrodes on a base plate for applying a jetting voltage;

forming a photosensitive resin layer on the base plate so as to cover all of the plurality of jetting electrodes;

making the photosensitive resin layer stand with respect to the base plate so as to correspond to each jetting electrode and so as to form the photosensitive resin layer in a nozzle shape having a nozzle diameter of more than 0.2 μm and of not more than 4 μm, by exposing and developing the photosensitive resin layer;

forming an in-nozzle passage so as to establish a communication from an edge portion of the nozzle to the jetting electrode in the nozzle; and connecting the in-nozzle passage to a liquid solution supplying channel corresponding to the plurality of nozzles.

2. The producing method of the electrostatic sucking type liquid jetting head of claim 1, further comprising:

making at least an inside surface of each liquid solution supplying channel insulating; and providing a control electrode for controlling a meniscus position of the liquid solution at the edge portion of the nozzle, in the liquid solution supplying channel.

3. The producing method of the electrostatic sucking type liquid jetting head of claim 2, wherein the liquid solution supplying channel is formed from a piezoelectric material.

4. The producing method of the electrostatic sucking type liquid jetting head of claim 1, wherein the photosensitive resin layer is a fluorine-containing resin.

5. A producing method for producing a nozzle plate having a plurality of nozzles for jetting liquid solution as a droplet from a nozzle edge, comprising:

forming a plurality of jetting electrodes on a base plate for applying a jetting voltage;

forming a photosensitive resin layer on the base plate so as to cover all of the plurality of jetting electrodes;

making the photosensitive resin layer stand with respect to the base plate so as to correspond to each jetting electrode and so as to form the photosensitive resin layer in a nozzle shape having a nozzle diameter of more than 0.2 μm and of not more than 4 μm, by exposing and developing the photosensitive resin layer; and forming an in-nozzle passage so as to establish a communication from an edge portion of the nozzle to the jetting electrode in the nozzle.

6. The producing method of the nozzle plate of claim 5, wherein the photosensitive resin layer is a fluorine-containing resin.

* * * * *

UNITED STATES PATENT AND TRADEMARK OFFICE

CERTIFICATE OF CORRECTION

PATENT NO. : 7,449,283 B2
APPLICATION NO. : 10/529332
DATED : November 11, 2008
INVENTOR(S) : Nishi et al.

It is certified that error appears in the above-identified patent and that said Letters Patent is hereby corrected as shown below:

Title Page, item (73), Assignee, delete "Sharp Kabushiki Kaisha (JP)" and insert therefor --Konica Minolta Holdings, Inc. Japan; Sharp Kabushiki Kaisha, Japan; National Institute of Advanced Industrial Science and Technology, Japan--.

Signed and Sealed this

Thirtieth Day of March, 2010

David J. Kappos

David J. Kappos
*Director of the United States Patent and Trademark Office*